US006148803A

United States Patent [19]

Majima et al.

[11] Patent Number: 6,148,803

[45] Date of Patent: Nov. 21, 2000

[54] LEAKAGE DIAGNOSING DEVICE FOR FUEL EVAPORATED GAS PURGE SYSTEM

[75] Inventors: Yoshihiro Majima; Takeshi Fujimoto, both of Kariya; Keiji Wakahara, Nagoya; Junya Morikawa, Toyota; Shigenori Isomura; Makoto Miwa, both of Kariya, all of Japan

[73] Assignee: Denso Corporation, Japan

[21] Appl. No.: 09/204,141

[22] Filed: Dec. 3, 1998

[30] Foreign Application Priority Data

| | | | |
|---|---|---|---|
| Dec. 4, 1997 | [JP] | Japan | 9-333397 |
| Jan. 26, 1998 | [JP] | Japan | 10-012171 |
| Jan. 30, 1998 | [JP] | Japan | 10-019298 |
| May 8, 1998 | [JP] | Japan | 10-125584 |
| Jun. 2, 1998 | [JP] | Japan | 10-152841 |

[51] Int. Cl.[7] ..... F02M 33/00

[52] U.S. Cl. ..... 123/520; 73/118.1

[58] Field of Search ..... 123/516, 518, 123/519, 520; 73/118.1

[56] References Cited

U.S. PATENT DOCUMENTS

| | | | |
|---|---|---|---|
| 5,315,980 | 5/1994 | Otsuka et al. . | |
| 5,317,909 | 6/1994 | Yamada et al. . | |
| 5,425,344 | 6/1995 | Otsuka et al. . | |
| 5,461,569 | 10/1995 | Hara et al. | 123/520 |
| 5,679,890 | 10/1997 | Shinohara et al. | 123/519 |
| 5,680,849 | 10/1997 | Morikawa et al. . | |
| 5,857,447 | 1/1999 | Shinohara | 123/520 |

FOREIGN PATENT DOCUMENTS

| | | |
|---|---|---|
| 9-177617 | 9/1997 | Japan . |
| 11-229985 | 8/1999 | Japan . |

OTHER PUBLICATIONS

Co–pending, commonly owned U.S. application No. 09/113,281 of Fujimoto et al for "Abnormality Detection Apparatus for Preventing Fuel Gas Emission", filed Jul. 10, 1998.

*Primary Examiner*—Thomas N. Moulis
*Attorney, Agent, or Firm*—Nixon & Vanderhye PC

[57] ABSTRACT

A leakage diagnosing apparatus for an evaporated gas purge system, which executes purge system leakage diagnosis based on a detected pressure change amount and an introduced pressure which is introduced into a part of the purge system including at least a fuel tank and a canister. The detected pressure change amount is obtained by detecting pressure in the part of the purge system after such part of the purge system is hermetically sealed. Accordingly, the reliability of the leakage diagnosis is improved because an erroneous diagnosis caused by the introduced pressure is prevented. The detected pressure change amount may be compensated based on the introduced pressure into the sealed gas purge system. Accordingly, an erroneous leakage determination is prevented, and the reliability of leakage determination is improved.

59 Claims, 39 Drawing Sheets

FIG. 4A CCV

FIG. 4B PCV

FIG. 4C PRESSURE OF GAS PURGE PASSAGE

PGRMX (%)

(mmHg)

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(rpm)

START
401
I/S ON ?
YES
NO
402
XPRG = 1 ?
NO
YES
403
UNDER ACCELERATION/ DECELERATION ?
YES
NO
404
XNFGPG = 1 ?
NO
YES
405
PGR > β%?
NO
YES
406
|1-FAFAV| > ω%?
NO
YES
407
FGPG = FGPG(i-1) + (FAFAV - 1)/PGR
408
XNFGPG = 1?
YES
NO
409
STABILIZED?
NO
YES
410
XNFGPG = 1
411
CALCULATE FGPGAV
RETURN
412
FGPG = 1.0
413
FGPGAV = 1.0
414
XNFGPG = 0
RETURN

| FIG. 15A |
| --- |
| FIG. 15B |

| COOLING WATER TEMP. (°C) | 0 | 20 | 40 | 60 |
|---|---|---|---|---|
| KFLGA | 0.2 | 0.2 | 0.05 | 0.05 |
| KFLGB | 0.2 | 0.2 | 0.1 | 0.05 |

| PURGE EXECUTION ACCUMULATED TIME (sec) | 0 | 100 | 200 | 300 |
|---|---|---|---|---|
| KFLGA | 0.2 | 0.05 | 0.05 | 0.05 |
| KFLGB | 0.2 | 0.1 | 0.05 | 0.05 |

FIG. 19A

| AV. INJECTION PULSE | 10 | 20 | --- | 100 |
|---|---|---|---|---|
| FUEL CONSUMPTION | •••• | •••• | --- | •••• |

FIG. 19B

| AV. VEHICLE SPEED | 0 | 10 | --- | 80 |
|---|---|---|---|---|
| FUEL CONSUMPTION | •••• | •••• | --- | •••• |

FIG. 19C

| AV. E/G SPEED | 700 | 800 | --- | 3000 |
|---|---|---|---|---|
| FUEL CONSUMPTION | •••• | •••• | --- | •••• |

FIG. 19D

| AV. INTAKE AIR | 2 | 3 | --- | 10 |
|---|---|---|---|---|
| FUEL CONSUMPTION | •••• | •••• | --- | •••• |

FIG. 20

| FUEL REMAINING AMOUNT (ℓ) / FUEL CONSUMPTION (ℓ) | 0 | 10 | 20 | 30 | 40 | 50 | 60 |
|---|---|---|---|---|---|---|---|
| 0 | ..... | ..... | ..... | ..... | ..... | ..... | ..... |
| 0.1 | ..... | ..... | ..... | ..... | ..... | ..... | ..... |
| 0.2 | ..... | ..... | ..... | ..... | ..... | ..... | ..... |
| 0.3 | ..... | ..... | ..... | ..... | ..... | ..... | ..... |
| 0.4 | ..... | ..... | ..... | ..... | ..... | ..... | ..... |
| 0.5 | ..... | ..... | ..... | ..... | ..... | ..... | ..... |

FIG. 21

| GAS CONCENTRATION (%) | 0.05 | 0.1 | 0.2 |
|---|---|---|---|
| BA | 1 | 1.1 | 1.5 |
| BB | 0 | 0.5 | 1 |

FIG. 22A

| COOLING WATER TEMP. (°C) | 0 | 20 | 40 | 60 |
|---|---|---|---|---|
| KFLGC | 0.2 | 0.2 | 0.1 | 0.05 |

FIG. 22B

| PURGE EXECUTION ACCUMULATED TIME (sec) | 0 | 100 | 200 | 300 |
|---|---|---|---|---|
| KFLGC | 0.2 | 0.1 | 0.05 | 0.05 |

FIG. 23

| INTAKE AIR TEMP. (°C) | 0 | 20 | 40 | 60 |
|---|---|---|---|---|
| KFLGK | 0 | 0 | 0.05 | 0.1 |

5
OPEN PCV
1721
T←0 sec
1722
3
1723
<PT≦-20mmHg?>
NO
YES
1724
F2←0
1725
CLOSE PCV
1726
READ P2a
T←0 sec
4
1727
T≧10 sec?
NO
YES
READ P2b
1728
ΔP2←P2b-P2a
1729
1730
LEAKAGE?
YES
NO
8
1731
F1, F2, F3←0
1
RETURN
1732
T≧10 sec?
NO
YES
1733
Fclose←1
6
ALARM
1734
1
1735
F3←1
1
1736
FLEAK←1
6
1737
F2←1
1738
<FAFLEAK≧KFLEAKMX?>
NO
YES
1739
FAF≧±15%?
NO
YES
1740
Duty<8%?
NO
YES
1
7
OPEN CCV
1741
PCV
NORMAL CONTROL
1742
8

| INTAKE AIR TEMP. (°C) | 0 | 10 | 20 | 30 | 40 | 50 |
|---|---|---|---|---|---|---|
| FLEAK | 0.1 | 0.1 | 0.2 | 0.3 | 0.4 | 0.5 |

START OF NEGATIVE PRESSURE INTRODUCTION

CCV
OPEN
CLOSE

PCV Duty(%)
100
0

FLEAK
0.4
0

Km
1.2
1
0.8

FAF DEVIATION (FAF-1)
0.2
0
-0.2
TIME

FIC. 36A

| ELAPSED TIME (sec) | 0 | 500 | 1000 | ····· | 10000 |
|---|---|---|---|---|---|
| ΔT1 (°C) | 0 | 0.2 | 0.4 | ····· | 4.0 |

| AV. VEHICLE SPEED (km/h) | 0 | 10 | 20 | 30 | 40 | ····· | 100 |
|---|---|---|---|---|---|---|---|
| ΔT2 (°C) | 0 | 0.1 | 0.1 | 0.2 | 0.3 | ····· | ····· |

FIG. 37

| SPEED \ TIME | 0 | 20 | 40 | ····· | 1000 |
|---|---|---|---|---|---|
| 0 | 0 | 0 | 0.1 | ····· | 4.0 |
| 20 | 0 | 0 | 0.1 | ····· | 5.0 |
| 40 | 0 | 0 | 0.1 | ····· | 6.0 |
| ⋮ | ⋮ | ⋮ | ⋮ | ····· | ⋮ |
| 100 | 0 | 0.1 | 0.2 | ····· | 10.0 |

FIG. 38

| ATMOSPHERIC TEMP. (°C) | 0 | 20 | 40 | 60 |
|---|---|---|---|---|
| FLEAK | 0.1 | 0.2 | 0.4 | 0.5 |

FIG. 39

| GAS CONCENTRATION L.V.(%) | 0 | 1 | 2 | 3 | 4 | 5 |
|---|---|---|---|---|---|---|
| FLEAK | 0.1 | 0.2 | 0.3 | 0.4 | 0.4 | 0.4 |

START OF NEGATIVE PRESSURE INTRODUCTION

CCV
OPEN
CLOSE

PCV Duty(%)
100
0

FLEAK
0.4
0

FAF DEVIATION (FAF-1)
0.2
0
-0.2
TIME

START OF NEGATIVE PRESSURE INTRODUCTION

CCV
OPEN
CLOSE

PCV Duty(%)
100
0

FLEAK
0.4
0

FAFAV DEVIATION (FAFAV-1)
0.2
0
-0.2
TIME

START OF NEGATIVE PRESSURE INTRODUCTION

CCV
OPEN
CLOSE

PCV Duty(%)
100
0

FLEAK
0.4
0

Km
1.2
1
0.8
FLEAK COMPENSATION
FPC COMPENSATION
TIME

| GAS CONCENTRATION L.V.(%) | 0 | 1 | 2 | 3 | 4 | 5 |
|---|---|---|---|---|---|---|
| DELAYED TIME (sec) | 0.5 | 0.4 | 0.3 | 0.2 | 0.1 | 0 |

FIG. 46A
FIG. 46B
FIG. 46C
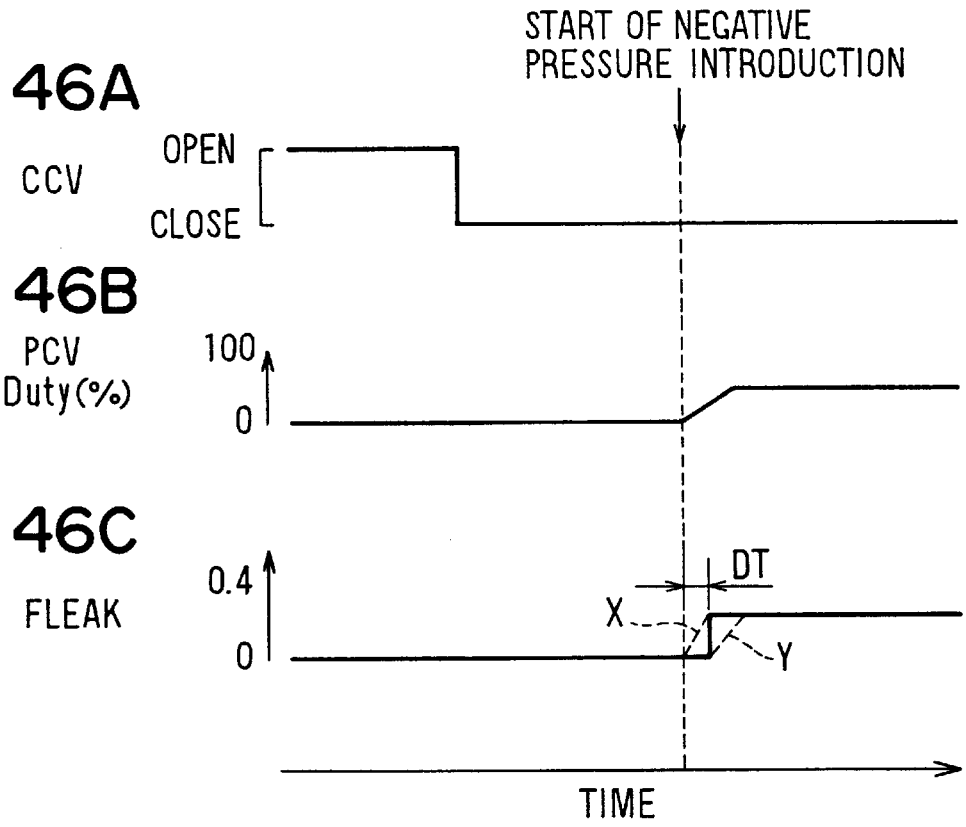
FIG. 47
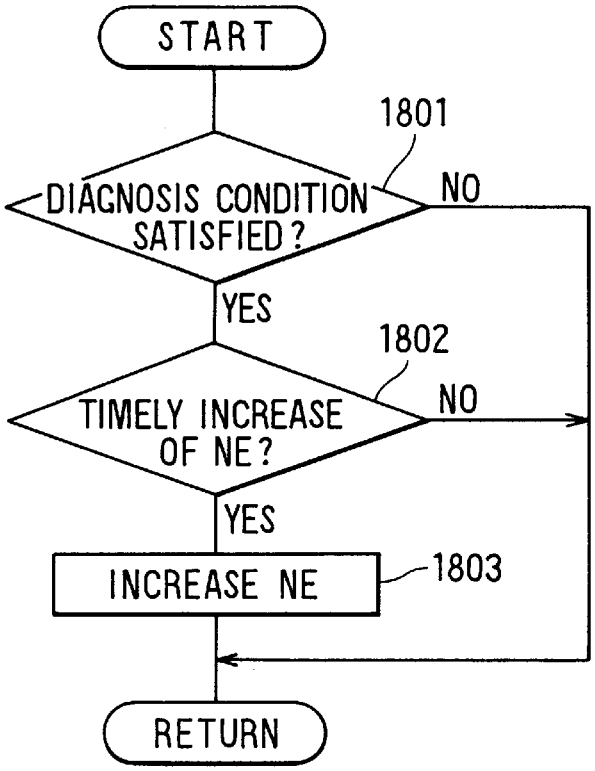

| GAS CONCENTRATION L.V. (%) | 0 | 1 | 2 | 3 | 4 | 5 |
|---|---|---|---|---|---|---|
| INCREASED AMOUNT OF NE (rpm) | 50 | 100 | 150 | 200 | 200 | 200 |

| FAF-1 | 0 | 0.05 | 0.1 | 0.15 |
|---|---|---|---|---|
| CANE (rpm) | 0 | 50 | 100 | 150 |

START OF NEGATIVE PRESSURE INTRODUCTION

CCV
OPEN
CLOSE

PCV Duty (%)
100
0

NE (rpm)
1000
500
0

FLEAK
0.4
0

FAF DEVIATION (FAF-1)
0.2
0
-0.2
TIME

LEAKAGE DIAGNOSING DEVICE FOR FUEL EVAPORATED GAS PURGE SYSTEM

BACKGROUND OF THE INVENTION

1. Field of the Invention

The present invention relates to a leakage diagnosing device for an evaporated gas purge system for diagnosing a leakage (pressure leakage) in an evaporated gas purge system which purges (discharges) evaporated gas, caused by a fuel evaporation in a fuel tank, to an intake pipe of an internal combustion engine.

2. Description of Related Art

According to a conventional evaporated gas purge system, in order to prevent evaporated gas generated from inside of a fuel tank from leaking out to the atmosphere, the evaporated gas is adsorbed in a canister via an evaporated gas passage at the inside of the fuel tank. A purge control valve is installed at a midway of a purge passage for purging the evaporated gas, adsorbed in the canister, to an intake pipe of an internal combustion engine. An opening and closing of the purge control valve is controlled in accordance with an operating state of the internal combustion engine to control a purge flow rate of the evaporated gas purged from the canister to the intake pipe. In order to prevent extensive leakage of the evaporated gas from the evaporated gas purge system to the atmosphere, the leakage of the evaporated gas needs to be detected at an early stage.

According to a conventional diagnosing method disclosed in, for example, JP-A-5-125997, an existence or an absence of leakage is diagnosed based on a pressure change amount in a gas purge passage after introducing the negative pressure of an intake pipe into the gas purge passage and sealing the gas purge passage including a fuel tank and a canister hermetically. The pressure change amount in the gas purge passage is detected by a pressure sensor, and is compared to a predetermined value.

However, the pressure change amount after introducing the negative pressure fluctuates when the introduced negative pressure changes, even if the gas purge passage is normal (no leakage). In other words, the pressure change amount after the negative pressure introduction may increase as the introduced negative pressure becomes lower. Therefore, a leakage diagnosis error may be caused by such fluctuation of the pressure change amount when only the pressure change amount is used as a diagnosis parameter for the leakage diagnosis.

The leakage diagnosis error may also be caused by, not only such fluctuation of the pressure change amount, but also diagnosis timing, a fluctuation of a fuel condition parameter such as a remaining amount of fuel or fuel temperature, a generated amount of the evaporated gas, and the like.

SUMMARY OF THE INVENTION

The present invention is made in light of the foregoing problems, and it is an object of the present invention to provide a leakage diagnosing device for an evaporated gas purge system which is capable of preventing an erroneous leakage determination. Particularly, it is an object of the present invention to provide a leakage diagnosing device for an evaporated gas purge system capable of preventing erroneous diagnosis caused by a change of a diagnosis parameter.

According to a leakage diagnosing apparatus for an evaporated gas purge system of the present invention, purge system leakage is diagnosed based on a detected pressure change amount and an introduced pressure which is introduced into a part of the purge system including at least a fuel tank and a canister. The detected pressure change amount is obtained by detecting pressure in the part of the purge system after such part of the purge system is hermetically sealed.

Accordingly, the reliability of the leakage diagnosis is improved because an erroneous diagnosis caused by the introduced pressure is prevented.

Preferably, the detected pressure change amount may be compensated based on the introduced pressure into the sealed gas purge system.

Accordingly, an erroneous leakage determination is prevented, and the reliability of leakage determination is improved.

According to another aspect of the present invention, an evaporated gas concentration reducing operation to emit evaporated gas from the fuel tank is executed before detecting the pressure in the sealed gas purge system.

Accordingly, pressure difference between a partial pressure of the evaporated gas component in the gas purge system and a saturated vapor pressure becomes large. Therefore, the accuracy of the abnormality diagnosis of the evaporated gas purge system is improved without being affected by the condition of the fuel delivery system.

According to another aspect of the present invention, an evaporated gas concentration is determined from a ratio of an air fuel ratio feedback compensation amount deviation to a purge ratio during a purge execution Then, one of an execution and a non-execution of the abnormality diagnosis is selected by comparing at least one of the evaporated gas concentration and a change amount of the evaporated gas concentration with a comparison value.

Accordingly, the abnormality diagnosis is terminated when a generated amount of the evaporated gas is large. Therefore, the drivability and the exhaust emission are not deteriorated.

According to another aspect of the present invention, an anticipated compensation for compensating a fuel injection amount is executed to reduce a deviation of an air fuel ratio which is caused by introducing a negative pressure of the intake pipe into the sealed gas purge system under the purge system leakage diagnosis during an idling of the engine.

Accordingly, an influence, caused by the evaporated gas purge from the fuel tank, is reduced by the anticipated compensation even if the abnormality diagnosis is executed during the idling of the engine. Therefore, an air fuel ratio deviation toward rich, caused by the evaporated gas purge from the fuel tank, is prevented. As a result, the air fuel deviation toward rich is reduced even when the abnormality diagnosis of the gas purge system is executed during the idling of the engine. Accordingly, the abnormality in the gas purge system is detected in an early stage without deteriorating the emission and the drivability.

According to another aspect of the present invention, a fuel amount consumed by the engine is determined. One of the detected pressure and the detected pressure change amount used for the leakage diagnosis is compensated based on the consumed fuel amount determined by the fuel consumption determination.

Accordingly, an error caused by the fuel consumption is eliminated from the detected pressure or the detected pressure change amount after sealing, and the accuracy of the pressure detection is improved. Therefore, the accuracy of the leakage diagnosis is improved, and even a small leak, which was unable to be detected according to the prior art, may be detected.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

FIG. 19A is an illustrated map to determine fuel consumption based on an average injection pulse according to the abnormality diagnosis routine in the second embodiment of the present invention;

FIG. 19B is an illustrated map to determine fuel consumption based on an average vehicle speed according to the abnormality diagnosis routine in the second embodiment of the present invention;

FIG. 19C is an illustrated map to determine fuel consumption based on an average engine speed according to the abnormality diagnosis routine in the second embodiment of the present invention;

FIG. 19D is an illustrated map to determine fuel consumption based on an average intake air amount according to the abnormality diagnosis routine in the second embodiment of the present invention;

FIG. 20 is an illustrated map to determine pressure compensation amount ΔP1b for P1b based on a fuel consumption and a fuel remaining amount according to the abnormality diagnosis routine in the second embodiment of the present invention;

FIG. 21 is a map to determine compensation coefficients BA and BB according to an evaporated gas concentration according to a modification of the abnormality diagnosis routine in the second embodiment of the present invention;

FIG. 22A is a map to determine a determination value KFLGC based on the cooling water temperature according to a modification of the abnormality diagnosis routine in the second embodiment of the present invention;

FIG. 22B is a map to determine a determination value KFLGC based on accumulated time of the purge execution according to a modification of the abnormality diagnosis routine in the second embodiment of the present invention;

FIG. 23 is a map to determine a compensation value KFLGK based on an intake temperature according to a modification of the abnormality diagnosis routine in the second embodiment of the present invention;

FIG. 36A is a table to determine a fuel temperature increase ΔT1 according to an elapsed time after the engine start in the second exemplary method for determining FLEAK in the seventh embodiment of the present invention;

FIG. 37 is a table to determine a fuel temperature increase ΔT3 according to a current vehicle speed and a continued time of such speed in the second exemplary method for determining FLEAK in the seventh embodiment of the present invention;

FIG. 38 is a table to estimate FLEAK from an atmospheric temperature in the fuel tank according to the second exemplary method for determining FLEAK in the seventh embodiment of the present invention;

FIG. 39 is a table to estimate FLEAK from an evaporated gas concentration learned value according to a third exemplary method for determining FLEAK in the seventh embodiment of the present invention;

FIGS. 46A through 46C are time charts showing a relationship among an operation of the canister closure valve, Duty (%) of the purge control valve, and FLEAK according to the ninth embodiment of the present invention;

FIG. 47 is a flowchart showing an engine speed increase control routine according to a tenth embodiment of the present invention;

Figure 1A:
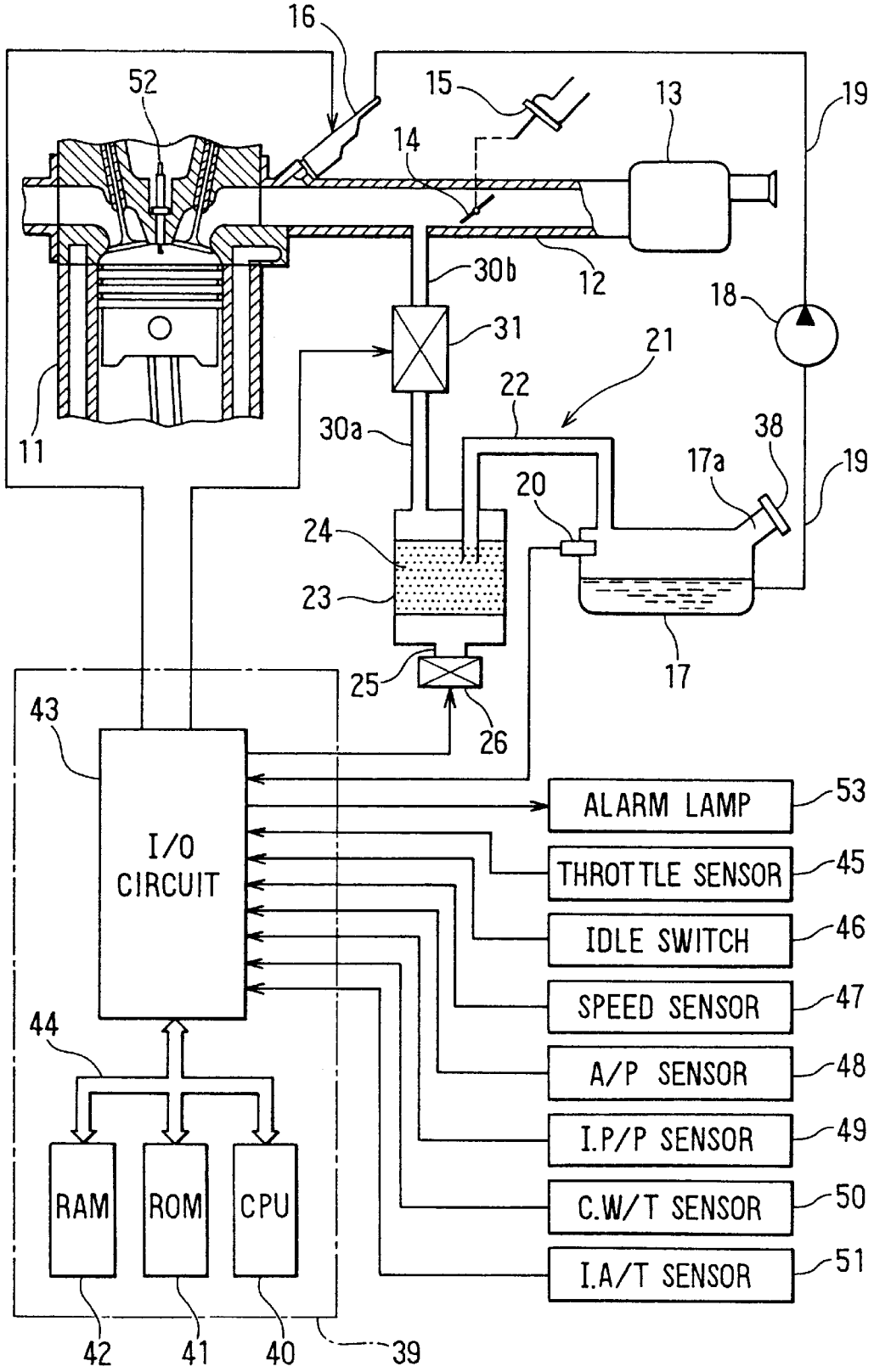
FIG. 1A is a schematic illustration showing a total gas purge system applicable to all embodiments except a sixth embodiment of the present invention.

DETAILED DESCRIPTION OF PREFERRED EMBODIMENTS (First embodiment)

A first embodiment of the present invention is shown in FIGS. 1 through 5. An air cleaner 13 is installed on the upstream side of an intake pipe 12 of an engine 11, and air which has passed through the air cleaner 13 is sucked to respective cylinders of the engine 11 via a throttle valve 14. An opening degree of the throttle valve 14 is adjusted by a stamping amount of an acceleration pedal 15. Further, fuel injection valves 16 are installed in each cylinder in the intake pipe 12. Fuel (gasoline) in a fuel tank 17 is delivered to each fuel injection valve 16 via a fuel pipe 19 by a fuel pump 18. A pressure sensor 20, such as a semiconductor pressure sensor, for detecting an inner pressure in the fuel tank 17 is installed in the fuel tank 17. A pressure in an evaporated gas purge passage is detected by detecting the inner pressure in the fuel tank 17 because they are identical each other when the gas purge passage 21 from the fuel tank 17 to a purge control valve 31 is hermetically sealed. In all embodiments of the present invention, "gas purge passage 21" means an area including a space in the fuel tank 17, a communication pipe 22, a canister 23, a purge passage 30*a* and the purge control valve 31. The fuel tank 17 is connected with the canister 23 via the communication pipe 22. An adsorber 24 of active carbon or the like, for adsorbing evaporated gas (evaporated fuel), is contained in the canister 23. An atmosphere communication pipe 25 for communicating with the atmosphere is installed at a bottom surface of the canister 23, and a canister closure valve 26 is attached to the atmosphere communication pipe 25.

Figure 1B:
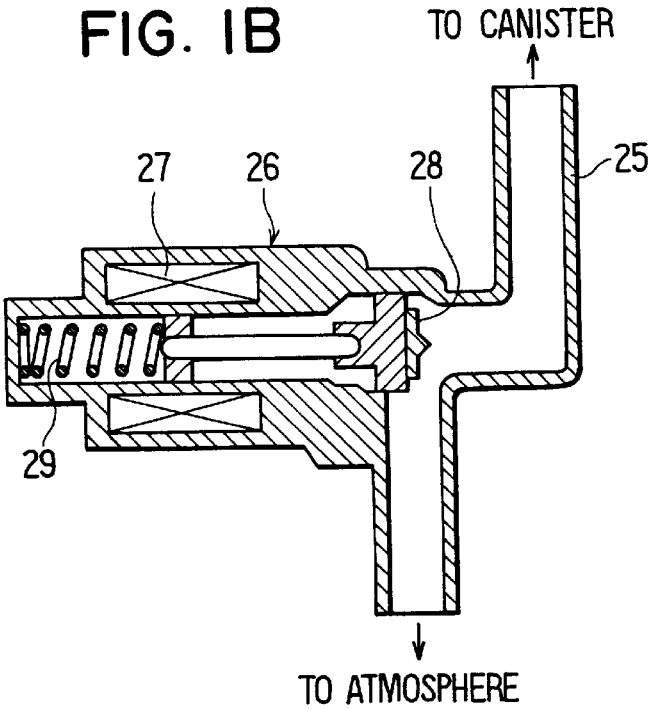
FIG. 1B is a sectional view showing a canister closure valve and an atmosphere communication pipe applicable to all embodiments of the present invention.

The canister closure valve 26 consists of an electromagnetic valve as shown in FIG. 1B. While the canister closure valve 26 is turned off, a valve body 28 is biased to an opening position by a spring 29, and the canister 23 is connected to the atmosphere via the atmosphere communication pipe 25. When certain voltage (for example, 6 Volts or greater) is applied to a solenoid coil 27 (when the canister closure valve 26 is turned on), the valve body 28 moves to a closing position against the spring 29, and the canister 23 is disconnected from the atmosphere because the atmosphere communication pipe 25 is closed.

Meanwhile, purge passages 30*a* and 30*b* are installed between the canister 23 and the intake pipe 12 for purging (discharging) evaporated gas, adsorbed to the adsorber 24, to the intake pipe 12. The purge control valve 31 is installed between the purge passages 30*a* and 30*b* for adjusting a purge flow rate.

Figure 1C:
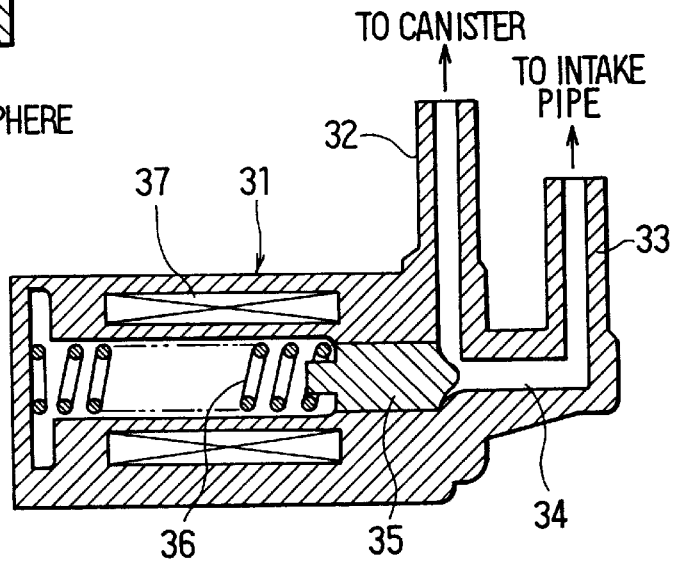
FIG. 1C is a sectional view showing a purge control valve applicable to all embodiments of the present invention.
Figure 1D:
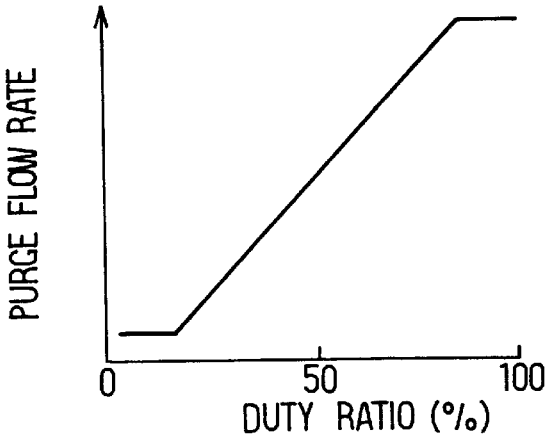
FIG. 1D is a characteristic graph showing a relationship between purge flow rate (purge flow amount) and duty ratio of a purge control valve applicable to all embodiments of the present invention.

The purge control valve 31 consists of an electromagnetic valve, including a port 32, port 33, a valve body 35, a spring 36 for applying a spring force to the valve body 35 in a valve closing direction, and a solenoid coil 37 for opening the valve body 35 against the spring 36, as shown in FIG. 1C. The port 32 is connected to the purge passage 30*a*, and the port 33 is connected to the purge passage 30*b*. Certain amount of voltage is applied to the solenoid coil 37 of the purge control valve 31 with a pulse signal. By adjusting a ratio of a pulse width to a period of the pulse signal (duty ratio), a ratio of a valve opening time to a period of opening and closing of the valve body 35 is adjusted. Thus, the purge flow rate of the evaporated gas from the canister 23 to the intake pipe 12 is controlled. The characteristic of the purge flow rate and the duty ratio is shown in FIG. 1D.

Further, a fuel supply port 17*a* of the fuel tank 17 is mounted with a filler cap 38 having a relief valve and the relief valve is opened and pressure is relieved when inner pressure of the fuel tank becomes an inner pressure exceeding −40 mmHg through 150 mmHg (relief pressure). Accordingly, pressure in a section from the fuel tank 17 to the canister 23 is always restrained to a pressure within a range of the relief pressure.

Next, an explanation will be given of the constitution of a control system. A control circuit 39 is constituted by connecting CPU 40, ROM 41, RAM 42, an input and output circuit 43 and so on to each other via a common bus 44. Further, the input and output circuit 43 is connected with various sensors for detecting an engine operating state such as a throttle sensor 45, an idle switch 46, a vehicle speed sensor 47, an atmospheric pressure sensor 48, an intake pipe pressure sensor 49, a cooling water temperature sensor 50, an intake air temperature sensor 51 and so on. A fuel injection control, ignition control, evaporated gas purge control, leakage diagnosis of the evaporated gas purge passage 21 and the like are executed based on signals inputted from the various sensors via the input and output circuit 43 as well as programs, data and the like stored in ROM 41 or RAM 42. Drive signals are outputted to the fuel injection valve 16, an ignition plug 52, the canister closure valve 26, the purge control valve 31 and so on via the input and output circuit 43. If an abnormality of the gas purge passage 21 is detected, an alarm lamp 53 is turned on and the abnormality is informed to a driver.

The leakage diagnosis procedures carried out by the leakage diagnosis program in the first embodiment will be outlined according to FIGS. 4A, 4B and 4C.

When certain diagnosis conditions are satisfied, the purge control valve 31 is opened to introduce the negative pressure (the intake pipe pressure) into the gas purge passage 21 after closing the canister closure valve 26. Then, the gas purge passage 21 is hermetically sealed by closing the purge control valve 31. When an adsorbed amount of the evaporated gas adsorbed by the canister 23 is small, the pressure in the gas purge passage 21 keeps decreasing for awhile even after sealing the gas purge passage 21 hermetically because the evaporated gas component in the gas purge passage 21 is adsorbed by the canister 23.

The first embodiment of the present invention determines whether the pressure in the gas purge passage 21 reaches the lowest pressure after sealing the gas purge passage 21 hermetically. The first pressure change determination period starts from t1 which is a timing when the pressure reaches the lowest pressure, and ends at t2 which is a timing when a first predetermined period has passed after t1.

A pressure change amount DPT1 during the first pressure change determination period is calculated from a difference between a pressure P1a (the introduced negative pressure) at t1 and a pressure P1b at t2. DPT1 fluctuates according to P1a. Therefore, DPT1 is compensated according to the introduced negative pressure P1a.

Generally, DPT1 increases as P1a becomes lower. Therefore, DPT1 is compensated to decrease it as P1a becomes lower. The compensated DPT1 corresponds to a pressure change amount detected under a constant negative pressure.

It is determined that there is no gas leakage on the gas purge passage 21 (normal) when the compensated DPT1 is smaller than a predetermined determination value L (when DPT1 is caused by the generation of the evaporated gas only). Then, the leakage diagnosis ends. The canister closure valve 26 is opened right after the end of the leakage diagnosis to resume the normal purge control.

When the compensated DPT1 is equal to or greater than the predetermined determination value L, there is a possibility that a gas leakage exists in the gas purge passage 21.

Therefore, the hermetically sealed state of the gas purge passage 21 is maintained even after the end of the first pressure change determination period until a predetermined waiting period elapses. Then, it transfers to a second pressure change determination period at t3 which is a timing that the predetermined waiting period ends.

It is determined that there is no gas leakage on the gas purge passage 21 (normal) when the pressure in the gas purge passage 21 is out of a predetermined pressure range (a pressure range which has a possibility of the gas leakage) at t3 which is also a timing that the second pressure change determination period starts. Then, the pressure change determination is terminated, and the leakage diagnosis ends. The canister closure valve 26 is opened right after the end of the leakage diagnosis to resume the normal purge control.

It is also determined that there is no gas leakage on the gas purge passage 21 (normal) when the pressure in the gas purge passage 21 is out of the predetermined pressure range (the pressure range which has a possibility of the gas leakage) during the second pressure change determination period. Then, the pressure change determination is terminated, and the leakage diagnosis ends. The canister closure valve 26 is opened right after the end of the leakage diagnosis to resume the normal purge control.

When the pressure in the gas purge passage 21 is within the predetermined pressure range (the pressure range which has a possibility of the gas leakage) until the end of the second pressure change determination period, a pressure change amount in the gas purge passage 21 during the second pressure change determination period DPT2 is determined to compare it with DPT1 for determining whether there is a gas leakage. The canister closure valve 26 is opened right after the end of the leakage diagnosis to resume the normal purge control.

Figure 2:
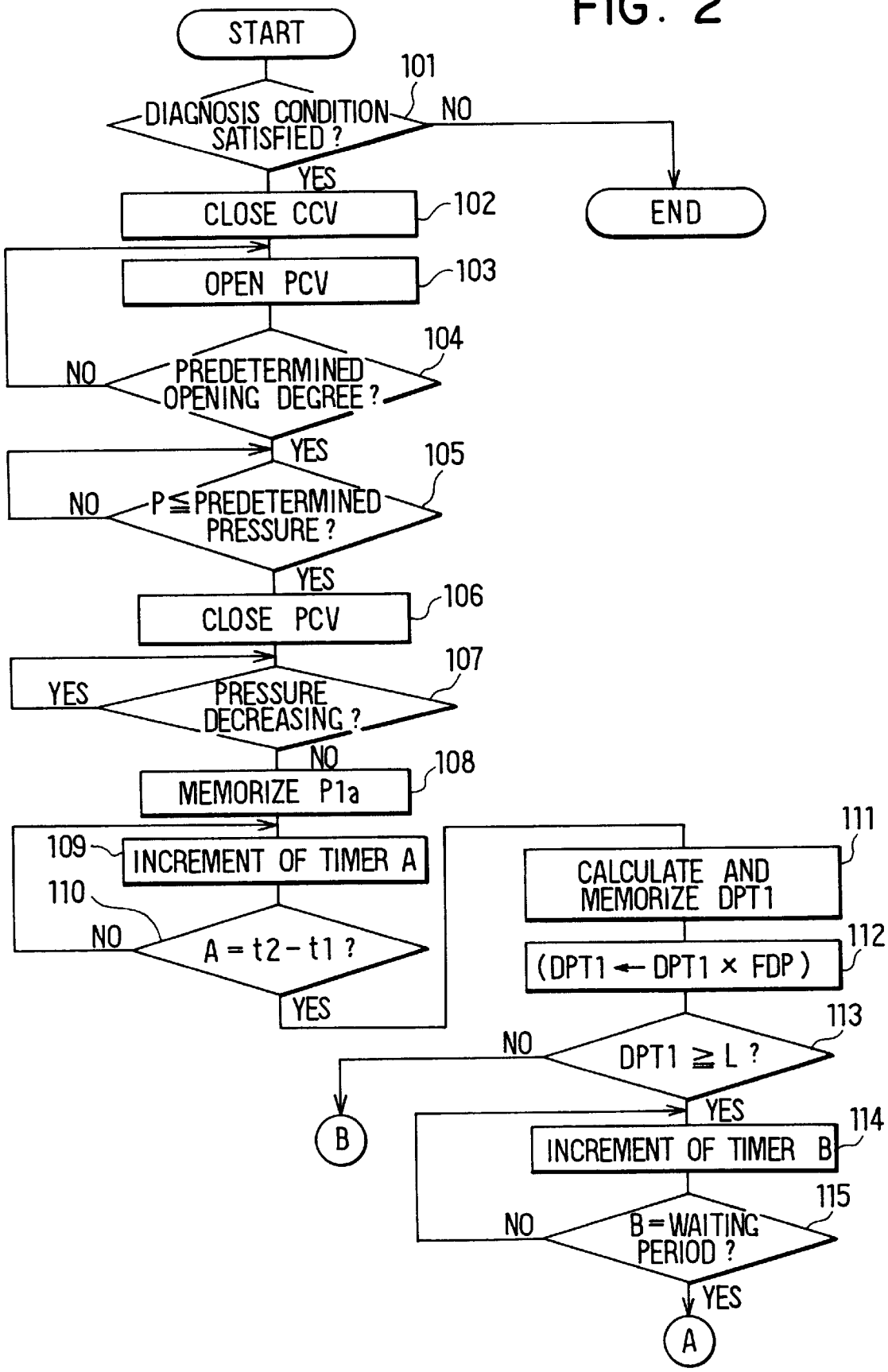
FIG. 2 is a part of a flowchart showing a gas leakage diagnosis program according to a first embodiment of the present invention.
Figure 3:
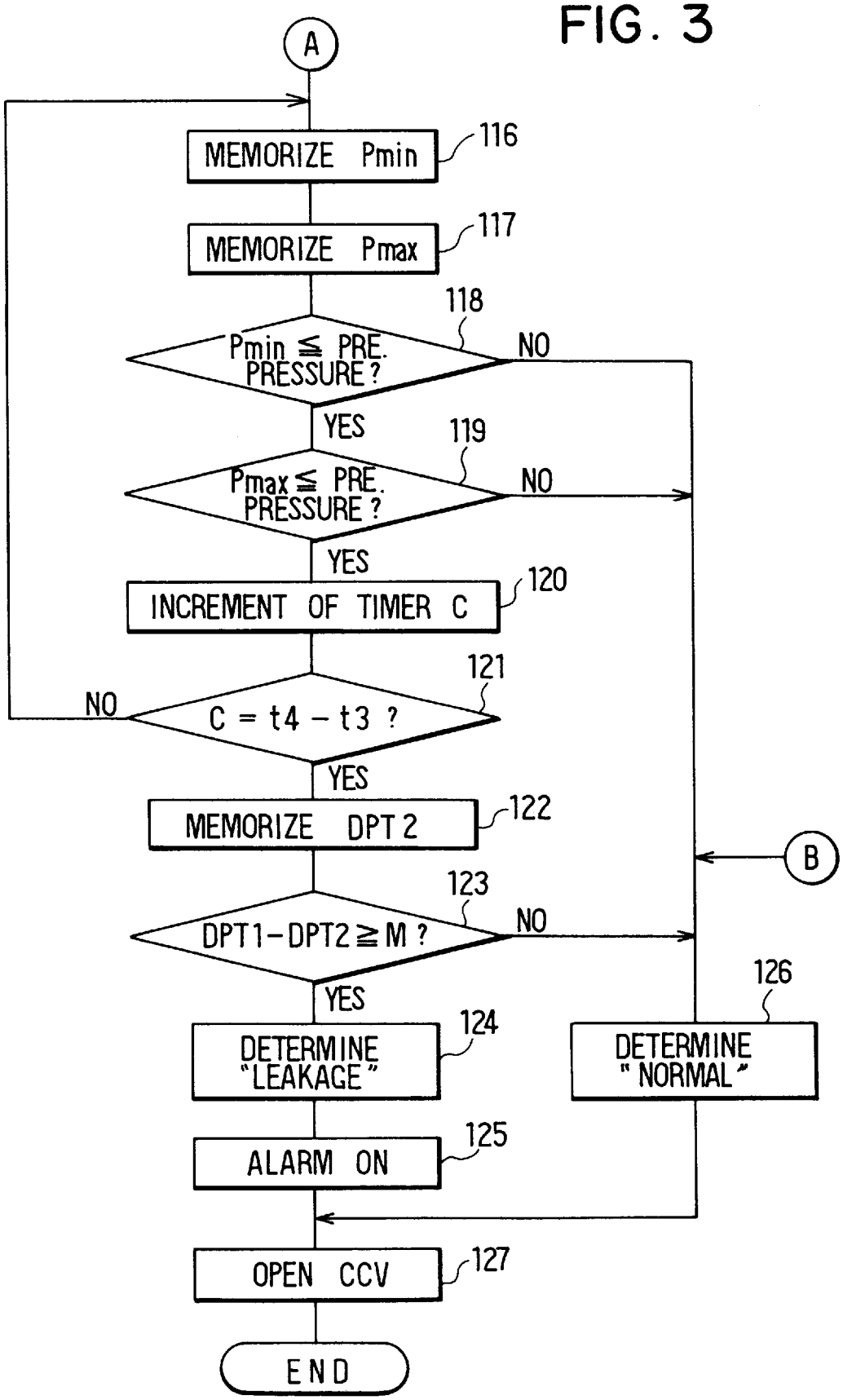
FIG. 3 is a part of the flowchart showing the gas leakage diagnosis program according to the first embodiment of the present invention.
Figure 4:
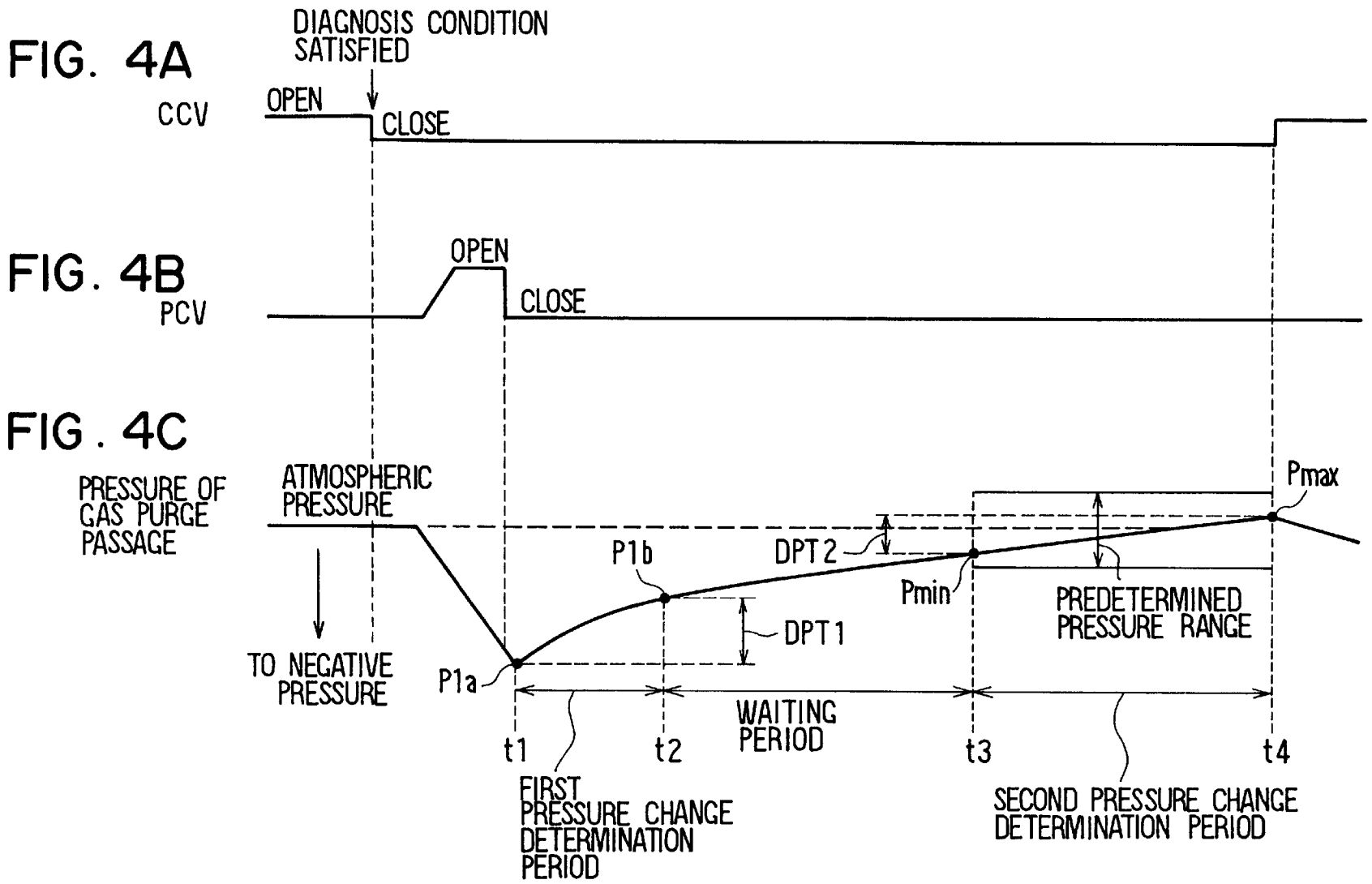
FIG. 4A is a time chart showing an operation of a canister closure valve according to the first embodiment of the present invention.
FIG. 4B is a time chart showing an operation of a purge control valve according to the first embodiment of the present invention.
FIG. 4C is a time chart showing a pressure change in a gas purge passage according to the first embodiment of the present invention.

The leakage diagnosis is performed by executing the leakage diagnosis program shown in FIGS. 2 and 3 at every predetermined time period. When the program is started in step 101 in FIG. 2, it is determined whether the leakage diagnosis executing condition is satisfied. In this case, the leakage diagnosis executing condition is satisfied when an operating state of the engine is stabilized. For example, it is determined based on an intake air amount, intake temperature, elapsed time after an engine start, whether it is during a feedback of an air-fuel ratio, or the like. When the leakage diagnosis executing condition is not satisfied in step 101, the program is finished without executing the following steps.

Meanwhile, when the leakage diagnosis executing condition is satisfied in step 101, the operation proceeds to step 102 to close the canister closure valve 26. The purge control valve 31 is gradually opened to a predetermined opening degree in steps 103 and 104 to introduce the negative pressure into the gas purge passage 21. There are two reasons for opening the purge control valve 31 gradually. One reason is to reduce the influence upon the drivability. The other is to make an air stream in the gas purge passage smooth when the negative pressure is introduced.

In step 105, the purge control valve 31 is maintained open with the predetermined opening degree unless the pressure in the gas purge passage 21 detected by the pressure sensor 20 is equal to or lower than the predetermined pressure. When the pressure in the gas purge passage 21 is equal to or lower than the predetermined pressure in step 105, the purge control valve 31 is closed in step 106 to seal the gas purge passage 21 hermetically.

It is determined in step 107 that whether the pressure in the gas purge passage is kept decreasing. When there is no pressure decrease, the introduced negative pressure P1a (the lowest pressure) is read and memorized in RAM 42 instep 108. In step 109, the elapsed time after t1 is counted by timer A. An incremental process for the timer A is repeated every constant period until the first predetermined period for the first pressure change determination period elapses (steps 109, 110). When counted time counted by the timer A reaches the first predetermined period, the program goes to step 111. In step 111, DPT1 is calculated from P1b and P1a, and memorizes it in RAM 42.

In step 112, DPT1 is compensated by the following equation according to P1a:

$$DPT1=DPT1\times FDP$$

Figures 5, 8:
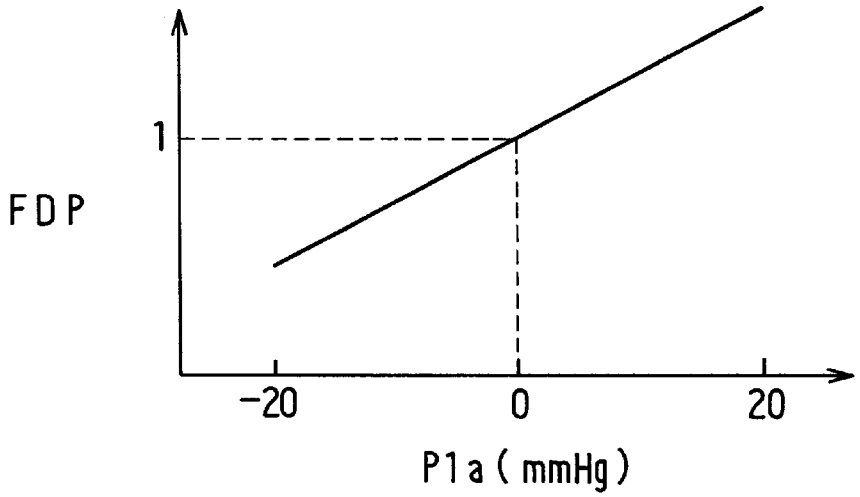
FIG. 5 is a schematic illustration showing a relationship between a compensation coefficient (FDP) and an introduced negative pressure (P1a) according to the first embodiment of the present invention.
FIG. 8 is a map to determine a full-open purge ratio PGRMX (%), used in the purge ratio control routine, based on an intake pipe pressure PM (mmHg) and an engine speed NE (rpm) according to the second embodiment of the present invention.

In this equation, FDP represents a compensation coefficient which is determined according to P1a as shown in FIG. 5. As understood from FIG. 5, FDP becomes smaller as P1a becomes lower.

The compensated DPT1 is compared to the predetermined determination value L in step 113. The predetermined determination value L is set at a value that is less than or equal to the pressure change amount caused by evaporated gas produced during the first pressure change determination period. Therefore, when the compensated DPT1 is smaller than the determination value L, it is determined that there is no gas leakage (normal) in step 126. Then, the canister closure valve 26 is opened in step 127 to resume the ordinary purge control.

When the compensated DPT1 is greater than or equal to the determination value L, it is considered that there is a possibility of the gas leakage. Therefore, the hermetically sealed state of the gas purge passage 21 is maintained even after the end of the first pressure change determination period, and elapsed time after the end of the first pressure change determination period is counted by a timer B to wait until it reaches a predetermined waiting period in steps 114 and 115. Specifically, an increment of the timer B is executed in step 114, and it is determined in step 115 that whether the timer B reaches the predetermined waiting period. The determination of the pressure change is not executed during the waiting period.

When the timer B reaches the predetermined waiting period in step 115, the program proceeds to the second pressure change determination period, and goes to step 116 to memorize a minimum pressure Pmin of the gas purge passage 21 during the second pressure change determination period. Pmin is always renewed during the second pressure change determination period.

In step 117, a maximum pressure Pmax of the gas purge passage 21 during the second pressure change determination period. Pmax is always renewed during the second pressure change determination period.

During the second pressure change determination period, it is determined in step 118 whether Pmin is within the predetermined pressure range (the pressure range which has a possibility of the gas leakage). When Pmin is outside of the predetermined pressure range, it is determined normal (no leakage) in step 126, and it stops the pressure change determination, and open the canister closure valve 26 in step 127 to resume the ordinary purge control. Accordingly, when a pressure in the gas purge passage 21 is outside of the predetermined pressure range at the beginning of the second pressure change determination period, it is determined normal, and the second pressure change determination is stopped.

During the second pressure change determination period, it is determined in step 119 whether Pmax is within the predetermined pressure range (the pressure range which has a possibility of the gas leakage). When Pmax is outside of the predetermined pressure range, it is determined normal (no leakage) in step 126, and it stops the pressure change determination, and open the canister closure valve 26 in step 127 to resume the ordinary purge control.

Elapsed time after the start of the second pressure change determination period is counted by a timer C until it reaches a second predetermined period (t4) corresponding to a timing that the second pressure change determination period ends in steps 120 and 121. Specifically, an increment of the timer C is executed in step 120, and it is determined in step 121 that whether the timer C reaches the second predetermined period (t4).

When the timer C reaches the second predetermined period (t4), the program goes to step 122 to calculate DPT2 which is a difference between Pmax and Pmin, and to memorize DPT2 in RAM 42. In step 123, it is determined whether the difference between DPT1 and DPT2 (DPT1−DPT2) is greater than or equal to a predetermined determination value M.

When (DPT1−DPT2) is less than the determination value M, it means that the pressure in the gas purge passage 21 varied almost in the same manner between the first pressure change determination period and the second pressure change determination period. In this case, therefore, it is presumed that the pressure change is caused by production of evaporated gas. Then, it is determined normal (no leakage) in step 126, and the canister closure valve 26 is opened in step 127 to resume the ordinary purge control.

On the other hand, when (DPT1−DPT2) is greater than or equal to the determination value M, it means that DPT1 is much larger than DPT2. When a gas leakage occurs, DPT1 increases because the pressure change becomes large after the introduction of the negative pressure, and DPT2 decreases because the pressure in the gas purge passage 21 after the negative pressure introduction rises to the approximate atmospheric pressure in shorter time. Therefore, the program goes to step 124 to determine that there is a leakage in the gas purge passage 21 when (DPT1−DPT2) is greater than or equal to the determination value M. Then, the alarm lamp 53 is turned on in step 125 to warn the driver, and the canister closure valve 26 is opened in step 127.

In step 123, a ratio of DPT1 to DPT2 may be used instead of the difference (DPT1−DPT2).

The produced amount of evaporated gas during the sealing of the gas purge passage 21 (=pressure change caused by the production of evaporated gas) varies according to the fuel temperature, driving condition or the like. Therefore, the determination values L and M used in step 113 and 123 may be determined from, for example, a map according to a driving condition, which may affect the production of evaporated gas, such as the fuel temperature (or outside temperature) or the like.

According to the evaporated gas leakage diagnosis program, the pressure change amount DPT1 is compensated according to the introduced negative pressure P1a. Therefore, DPT1 detected under several different negative pressures can be corrected to corresponding pressure change amounts under a constant negative pressure. Accordingly, high reliable leakage determination is achieved regardless the introduced negative pressure P1a.

Instead of step 112, it is possible to compensate the determination value L according to P1a based on the following equation:

$$L=L\times FDL$$

In this equation, FDL represents a compensation coefficient which is determined according to P1a. It is desirable to set that FDP becomes larger as P1a becomes lower. Accordingly, the compensated determination value L becomes larger as P1a becomes lower. In this case, the same advantage described in the first embodiment is obtained.

Instead of detecting the inner pressure of the fuel tank 17, a pressure at any place in the gas purge passage 21, such as a pressure at the communication pipe 22, may be detected by the pressure sensor 20.

(Second embodiment)

A second embodiment of the present invention will be described with reference to FIGS. 6 through 23. In this and following embodiments, components which are substantially the same as those in previous embodiments are assigned the same reference numerals.

Figure 6:
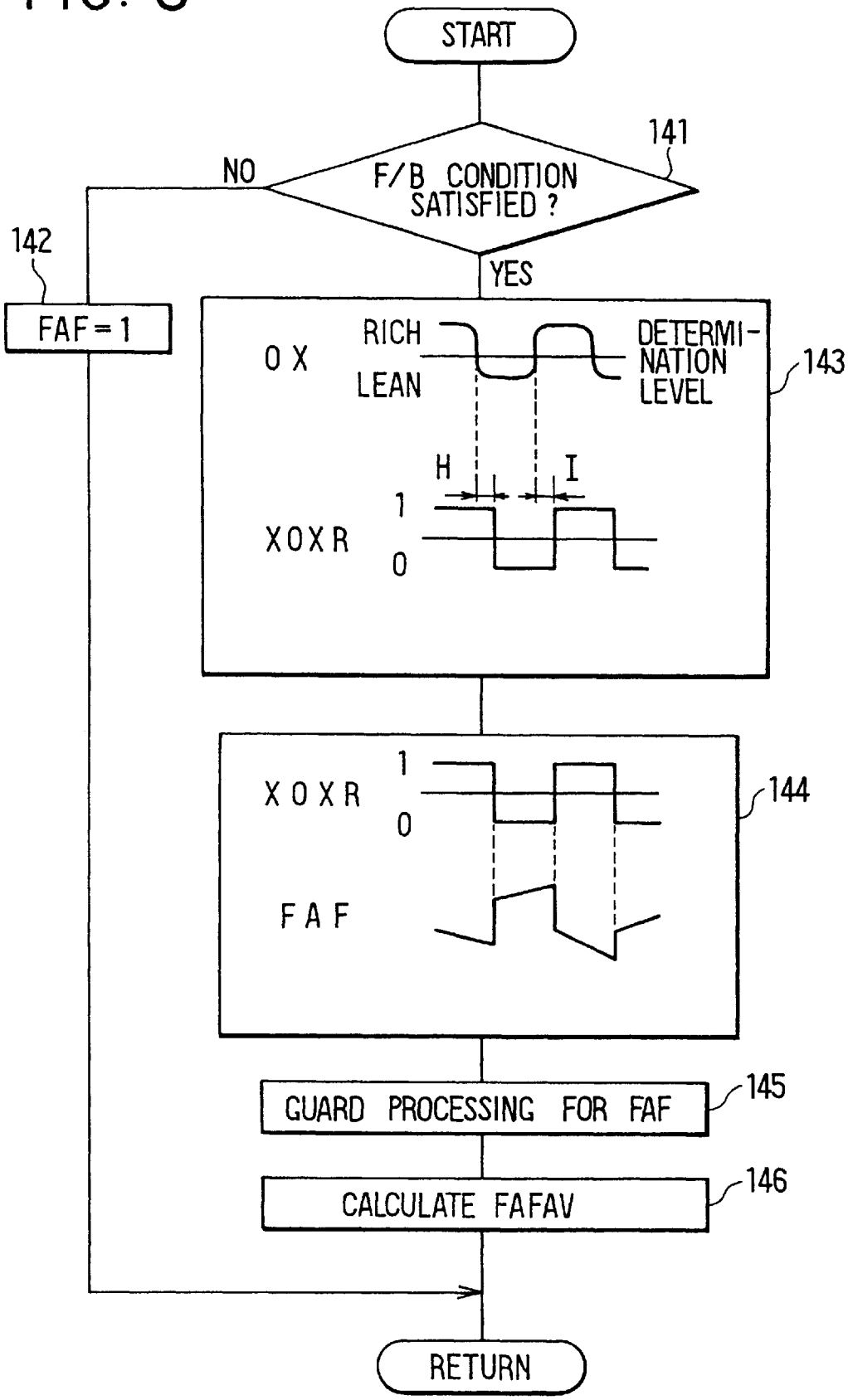
FIG. 6 is a flowchart showing an air fuel ratio feedback control routine according to a second embodiment of the present invention.

A routine for air fuel ratio feedback control in the second embodiment is executed by the control circuit 39 according to a flowchart shown in FIG. 6 as an interruption handling routine every 4 milliseconds (msec).

When the routine for air fuel ratio feedback control starts, it is determined whether a feedback execution condition is satisfied in step 141. The feedback condition consists of, for example, (1) it is not a timing of a start of the engine, (2) it is not during a fuel cut, (3) cooling water temperature THW≧40° C., (4) fuel injection amount TAU>TAUmin (TAUmin represents minimum fuel injection amount of the fuel injection valve 16), (5) an oxygen sensor (not illustrated) for detecting oxygen content in exhaust gas is under an active state. The feedback execution condition is satisfied only when all of the above five conditions are satisfied. When one of those five conditions is not satisfied, the feedback execution condition is satisfied, and the program goes to step 142. In step 142, an air fuel ratio compensation coefficient FAF (corresponding to an air fuel ratio feedback compensation amount) is set to "1.0", and this routine ends.

When the feedback execution condition is satisfied, the program goes to step 143. In step 143, an output OX from the oxygen sensor is compared to a predetermined determination level, and set an air fuel ratio flag XOXR with predetermined delayed periods H and I. XOXR is set to "0" (lean) when H milliseconds have passed after an inversion of OX from rich to lean, and is set to "1" (rich) when I milliseconds have passed after an inversion of OX from lean to rich.

In step 144, the air fuel ratio compensation coefficient FAF is set as follows. FAF skips predetermined value when XOXR changes from "0" to "1", and vice versa, and an integral control of FAF is executed while XOXR is "1" or "0", as shown in step 144.

In step 145, an upper limit and a lower limit of FAF are checked (guard processing). In step 146, an equalized (average) air fuel ratio compensation coefficient FAFAV is calculated based on FAF every skip or every predetermined period, and the routine for air fuel ratio feedback control ends.

Figure 7:
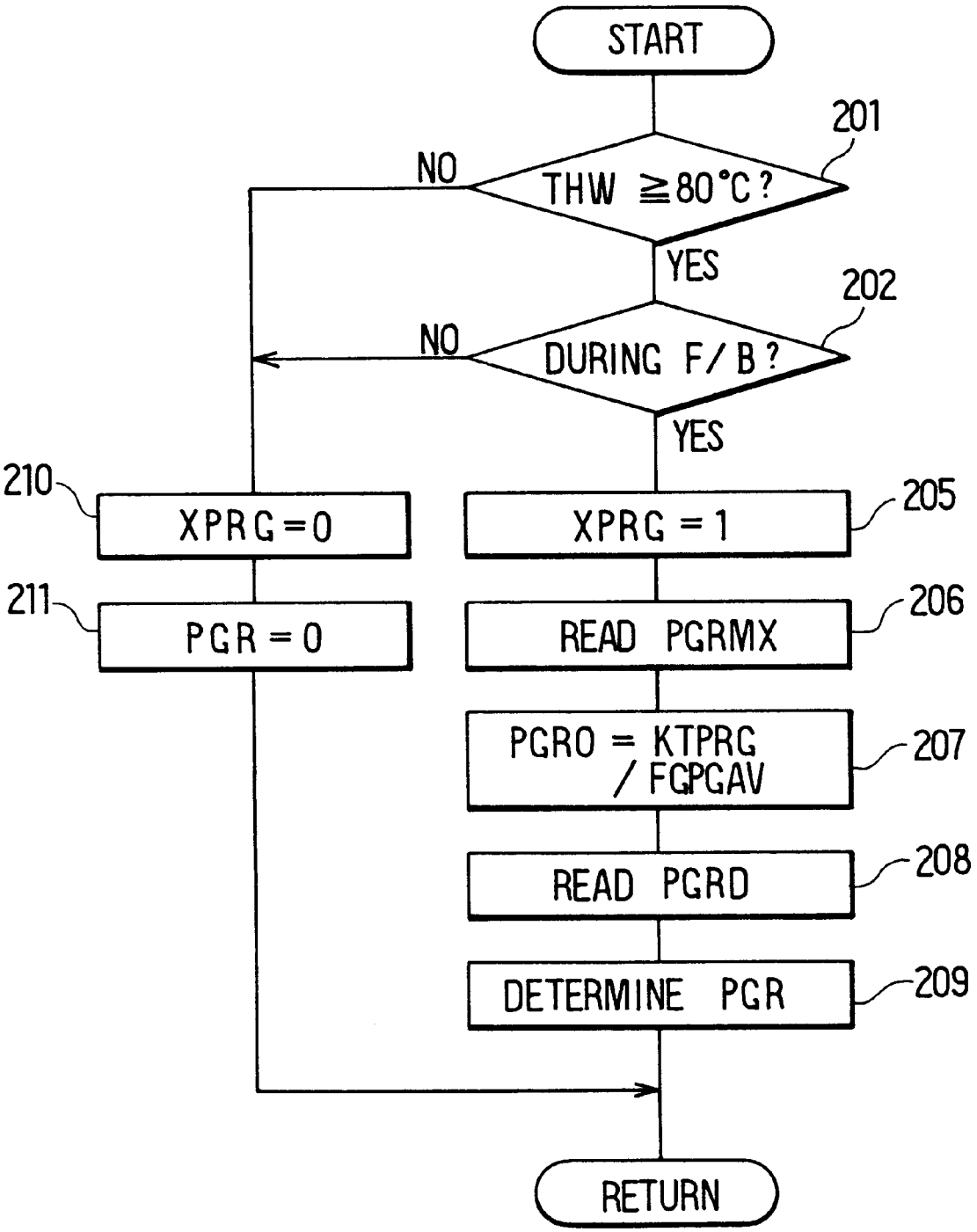
FIG. 7 is a flowchart showing a purge ratio control routine according to the second embodiment of the present invention.

A purge ratio control in the second embodiment is executed by the control circuit 39 according to a flowchart shown in FIG. 7 as an interruption handling routine every 32 msec.

In step 201, it is determined whether THW≧80° C. in step 201. When THW≧80° C., it is determined whether it is during the air fuel ratio feedback control in step 202. When the engine is warmed up (THW≧80° C.) and the ordinary air fuel ratio feedback control is under execution (when the feedback execution condition is satified in step 141 in FIG. 6), the program goes to step 205.

After setting a purge execution flag XPRG at "1" in step 205, a final purge ratio PGR (a ratio of purge flow rate to intake air flow rate) is determined in steps 206 through 209 as follows.

In step 206, a full-open purge ratio PGRMX (%) is read from a map shown in FIG. 8 based on an intake pipe pressure PM (mmHg) and an engine speed NE (rpm). In step 207, a compensation amount KTPRG for a target fuel injection amount is divided by an evaporated gas concentration average FGPGAV to calculate a target purge ratio PGRO.

The target fuel injection amount compensation amount KTPRG corresponds to the maximum compensation amount when the fuel injection amount TAU is reduced for compensation. The evaporated gas concentration average FGPGAV corresponds to an adsorbed amount of the evaporated gas in the canister 23. FGPGAV is presumed by other steps described hereinafter, and is always renewed in RAM 42. Therefore, the target purge ratio PGRO corresponds to a desirable gas purge amount if the fuel injection amount is reduced to KTPRG. In this case, PGRO decreases as FGPGAV increases. In the second embodiment, KTPRG is set as 30%.

In step 208, a purge ratio moderate parameter PGRD is read. PGRD is a parameter to prevent a sudden and extreme change of the purge ratio that may cause an undesirable air fuel ratio because the compensation may not be able to keep up with such sudden and extreme change. The setting processes of the purge ratio moderate parameter PGRD will be described hereinafter.

In step 209, the final purge ratio PGR is determined by choosing a smallest one among PGRMX, PGRO and PGRD. The purge control is executed with the final purge ratio PGR. PGR is generally controlled by PGRD. Therefore, the upper limit of PGR is limited by PGRMX or PGRO when PGRD keeps increasing.

When THW is less than 80° C. in step 201, or when it is not during the air fuel ratio feedback control in step 202, the program goes to step 210 to set (clear) XPRG at "0". PGR is reset as "0" in step 211, and the purge ratio control routine ends. When PGR is "0", it means that the gas purge is not executed. In other words, when the cooling water temperature THW is low (THW<80° C.) such as before the warming up of the engine 11, a fuel increase control other than the purge control is executed by a water temperature compensation, and the purge ratio control is not executed.

Figure 9:
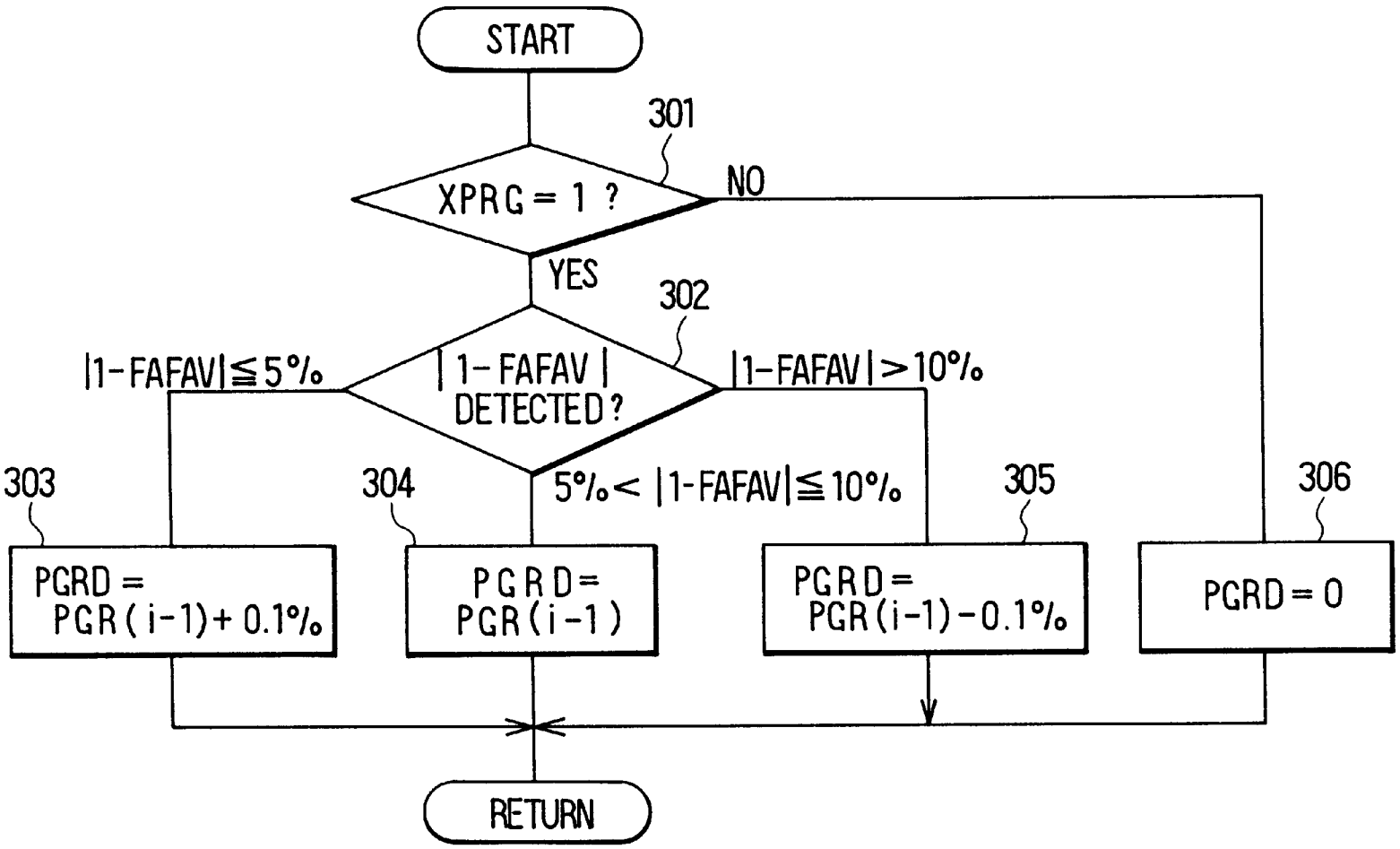
FIG. 9 is a flowchart showing a purge ratio moderate control routine according to the second embodiment of the present invention.

A purge ratio moderate control in the second embodiment is executed by the control circuit 39 according to a flowchart shown in FIG. 9 as an interruption handling routine every 32 msec.

In step 301, it is determined whether the purge execution flag XPRG is "1". When it is determined that XPRG is "0", in other words, when the purge ratio control is not executed, the program goes to step 306 to set PGRD at "0", and the purge ratio moderate control routine ends.

When it is determined that XPRG is "1" in step 301, it goes to step 302 to detect an absolute value of a deviation amount $|1-FAFAV|$ of FAF. When $|1-FAFAV| \leqq 5\%$, PGRD is set at a value that 0.1% is added to the last (former) final purge ratio PGR(i−1) in step 303.

When $5\% < |1-FAFAV| \leqq 10\%$, PGRD is set at the last (former) final purge ratio PGR(i−1) in step 304.

When $|1-FAFAV| > 10\%$, PGRD is set at a value that 0.1% is subtracted from the last (former) final purge ratio PGR (i−1) in step 305.

The compensation may not be able to keep up with a sudden and extreme change of the purge ratio, and a most appropriate air fuel ratio can not be maintained. To solve this problem, PGRD is adopted in the second embodiment.

Figure 10:
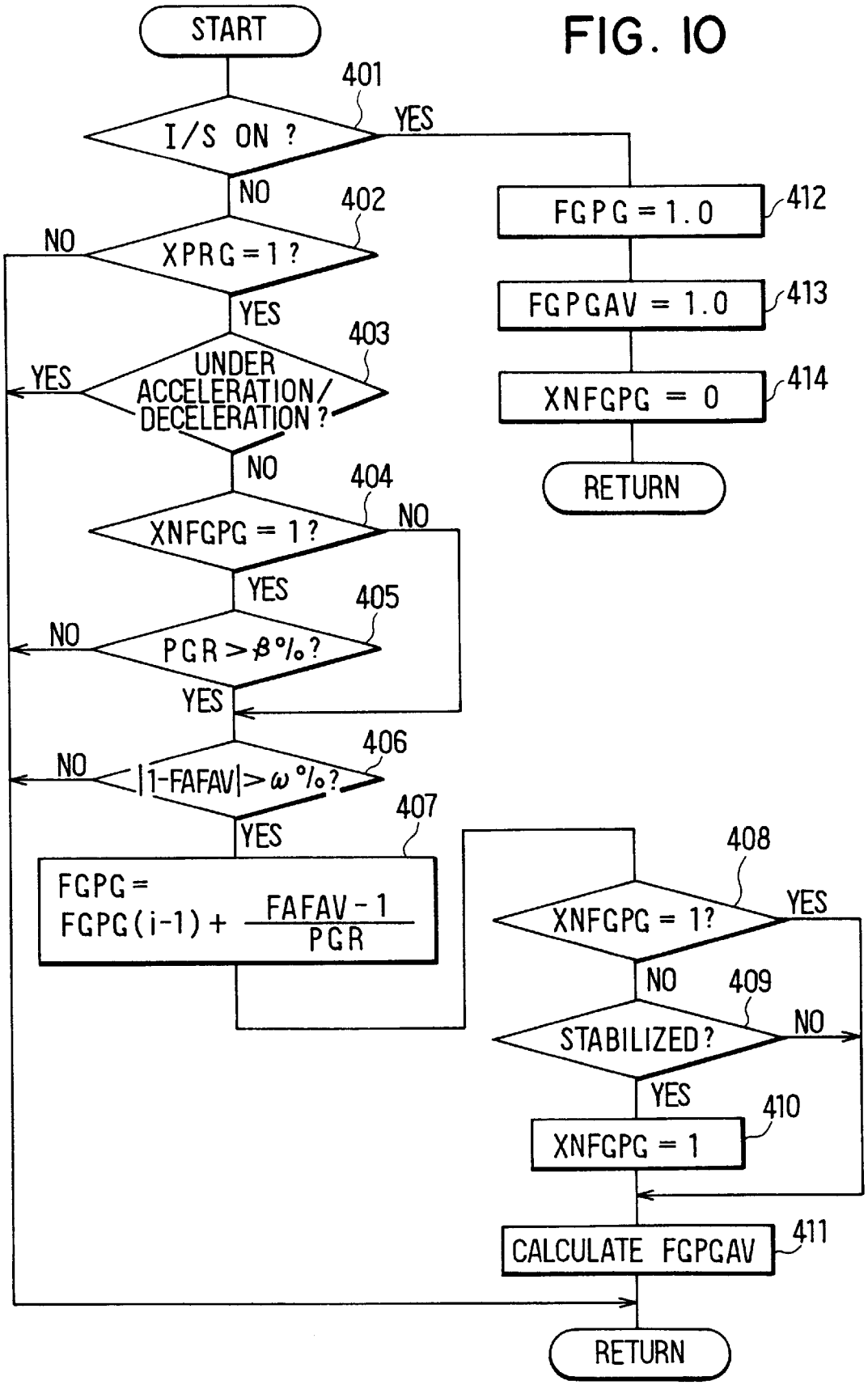
FIG. 10 is a flowchart showing an evaporated gas concentration detection routine according to the second embodiment of the present invention.

An evaporated gas concentration detection in the second embodiment is executed according to a flowchart shown in FIG. 10 as an interruption handling routine every 4 msec.

In step 401, it is determined whether the ignition switch is turned on. When it is determined that the ignition switch is turned on, respective data are initialized in steps 412 through 414, and the evaporated gas concentration FGPG, the average value FGPGAV of the evaporated gas concentration FGPG, and a termination flag for an initial concentration detection XNFGPG are reset to "1.0", "1.0", and "0", respectively. When FGPG=1.0 and FGPGAV=1.0, it means that the evaporated gas concentration is "0" (in other words, it means that no evaporated gas is adsorbed by the canister 23). Such initialization presumes the adsorbed amount "0" when the engine starts. When XNFGPG=0, it means that no evaporated gas concentration is detected yet after the start of the engine.

After turning on the ignition switch, it is determined whether the purge execution flag XPRG=1 (the purge control has already been started) in step 402. When XPRG=0 (before the start of the purge control), the evaporated gas concentration detection routine ends.

When XPRG=1 (after the start of the purge control), it is determined in step 403 whether the vehicle is changing its acceleration/deceleration. The determination whether the vehicle is changing its acceleration/deceleration is executed based on an off state of the idle switch 46, a valve opening degree change of the throttle valve 14, an intake pipe pressure change, vehicle speed change, and the like. When it is determined that the vehicle is under acceleration/deceleration in step 403, the evaporated gas concentration detection routine ends. In short, the execution of the evaporated gas concentration detection is prohibited during the acceleration and deceleration (transition period of the engine) to prevent an erroneous detection.

When it is determined that the vehicle is not under acceleration/deceleration in step 403, it is determined in step 404 whether XNFGPG=1 (whether the initial detection of the evaporated gas concentration is finished). When XNFGPG=1 (after the initial concentration detection), the program goes to step 405. When XNFGPG=0 (before the initial concentration detection), the program skips step 405 and goes to step 406.

In the very beginning, the program skips step 405 and proceeds from step 404 to step 406 because the evaporated gas concentration detection is not finished yet (XNFGPG=0). In step 406, it is determined whether the equalized (average) air fuel ratio compensation coefficient FAFAV has a deviation greater than a predetermined value co (for example, 2%) from a reference value (=1). The evaporated gas concentration is not detected properly when a deviation amount of the air fuel ratio caused by the gas purge is too small. Therefore, the evaporated gas concentration detection routine ends without further steps when the deviation amount of the air fuel ratio is small ($|1-FAFAV| \leqq \omega$).

When the deviation amount of the air fuel ratio is large ($|1-FAFAV| > \omega$), FGPG is detected according to the following equation (1) in step 407:

$$FGPG = FGPG(i-1) + (FAFAV-1)/PGR \quad (1)$$

In the equation (1), (FAFAV−1) corresponds to a deviation of the air fuel ratio feedback compensation amount, and PGR is the final purge ratio calculated in step 209 in FIG. 7.

Since the initial value of FGPG is "1", FGPG is gradually renewed according to the above equation (1) depending on whether the air fuel ratio is rich side or lean side. FGPG is reduced from "1" as the actual gas concentration is high (as the adsorbed amount by the canister 23 is large). FGPG is increased according to a decrease of the actual gas concentration (a purge amount of the canister 23). Specifically, when the air fuel ratio is rich (FAFAV−1<0), FGPG is reduced by a value of (FAFAV−1) divided by PGR. When the air fuel ratio is lean (FAFAV−1>0), FGPG is increased by a value of (FAFAV−1) divided by PGR.

In step 408, it is determined whether XNFGPG is "1" (the initial gas concentration detection is finished). When XNFGPG=0 (before the initial gas concentration detection), the program goes to step 409. In step 409, it is determined whether FGPG is stabilized by determining whether a certain condition, where a difference between the last (former) FGPG and the current FGPG is less than a predetermined value (for example, 3%), has been continued, for example, more than two times. When FGPG is stabilized, XNFGPG is set to "1" in step 410, and the program goes to step 411.

When XNFGPG=1 in step 408, or it is determined that FGPG is not stable in step 409, the program jumps to step 411. In step 411, the evaporated gas concentration average FGPGAV is calculated to average the current FGPG by executing a certain equalizing operation (for example, 1/64 equalizing operation).

After the initial gas concentration detection is finished (when XNFGPG is set to "1"), it is always determined "Yes" in step 404. In step 405, it is determined whether PGR is greater than a predetermined value β (for example, 0%). The evaporated gas concentration detection in step 406 and thereafter is executed only when PGR is greater than β. The evaporated gas purge may not be executed even when XPRG is set to "1", if PGR is "0". Therefore, the evaporated gas concentration detection is prevented when PGR=0 at any time other than the initial gas concentration detection.

When PGR is small, in other words, when the purge control valve 31 is controlled with a low flow rate, the valve control accuracy is generally low, and the reliability of the evaporated gas concentration detection is low. Therefore, β in step 405 may be set at a value corresponding to a small valve opening region (for example, 0%<β<2%) to execute the gas concentration detection only under the accurate detection conditions at any time other than the initial gas concentration detection.

Figure 11:
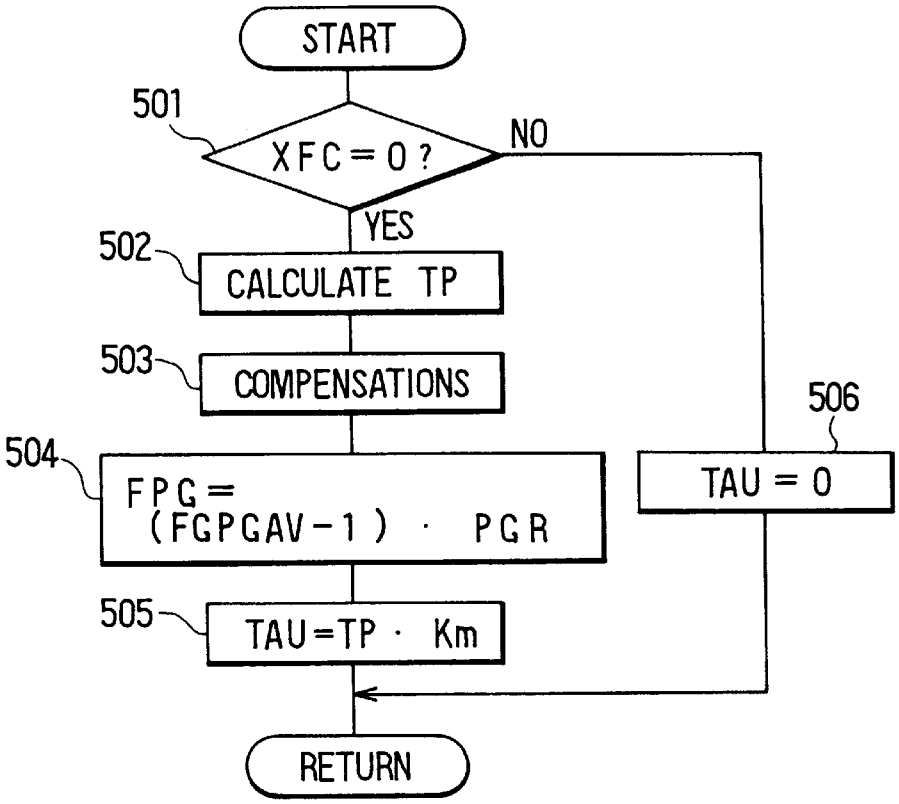
FIG. 11 is a flowchart showing a fuel injection amount control routine according to the second embodiment of the present invention.

A fuel injection amount control in the second embodiment is executed according to a flowchart shown in FIG. 11 as an interruption handling routine every 4 msec.

In step 501, it is determined whether a fuel cut flag XFC is "0" which represents not to execute the fuel cut. When it is determined that XFC=1 (execution of the fuel cut), the fuel injection amount TAU is set to "0" in step 506, and the fuel injection amount control routine ends. As a result, the fuel cut is performed.

On the other hand, when XFC=0 (non-execution of the fuel cut), a basic injection amount TP based on the engine speed NE and an engine load (for example, the intake pipe pressure PM) is calculated in step 502 according to data held in the ROM 41 as a map. In step 503, various compensations regarding the driving conditions of the engine 11, such as a cooling water temperature compensation, a compensation after starting of the engine, intake air temperature compensation and the like, are performed.

In step 504, the purge compensation coefficient FPG is calculated from the following equation (2) according to FGPGAV obtained from the routine shown in FIG. 10 and PGR obtained from the routine shown in FIG. 7:

$$FPG=(FGPGAV-1)\cdot PGR \tag{2}$$

In the equation (2), the purge compensation coefficient FPG means a replenished fuel amount resulted from the gas purge execution under the condition determined in the purge ratio control routine. A certain amount corresponding to FPG is reduced from TP as a compensation.

In step 505, a compensation coefficient Km is calculated from the following equation (3) according to FAF, FPG and an air fuel ratio learned value KGj, and this compensation coefficient Km is used to compensate the fuel injection amount TAU by multiplying Km by TP:

$$Km=1+(FAF-1)+(KGj-1)+FPG \tag{3}$$

In the equation (3), KGj is a backup data to be stored in a backup RAM (not illustrated), and is a coefficient which is set for each engine driving region. CPU 40 performs the fuel injection with the fuel injection valve 16 based on TAU and a predetermined injection timing.

Figure 12:
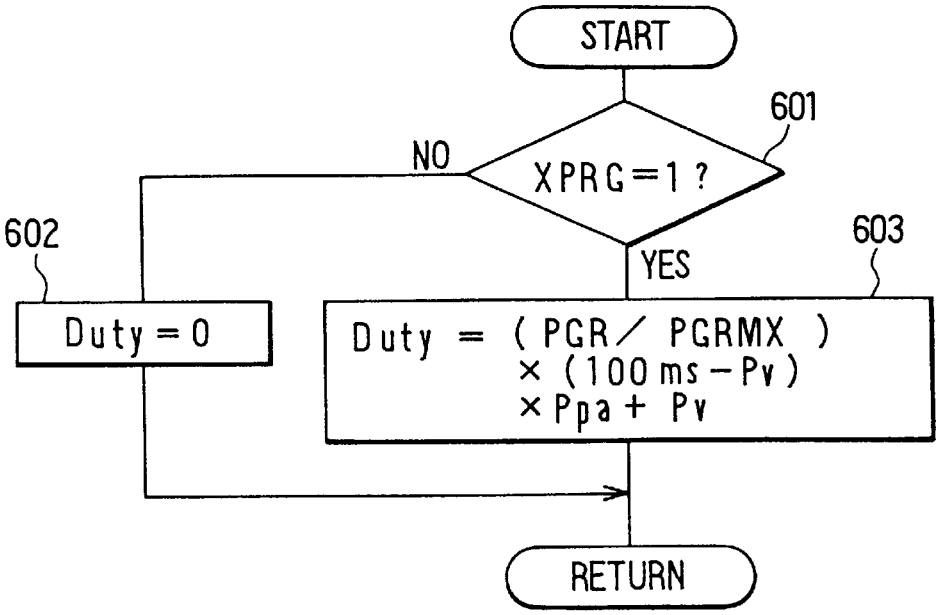
FIG. 12 is a flowchart showing a purge control valve control routine according to the second embodiment of the present invention.

A control for the purge control valve 31 in the second embodiment is executed according to a flowchart shown in FIG. 12 as an interruption handling routine every 100 msec.

In step 601, it is determined whether the purge execution flag XPRG is "1" which represents the purge execution. When it is determined that XPRG=0 (no purge execution), "Duty", which is a control value for driving the purge control valve 31, is set to "0" in step 602. When it is determined that XPRG=1 (purge execution), the program goes to step 603. In step 603, the "Duty" is calculated from the following equation (4) based on the final purge ratio PGR and the full-open purge ratio PGRMX suitable for the current driving condition:

$$\text{Duty}=(PGR/PGRMX)\cdot(100-Pv)\cdot Ppa+Pv \tag{4}$$

In this equation (4), a driving cycle of the purge control valve 31 is 100 msec. Pv represents a voltage compensation value for a battery voltage fluctuation (corresponds to time for a driving cycle compensation), and Ppa represents an atmospheric pressure compensation value for an atmospheric pressure fluctuation. A duty ratio of the driving pulse signal for the purge control valve 31 is determined according to the control value Duty calculated from the equation (4).

Figure 13:
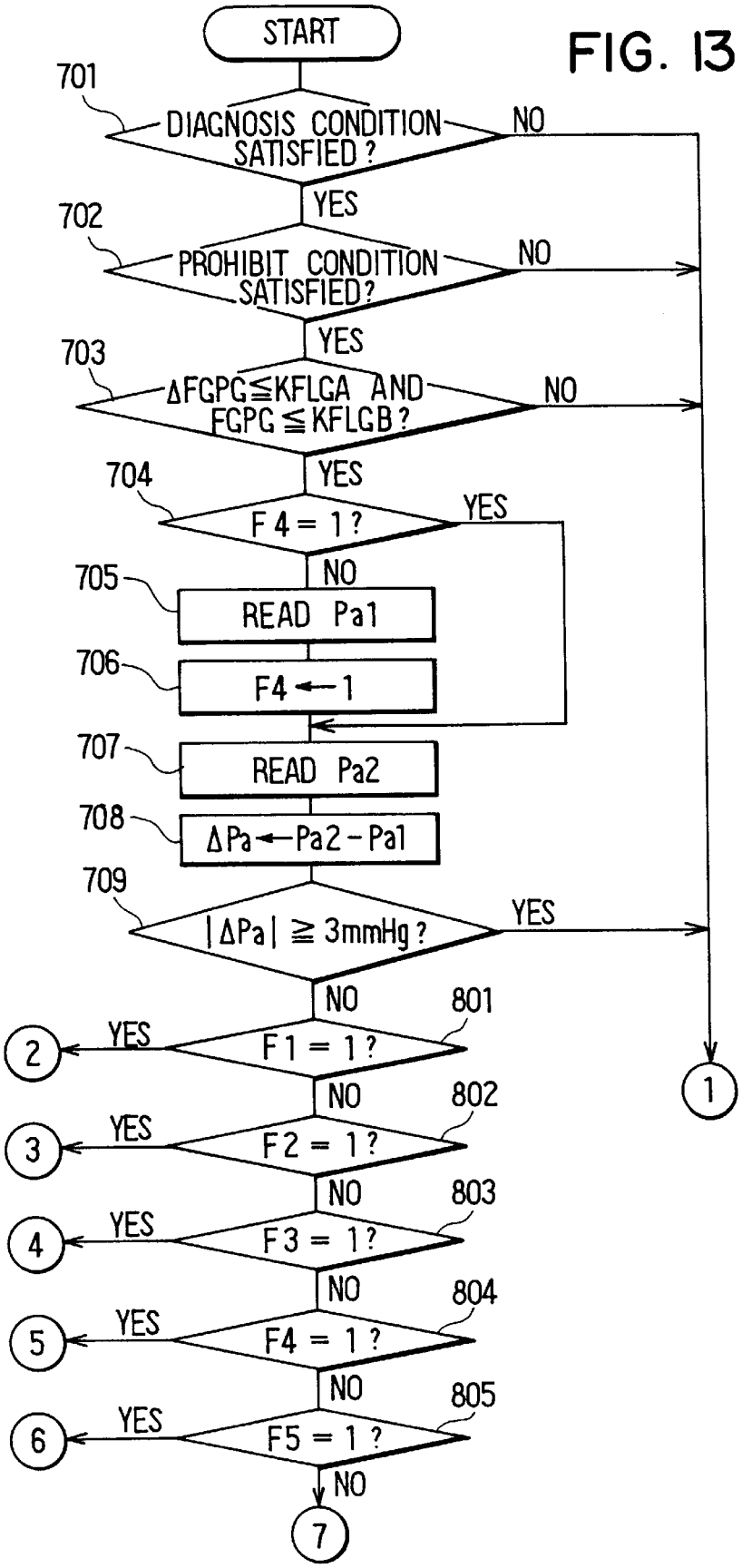
FIG. 13 is a part of a flowchart showing an abnormality diagnosis routine according to the second embodiment of the present invention.
Figure 14:
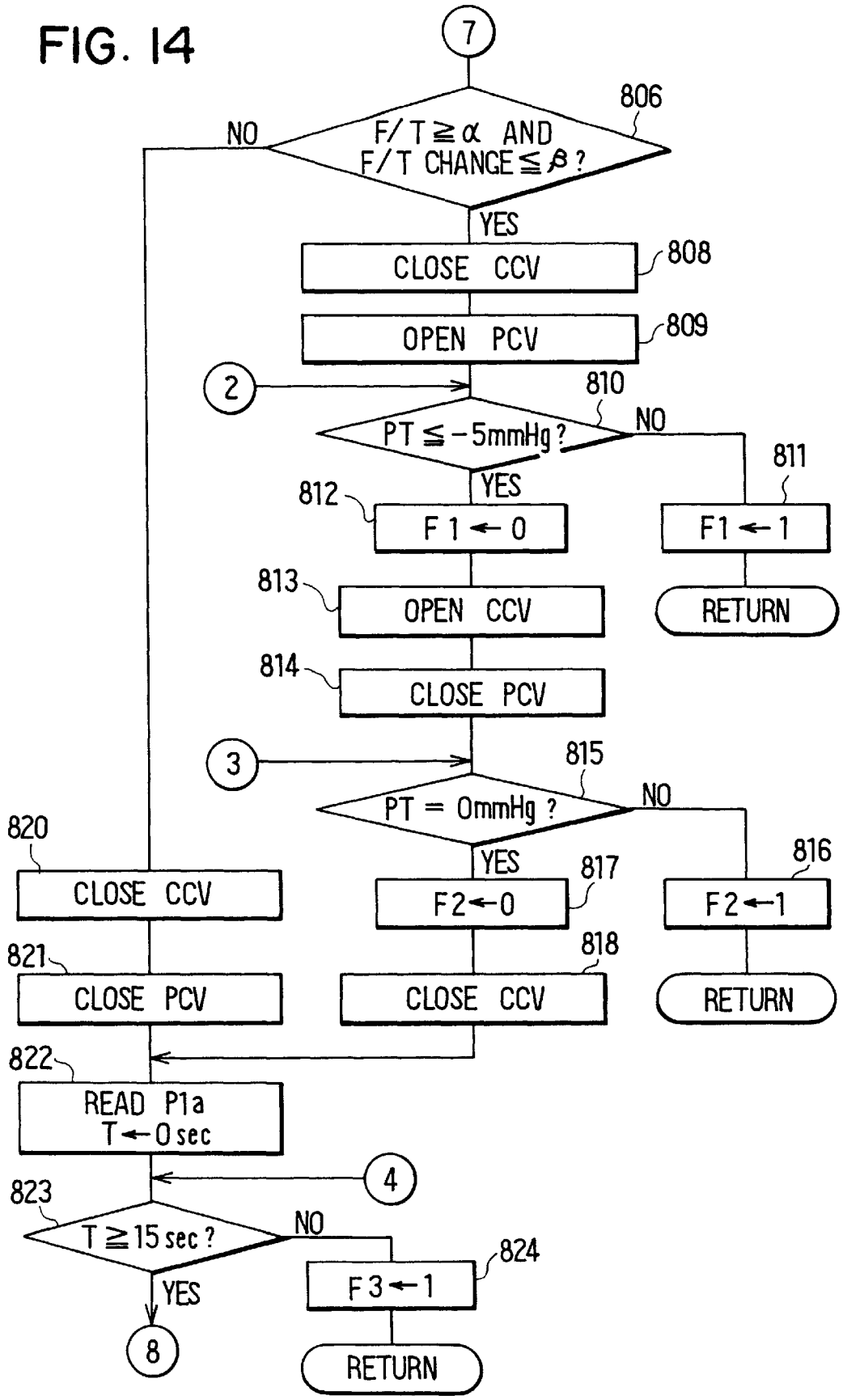
FIG. 14 is a part of a flowchart showing an abnormality diagnosis routine according to the second embodiment of the present invention.
Figures 15, 15A:
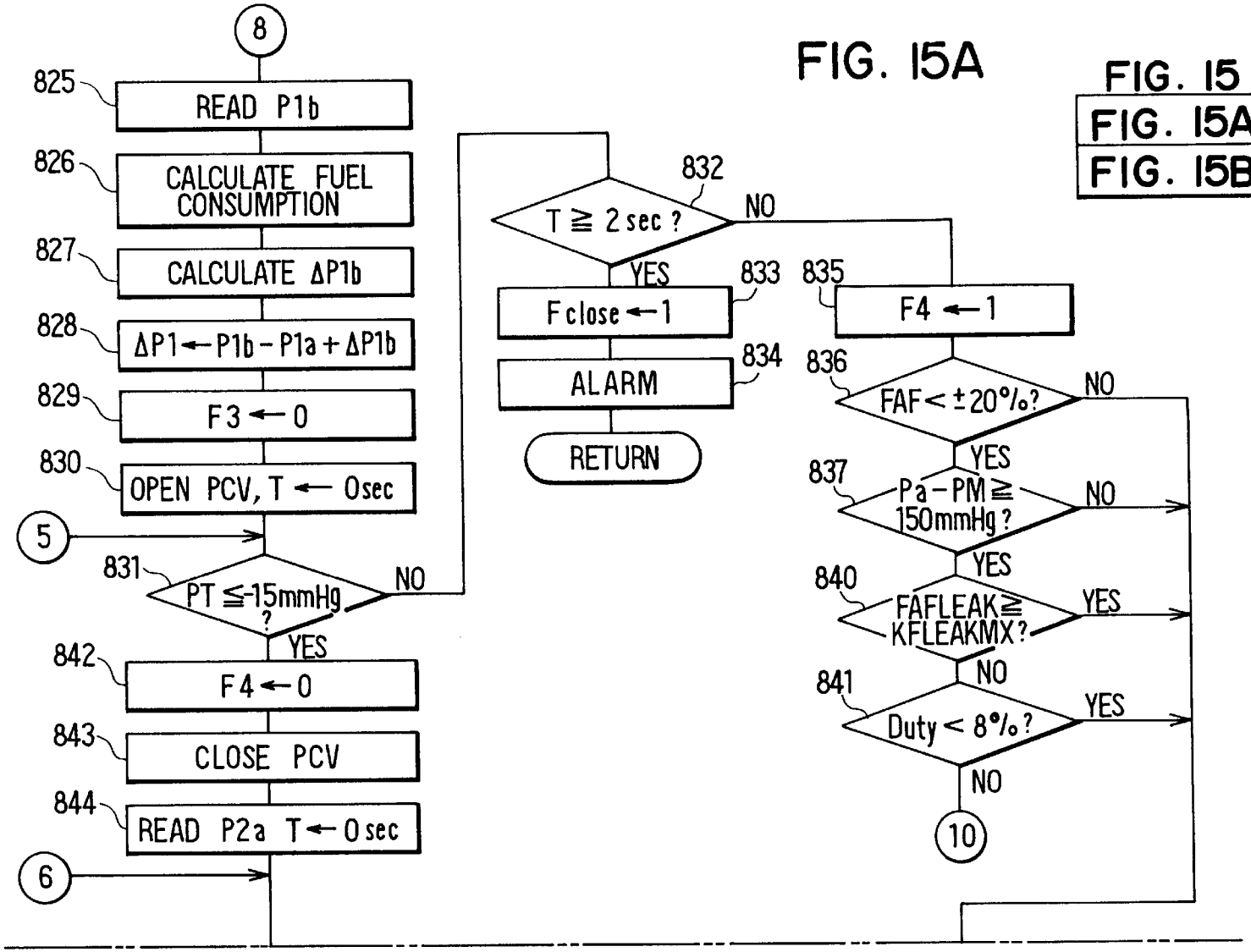
FIGS. 15A and 15B are a part of a flowchart showing an abnormality diagnosis routine according to the second embodiment of the present invention.

An abnormality diagnosis for the gas purge passage 21 in the second embodiment is executed repeatedly every 256 msec according to flowcharts shown in FIGS. 13, 14 and 15. This abnormality diagnosis routine functions as abnormality diagnosis means in the present invention.

In step 701, it is determined whether a diagnosis execution condition is satisfied. When an engine driving condition is stable, the diagnosis execution condition is satisfied. Specifically, the diagnosis execution condition is satisfied and goes to step 702 when an intake air amount is between 5.0 g/s and 40 g/s, an intake air temperature is between −10° C. and 70° C., a cooling water temperature at the start of the engine is between −7.5° C. and 35° C., an intake air temperature at the start of the engine is between −10° C. and 70° C., 700 seconds or more have passed after the start of the engine, a battery voltage is greater than 10 volts, and an air fuel ratio feedback is under execution. When the diagnosis execution condition is not satisfied in step 701, the canister closure valve 26 is fully opened in step 838, and the purge control valve 31 is brought under normal control condition in step 839, and the program goes to step 855.

When the diagnosis execution condition is satisfied in step 701, it is determined whether a diagnosis prohibit condition is not satisfied in step 702. The prohibit conditions are when an accidental fire occurs, when a failure is found in a driving condition detector (for example, when a fuel level gauge fails, when the vehicle speed sensor 47 fails, when the pressure sensor 20 fails, when an air flow sensor fails, when the intake pipe pressure sensor 50 fails, when a rotation sensor fails, when the throttle sensor 45 fails, when the atmospheric pressure sensor 48 fails, when an oxygen sensor fails, when the intake air temperature sensor 51 fails, or the cooling water temperature sensor 50 fails), when a fuel supply system fails, when an ignition system fails, when the canister closure valve 26 fails, and when a heater for the oxygen sensor fails. The diagnosis prohibit condition is satisfied when one of the above failures is found. The diagnosis prohibit condition is not satisfied when none of the above failures is found. When the diagnosis prohibit condition is not unsatisfied, the execution of the abnormality diagnosis is prohibited, and the program goes to step 838 to open the canister closure valve 26.

When the diagnosis prohibit condition is not satisfied, the program goes to step 703. In step 703, it is determined whether a generated amount of the evaporated gas (an adsorbed gas amount in the canister 23) is small, by determining whether a gas concentration change amount ΔFGPG is equal to or less than the determination value KFLGA, and whether the gas concentration FGPG is equal to or less than the determination value KFLGB.

Figures 16A, 16B, 17A, 17B:
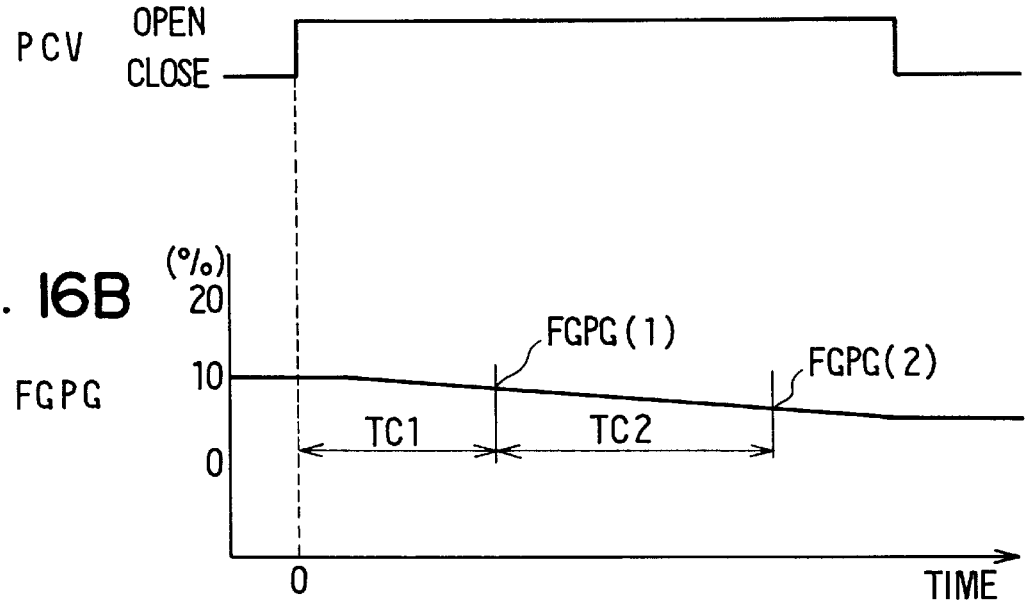
FIGS. 16A and 16B are time charts showing a relationship between an operation of the purge control valve and a measurement timing of an evaporated gas concentration FGPG according to an abnormality diagnosis routine in the second embodiment of the present invention.
FIG. 17A is a map to determine determination values KFLGA and KFLGB based on the cooling water temperature according to the abnormality diagnosis routine in the second embodiment of the present invention.
FIG. 17B is a map to determine KFLGA and KFLGB based on accumulated time of the purge execution according to the abnormality diagnosis routine in the second embodiment of the present invention.

The gas concentration change amount ΔFGPG is measured during the purge execution before the abnormality diagnosis execution. The gas concentration fluctuates immediately after the purge starts because the gas generating condition is unstable for a while after the start of the purge. Therefore, as shown in FIGS. 16A and 16B, the gas concentration measurement is performed after a predetermined period TC1 which is necessary to stabilize the gas concentration after the start of the purge. Specifically, the gas concentration FGPG(1) is detected at TC1 after the start of the purge, and the gas concentration FGPG(2) is detected at TC2. The gas concentration change amount ΔFGPG is a difference between FGPG(1) and FGPG(2). Alternatively, the gas concentration change amount ΔFGPG may be set at a value (or its inverse) obtained from a difference between FGPG(1) and FGPG(2) divided by FGPG(1) or FGPG(2).

Although the determination values KFLGA and KFLGB may be constant, they are determined from maps shown in FIGS. 17A or 17B in the second embodiment. FIG. 17A is a map to determine KFLGA and KFLGB according to the cooling water temperature. FIG. 17B is a map to determine KFLGA and KFLGB according to accumulated time of the purge execution. These determinations correspond to determination value setting means in the present invention.

The determination values KFLGA and KFLGB may be determined based on elapsed time after the start of the engine, or may be determined based on at least two parameters among the cooling water temperature, the accumulated time of the purge execution, and the elapsed time after the start of the engine. When KFLGA and KFLGB are determined based on the cooling water temperature, KFLGA and KFLGB determined based on the cooling water temperature at the engine start may be used even after the engine start. Step 703 corresponds to diagnosis execution condition determining means in the present invention.

When it is determined "No" in step 703 (when it is presumed that the generated amount of the evaporated gas is large), the execution of the abnormality diagnosis is prohibited, and the canister closure valve 26 is fully opened in step 838, and the purge control valve 31 is brought under the normal control in step 839, and first through fifth flags are reset to "0" in step 855, and the routine ends.

When it is determined "Yes" in step 703 (when it is presumed that the generated amount of the evaporated gas is small), it is determined whether the fourth flag F4 is "1" in step 704. When F4 is equal to "0", the atmospheric pressure Pa1 is read in step 705, and the fourth flag F4 is set to "1" in step 706.

When F4 is equal to "1" in step 704, the program jumps to step 707 to read the atmospheric pressure Pa2 at the second time. In step 708, an atmospheric pressure change ΔPa (=Pa2−Pa1) is calculated. In step 709, it is determine whether the absolute value of ΔPa is greater than a predetermined value (for example, 3 mmHg). When |ΔPa| is equal to or greater than 3 mmHg, the execution of the abnormality diagnosis is prohibited, and the canister closure valve 26 is fully opened in step 838, and the purge control valve 31 is brought under the normal control in step 839, and first through fifth flags are reset to "0" in step 855, and the routine ends. When |ΔPa| is less than 3 mmHg, the program goes to steps 801 through 805 to determine the location of the routine (to what extent the routine has finished) from the flags F1 through F5, and branches into various steps. The flags F1 through F5 are reset to "0" by an initialization immediately after the turning on of the ignition switch.

When it is determined "No" in all steps 801 through 805, the program goes to step 806 in FIG. 14. In step 806, it is determined according to fuel temperature and fuel temperature change amount whether an evaporated gas concentration reducing operation (steps 808 through 818) should be executed. Although the fuel temperature may be detected by a fuel temperature sensor (not shown) located in the fuel tank 17, it may be presumed from the cooling water temperature, the intake air temperature (or outer temperature), an accumulated driven time from the engine start, or a driving condition.

In step 806, it is determined (1) whether the fuel temperature is equal to or greater than a predetermined temperature α, and (2) whether the fuel temperature change amount is equal to or less than β. When it is determined "Yes" in step 806, the program goes to step 808 because it is presumed that a partial pressure of the evaporated gas component in the fuel tank 17 may be close to the saturated vapor pressure.

Figures 18A, 18B, 18C:
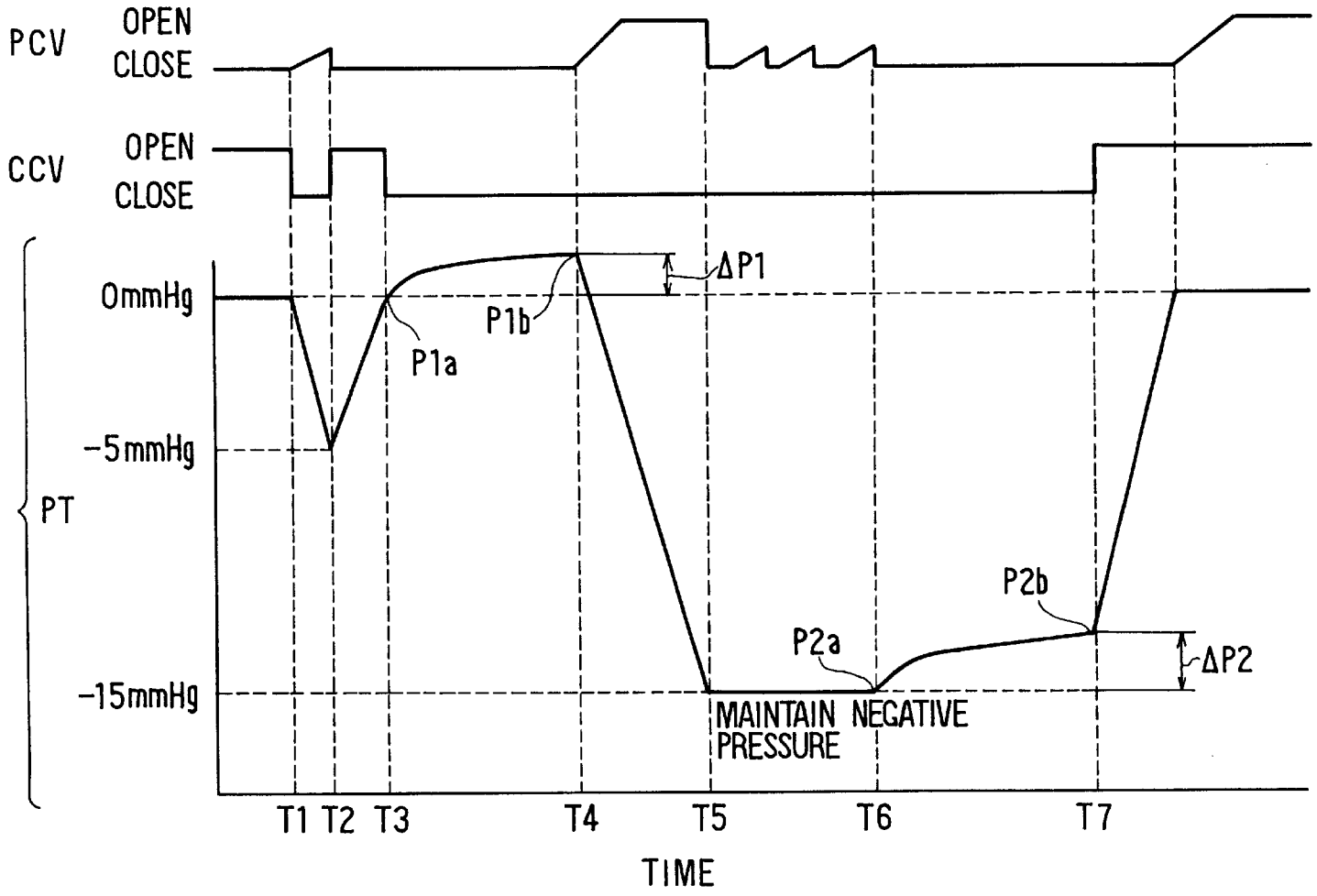
FIGS. 18A, 18B and 18C are time charts showing a relationship among operations of the purge control valve and the canister closure valve, and a fuel tank inner pressure PT according to the abnormality diagnosis routine in the second embodiment of the present invention.

The canister closure valve 26 is fully closed in step 808, and the purge control valve 31 is opened in step 809 to introduce the negative pressure of the intake pipe 12 into the gas purge passage 21 (time T1 to T2 in FIGS. 18A, 18B and 18C). Accordingly, the concentration (the partial pressure of the evaporated gas component) in the gas purge passage 21 is reduced because the evaporated gas in the gas purge passage 21 is sucked into the intake pipe 12. Therefore, the pressure difference between the partial pressure of the evaporated gas component in the gas purge passage 21 and the saturated vapor pressure becomes large.

In step 810, it is determined whether the fuel tank inner pressure PT detected by the pressure sensor 20 is equal to or less than −5 mmHg. When PT is greater than −5 mmHg, the first flag F1 is set to "1" which means that it is still introducing the negative pressure in step 811, and the program ends. In this case, when this program is again executed thereafter, it is determined "Yes" in step 801. Therefore, the negative pressure introduction (opening operation of the purge control valve 31) is continued until PT is lowered to −5 mmHg or less by repeating the processes of step 801→step 810→. . . .

When PT becomes equal to or lower than −5 mmHg at T2 in FIGS. 18A, 18B and 18C, it is determined "Yes" in step 810, and goes to step 812 to reset the first flag F1 at "0". In step 813, the canister closure valve 26 is fully opened, and the purge control valve 31 is fully closed in step 814 to introduce the atmospheric pressure into the gas purge passage 21.

In step 815, it is determined whether PT returns to the atmospheric pressure (0 mmHg). When PT is not 0 mmHg, the second flag F2 is set to "1" which means that it is still introducing the atmospheric pressure in step 816, and the program ends. In this case, when this program is again executed thereafter, it is determined "No" in step 801 and "Yes" in step 802. Therefore, the atmospheric pressure introduction is continued until PT returns to 0 mmHg by repeating the processes of step 801→step 802→815 . . . .

When PT becomes 0 mmHg in step 815, the second flag F2 is reset to "0" instep 817. The canister closure valve 26 is fully closed in step 818 to seal the gas purge passage 21 hermetically, and the pressure deviation amount from the atmospheric pressure (the pressure change amount) ΔP1 is measured by processes in steps 822 through 829.

When it is determined the fuel temperature is less than the predetermined temperature α, or the fuel temperature change amount is greater than β in step 806, it is estimated that the partial pressure of the evaporated gas component in the fuel tank 17 is quite higher than the saturated vapor pressure. Therefore, it is not necessary to reduce the evaporated gas concentration. In this case, the program goes to steps 820 and 821 to close the purge control valve 31 and the canister closure valve 26 to close the evaporated gas purge system (the evaporated gas purge passage 21 ), and the pressure change amount ΔP1 from the atmospheric pressure according to steps 822 through 829.

In step 822, P1a at T3 in FIGS. 18A, 18B and 18C is read, and the timer T is reset and started. In step 823, it is determined whether the counted value of the timer T is equal to or greater than 15 seconds. When T is less than 15 seconds, the third flag F3 is set to "1" which means that it is under measurement of the pressure change in step 824, and the program ends.

In this case, when this program is again executed thereafter, it is determined "No" in steps 801 and 802, and is determined "Yes" in step 803. Therefore, the processes of step 801→step 802→step 803→823→. . . are performed. During this period, PT increases from 0 mmHg between T3 and T4 in FIGS. 18A, 18B and 18C according to the generated amount of the evaporated gas in the fuel tank 17.

When 15 seconds have passed after T3 (when P1a is detected), P1b detected by the pressure sensor 20 is read in step 825 in FIG. 15A. In step 826, fuel consumption during the first measurement period (from T3 to T4) is calculated in step 826. The fuel consumption is calculated from one of maps shown in FIGS. 19A through 19D. FIG. 19A is a map to determine the fuel consumption according to an average injection pulse (average injection amount) during the pressure measurement period. FIG. 19B is a map to determine the fuel consumption according to an average vehicle speed during the pressure measurement period. FIG. 19C is a map to determine the fuel consumption according to an average engine speed during the pressure measurement period. FIG. 19D is a map to determine the fuel consumption according to an average intake air amount during the pressure measurement period. The fuel consumption may be determined according to an average intake pipe pressure during the pressure measurement period. The fuel consumption may be calculated by accumulating the injection pulse during the pressure measurement period. FIGS. 19A through 19D are set such that the fuel consumption increases as the parameters, such as the average injection pulse, the average vehicle speed, the average engine speed, the average intake air amount (or the average intake pipe pressure), increase. The fuel consumption may be calculated from a map or an equation based on two or more parameters among the above parameters. The step 826 corresponds to fuel consumption determining means in the present invention. In FIGS. 19A through 19D and FIG. 20, " . . . " represents data.

After determining the fuel consumption in step 826, the program goes to step 827 to calculate pressure compensation amount ΔP1b for P1b from a map, such as FIG. 20, based on the fuel consumption and the fuel remaining amount (or a fuel tank volume not occupied by fuel ("air volume")). Alternatively, ΔP1b may be calculated from the following equation:

$$\Delta P1b = 760 \times (\text{the fuel consumption}/\text{the air volume})$$

In this equation, (the air volume)=(the fuel tank volume)−(the fuel remaining amount). The fuel remaining amount is detected by a fuel gauge (not illustrated) installed in the fuel tank 17. The reason for calculating ΔP1b based on the ratio of the fuel consumption to the air volume is to compensate P1b which varies with a ratio of the fuel consumption to the air volume.

In step 828, the pressure change amount ΔP1 during the first pressure measurement period (from T3 to T4) is calculated from the following equation:

$$\Delta P1 = P1b - P1a + \Delta P1b$$

Accordingly, ΔP1 without an influence of the air volume increase caused by the fuel consumption is obtained.

In step 829, the third flag F3 is reset to "0" to terminate the measurement of ΔP1.

In step 830, the purge control valve 31 is opened, and the timer T is reset and started. The intake pipe negative pressure is introduced into the gas purge passage 21 having the atmospheric pressure by opening the purge control valve 31 (from T4 to T5 in FIGS. 18A, 18B and 18C). Accordingly, the fuel tank inner pressure PT starts to decrease if there is no leakage in the gas purge passage 21.

Instep 831, it is determined whether PT is equal to or less than a predetermined negative pressure (for example, −15 mmHg). When PT is greater than −15 mmHg, it is determined in step 832 whether 2 seconds have passed after the start of the negative pressure introduction. When it is before elapsing 2 seconds, the program goes to step 835 to set the fourth flag F4 to "1" which means that it is still introducing the negative pressure. In this case, when this program is again executed thereafter, it is determined "No" in steps 801, 802 and 803, and is determined "Yes" in step 804 because F4 is set to "1". Therefore, the processes of steps 801 through 804→step 831→ . . . are performed.

In step 836, it is determined whether the air fuel ratio compensation coefficient FAF is within a range between −20% and 20%. When FAF is within the range between −20% and 20%, it is determined instep 837 whether the pressure difference between the atmospheric pressure Pa and the intake pipe pressure PM is equal to or greater than 150 mmHg.

When it is determined "No" in step 836 or step 837, the execution of the abnormality diagnosis is prohibited, and the program goes to step 838 to open the canister closure valve 26, and the purge control valve 31 is brought under normal control condition in step 839, and the program goes to step 855, and first through fifth flags F1–F5 are reset to "0" in step 855, and the routine ends.

In step 840, it is determined whether a fuel injection amount compensation value FAFLEAK is equal to or greater than an upper limit value KFLEAKMX to know whether the introduction of the intake pipe negative pressure into the gas purge passage 21 is under a stable condition. when FAFLEAK is equal to or greater than KFLEAKMX, the program goes to step 841 to determine whether the control value "Duty" for driving the purge control valve 31 is less than 8%.

When it is determined "Yes" in step 841, it is considered that the introduction of the intake pipe negative pressure is unstable. Therefore, the execution of the abnormality diagnosis is prohibited, and the program goes to step 838 to open the canister closure valve 26, and the purge control valve 31 is brought under normal control condition in step 839, and the program goes to step 855, and first through fifth flags are reset to "0" in step 855, and the routine ends.

When it is determined "No" in steps 840 and 841, it is considered that the introduction of the intake pipe negative pressure is stable. Therefore, the routine ends.

If the introduction control of the intake pipe negative pressure is executed by the purge ratio PGR instead of using "Duty", step 841 may be executed by determining whether PGR is less than 0.2%, and the abnormality diagnosis may be prohibited when PGR is less than 0.2%.

When it is determined "Yes" in step 832 before determining "Yes" in step 831, in other words, when PT is still higher than −15 mmHg after elapsing two seconds from the beginning of the negative pressure introduction, it means that the negative pressure can not be introduced into the fuel tank 17. The possible reason for being unable to introduce the negative pressure into the fuel tank 17 may be a choke in the gas purge passage 21. In this case, the program goes to step 833 to set a choke flag Fclose to "1" which means that a choke is detected. Then, it goes to step 834 to warn (alarm) the abnormality by turning on the alarm lamp 53, and the routine ends.

When it is determined "Yes" in step 831 before determining "Yes" in step 832, in other words, when PT is equal to or less than −15 mmHg within two seconds from the beginning of the negative pressure introduction, the program goes to step 842 to reset the fourth flag F4 to "0". In step 843, the purge control valve 31 is fully closed to terminate the negative pressure introduction (at T5 in FIGS. 18A, 18B and 18C).

In step 844, the fuel tank inner pressure P2a, detected by the pressure sensor 20 at T6 (in FIGS. 18A, 18B and 18C) which is immediately after sealing the gas purge passage 21 hermetically with the negative pressure, is read and memorized, and the timer T is reset and started. After this, PT increases from −15 mmHg according to the evaporated gas generated in the fuel tank 17 between T6 and T7 in FIGS. 18A, 18B and 18C.

In step 845, it is determined whether 15 seconds have passed after reading P2a (whether the timer T is equal to or greater than 15 seconds). When it is determined that T is less than 15 seconds, the program goes to step 846 to set the fifth flag F5 to "1" which means that it is during the pressure change detection period, and the routine ends. Accordingly, when this program is again executed thereafter, it is determined "No" in steps 801 through 804, and is determined "Yes" in step 805, and the processes of steps 801 through 805→step 845→ . . . are performed.

When it is determined that T reaches 15 seconds in step 845, the program goes to step 847 to read P2b detected by the pressure sensor 20 at T7 in FIGS. 18A, 18B and 18C. In step 848, the fuel consumption during the second pressure measurement period (from T6 to T7 in FIGS. 18A, 18B and 18C) is calculated in the same way described in step 826.

In step 849, pressure compensation amount ΔP2b for P2b is calculated from a map, such as FIG. 20, based on the fuel consumption and the fuel remaining amount (or a fuel tank volume not occupied by fuel ("air volume")).

Alternatively, ΔP2b may be calculated from the following equation:

$$\Delta P2b=(760-20)\times(\text{the fuel consumption/the air volume})$$

In step 850, the pressure change amount ΔP2 during the second pressure measurement period (from T6 to T7 in FIGS. 18A, 18B and 18C) is calculated from the following equation:

$$\Delta P2=P2b-P2a+\Delta P2b$$

Accordingly, ΔP2 without an influence of the air volume increase caused by the fuel consumption is obtained.

In step 851, ΔP2 is compensated by the following equation:

$$\Delta P2=\Delta P2\times FDP$$

In this equation, FDP represents a compensation coefficient which is determined according to P1a as shown in FIG. 5. As understood from FIG. 5, FDP becomes smaller as P1a becomes lower.

In step 852, it is determined based on the leakage determination condition shown in the following inequality whether the leakage exists:

$$\Delta P2>\gamma\cdot\Delta P1\cdot BA+\epsilon$$

In the above inequality, γ represents a compensation coefficient to compensate a difference of the fuel evaporation amount caused by the difference between the atmospheric pressure and the negative pressure. ϵ represents a compensation coefficient to compensate a pressure leakage at the canister closure valve 26 or the like. BA represents a compensation coefficient to compensate ΔP1 under the atmospheric pressure according to the evaporated gas concentration, and is determined from a map shown in FIG. 21. The pressure change amount ΔP1 from the atmospheric pressure in the above inequality may be replaced by the pressure change amount ΔP2 from the negative pressure.

The above inequality may be replaced by the following inequality:

$$\Delta P2>\gamma\cdot\Delta P1+\epsilon+BB$$

In this inequality, BB represents a compensation coefficient to compensate ΔP1 under the atmospheric pressure according to the evaporated gas concentration, and is determined from a map shown in FIG. 21.

In FIG. 21, the compensation coefficients BA and BB are determined according to the evaporated gas concentration. However, the compensation coefficients BA and BB may be determined according to the change amount of the evaporated gas concentration, or may be determined according to both of the evaporated gas concentration and the change amount of the evaporated gas concentration. Additionally, the compensation coefficients BA and BB may be compensated by the intake air temperature.

When the above inequality is satisfied, it is determined in step 852 that the leakage exists.

If there is a cause for the leakage in the hermetically sealed gas purge passage 21, a flowing out to the atmosphere from the gas purge passage 21 occurs under the positive pressure, and a flowing into the gas purge passage 21 from the atmosphere occurs under the negative pressure. Therefore, ΔP2 becomes greater than ΔP1 because (the pressure change amount under the atmospheric pressure ΔP1)=(generated amount of the evaporated gas in the fuel tank 17)−(an outflow to the atmosphere from the gas purge passage 21), and (the pressure change amount under the negative pressure ΔP2)=(generated amount of the evaporated gas in the fuel tank 17)+(an inflow to the gas purge passage 21 from the atmosphere). The above inequality is derived from such relationships.

When it is determined "Yes" ("the leakage exists in the gas purge passage 21") in step 852, the program goes to step 853 to set the leakage flag Fleak to "1", and the alarm lamp 53 is turned on in step 854 to warn the abnormality, and the routine ends.

When it is determined "No" ("no leakage exists in the gas purge passage 21") in step 852, the program goes to step 855 to reset first through fifth flags F1–F5 to "0", and the routine ends.

According to the second embodiment of the present invention, the following abnormalities are detected by the above abnormality diagnosis routine:

(Abnormality 1.) A damage or a fall of a part of the communication pipe 22 or the purge passage 30*a:*

Figure 15B:
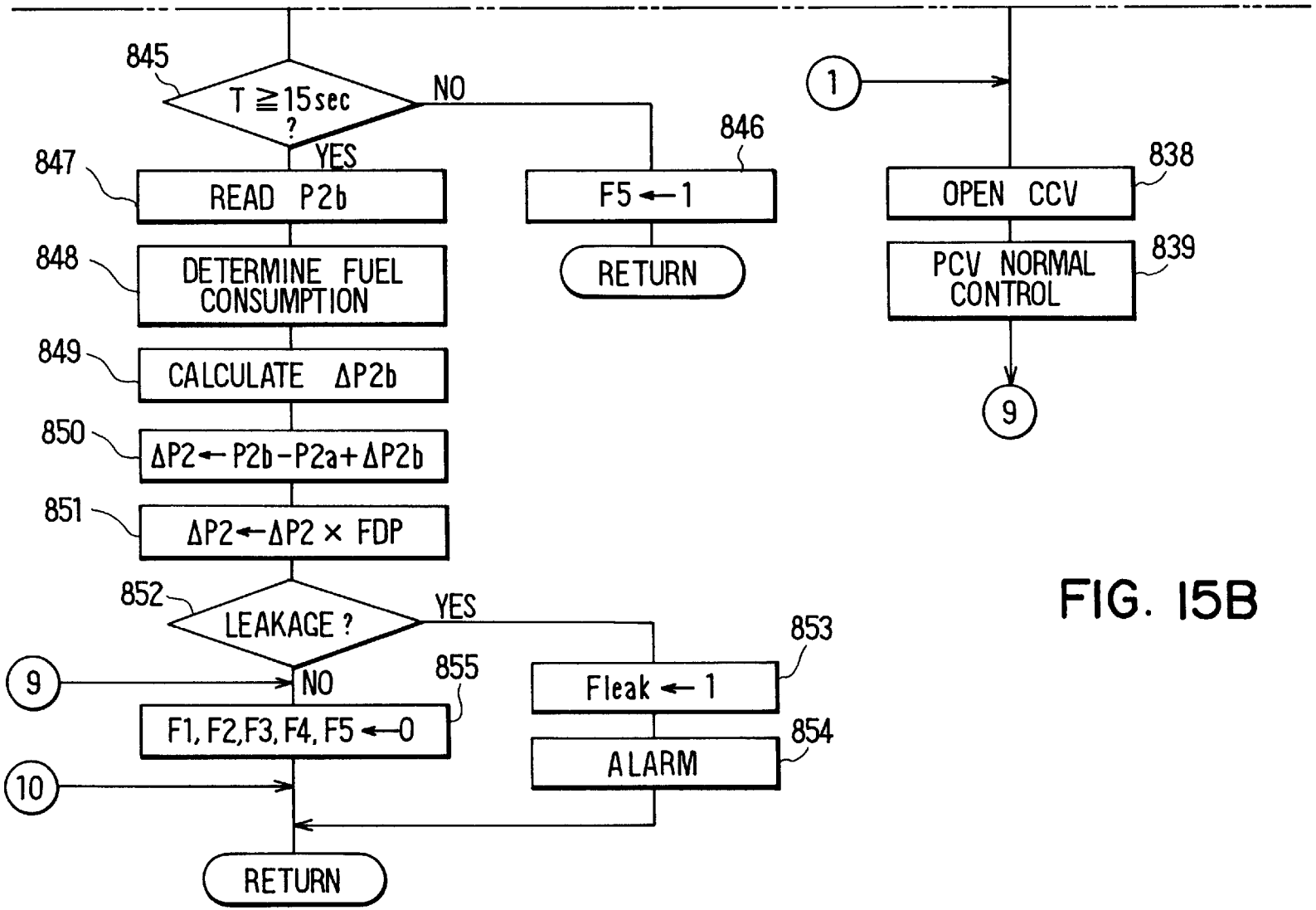

The atmosphere flows into the gas purge passage 21 via such damaged or fallen part under the negative pressure, and it flows out into the atmosphere via such damaged or fallen part under the positive pressure. Therefore, it is determined "leakage exists" in step 852, and the abnormality is informed in step 854 in FIG. 15B.

(Abnormality 2.) A bend or a crush of a part of the communication pipe 22 or the purge passage 30*a:*

The pressure in the gas purge passage 21 is not lowered or takes time to be lowered when the negative pressure is introduced. Therefore, it is determined "No" in step 831 and "Yes" in step 832, and the abnormality is informed in step 834 in FIG. 15A.

(Abnormality 3.) An impossibility of opening the purge control valve 31:

It is determined "No" in step 831 and "Yes" in step 832, and the abnormality is informed in step 834 in FIG. 15A because the negative pressure is not introduced into the gas purge passage 21. When the purge control valve 31 is impossible to be opened, the evaporated gas adsorbed by the adsorber 24 is not introduced into the intake pipe 12, and an adsorbing capacity of the adsorber 24 is saturated, and the evaporated gas is emitted via the atmosphere communication pipe 25.

(Abnormality 4.) A fall of a part of the purge passage 30*b:*

It is determined "No" in step 831 and "Yes" in step 832, and the abnormality is informed in step 834 in FIG. 15A because the negative pressure is not introduced into the gas purge passage 21 from the intake pipe 12.

(Abnormality 5.) A bend or a crush of a part of the communication pipe 22 or the purge passage 30*b:*

The pressure in the gas purge passage 21 is not lowered or takes time to be lowered when the negative pressure is introduced. Therefore, it is determined "No" in step 831 and "Yes" instep 832, and the abnormality is informed in step 834 in FIG. 15A. In this case, there is a possibility that the evaporated gas may be emitted via the atmosphere communication pipe 25 as described in the case of the above abnormality 3.

(Abnormality 6.) A choke of the atmosphere communication pipe 25 of the canister 23:

Although the evaporated gas is not purged when the purge passages 30*a,* 30*b* are crushed even if the purge control valve 31 is opened, this (abnormality 6) does not cause a sudden pressure increase shown in the case of the bend or the crush of a part of the communication pipe 22 or the purge passages 30*a,* 30*b,* because some of the evaporated gas may be purged when the purge control valve 31 is opened even if the atmosphere communication pipe 25 is choked. Therefore, the abnormality diagnosis routine in the second embodiment does not detect the abnormality of the choke at the atmosphere communication pipe 25. However, such abnormality of the choke at the atmosphere communication pipe 25 may be detected in step 847 if the fuel tank inner pressure P2b does not return to the neighborhood of the atmospheric pressure quickly when the canister closure valve 26 is opened after the detection of P2b.

(Abnormality 7.) An impossibility of closing the purge control valve 31:

In this case, the evaporated gas is always introduced into the intake pipe 12. However, the evaporated gas may not be emitted via the atmosphere communication pipe 25. Therefore, the abnormality diagnosis routine in the second embodiment does not detect the abnormality of the impossibility of closing the purge control valve 31. If it is necessary, it may be determined that the purge control valve 31 is unable to be closed if ΔP1 calculated in step 828 is lower than a predetermined negative pressure.

According to the second embodiment of the present invention, the execution and the termination of the abnormality diagnosis is determined by determining whether the generated amount of the evaporated gas is less than the predetermined value in step 703 in FIG. 13. Therefore, the drivability and the exhaust emission are improved by prohibiting the abnormality diagnosis from being executed when the generated amount of the evaporated gas is large, and the abnormality of the gas purge passage 21 is detected by executing the abnormality diagnosis when the generated amount of the evaporated gas is small.

The determination whether the evaporated gas concentration FGPG is equal to or less than KFLGB in step 703 may be omitted, because it is possible to determine the execution and the termination of the abnormality diagnosis by presuming the generated amount of the evaporated gas from only the evaporated gas concentration change amount ΔFGPG since the evaporated gas concentration change amount ΔFGPG increases as the generated amount of the evaporated gas increases.

Furthermore, KFLGA may be replaced by KFLGC which is determined from FIGS. 22A or 22B based on the cooling water temperature or purge execution accumulated time, respectively. In that case, the execution or termination of the abnormality diagnosis is determined by determining whether the change amount of the evaporated gas concentration is equal to or less than KFLGC in step 703. The determination value KFLGC may be determined based on the elapsed time after the start of the engine, or may be determined based on two parameters or more among the cooling water temperature, the purge execution accumulated time, and the elapsed time after the start of the engine.

Furthermore, the determination value KFLGC may be compensated by the following equation:

$$KFLGC=KFLGC-KFLGK$$

In this equation, the compensated value KFLGK is determined from FIG. 23 based on the intake air temperature.

According to the second embodiment of the present invention, the pressure change amount ΔP1 at the first pressure measurement period and the pressure change amount ΔP2 at the second pressure measurement period are compensated with respective pressure compensation amount ΔP1b and ΔP2b according to fuel consumption. Therefore, the detection accuracy for ΔP1 and ΔP2 is improved because the influence, caused by the increase of the air volume (the fuel tank volume not occupied by fuel) according to the fuel consumption, is eliminated. Accordingly, a small amount of the leakage, which was difficult to be detected in the prior art, is detected.

Alternatively, ΔP1b and ΔP2b used in the second embodiment may be calculated from the following equations:

$$\Delta P1b=760\times(\text{fuel consumption/fuel remaining amount})$$

$$\Delta P2b=(760-20)\times(\text{fuel consumption/fuel remaining amount})$$

One of fuel remaining amount at the end of the pressure measurement period, fuel remaining amount at the start of the pressure measurement period, and average fuel remaining amount during the pressure measurement period may be used as the fuel remaining amount in the above equations.

According to the second embodiment of the present invention, the evaporated gas concentration is reduced by releasing (emitting) the evaporated gas in the fuel tank 17 before measuring the pressure change amount ΔP1 from the atmospheric pressure. Therefore, the pressure difference between the partial pressure of the evaporated gas component in the fuel tank 17 and the saturated vapor pressure is increased. Thus, the pressure change amount ΔP1 from the atmospheric pressure is measured without being affected by the fuel system, such as a fuel temperature. Accordingly, the detection accuracy for the abnormality diagnosis of the evaporated gas purge system is improved.

Furthermore, it is determined based on the fuel temperature and the fuel temperature change amount whether the execution condition for the reducing operation of the evaporated gas concentration is satisfied in the second embodiment of the present invention. When the execution condition is not satisfied (when it is estimated that the partial pressure of the evaporated gas component is quite smaller than the saturated vapor pressure), the pressure change amount ΔP1 is measured without executing the reducing operation of the evaporated gas concentration. Accordingly, the abnormality diagnosis of the evaporated gas purge system is executed in a shorter time period than that of the prior art.

The determination of the execution condition for the reducing operation of the evaporated gas concentration may be executed based on only one of the fuel temperature and the change amount of the fuel temperature. Furthermore, the evaporated gas concentration reducing operation may be executed every routine without determining the execution condition of the evaporated gas concentration reducing operation (by omitting step 806).

(Third embodiment)

Figures 24A, 24B, 24C:
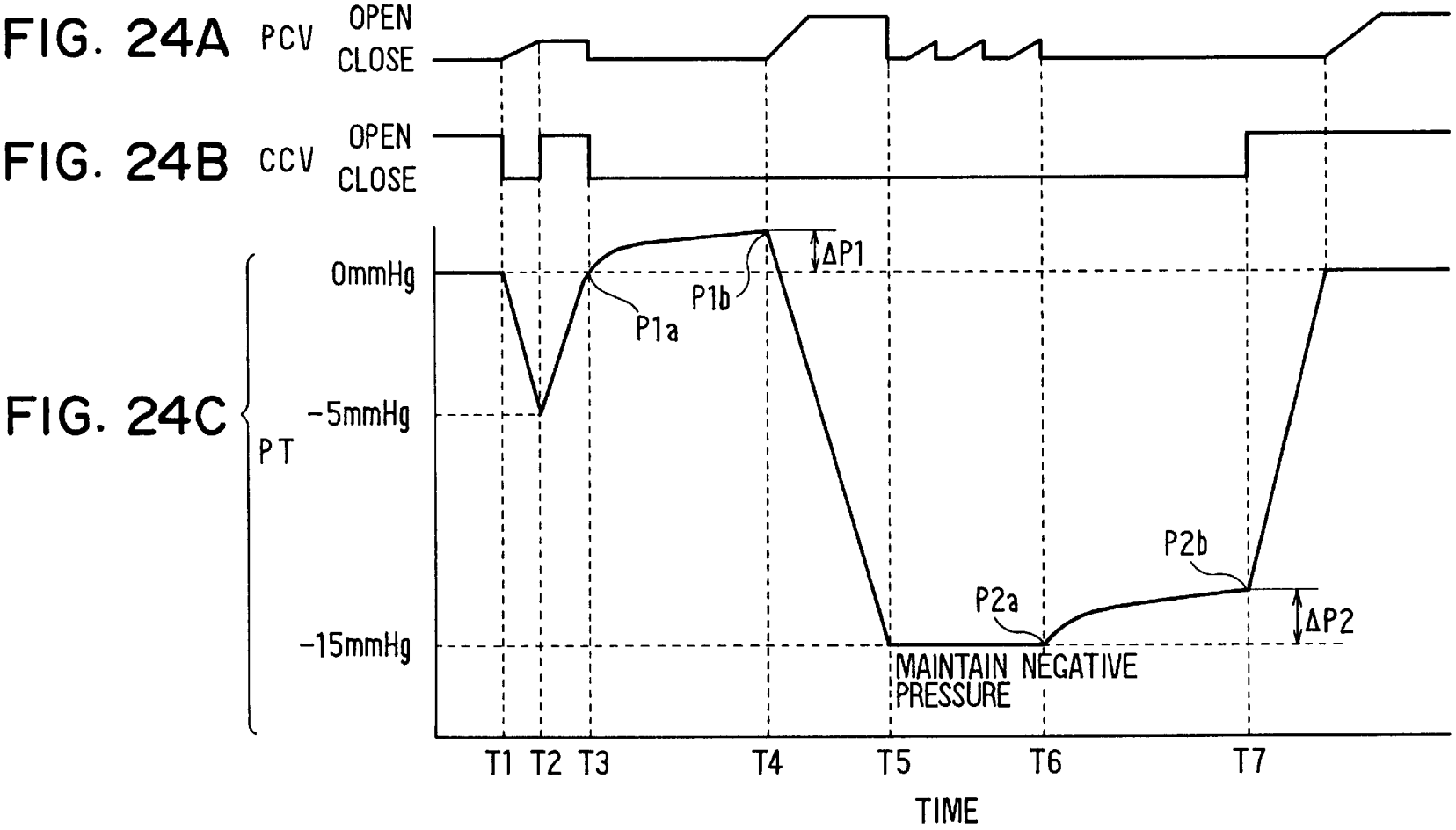
FIGS. 24A, 24B and 24C are time charts showing a relationship among operations of the purge control valve and the canister closure valve, and a fuel tank inner pressure PT according to the abnormality diagnosis routine in a third embodiment of the present invention.

Although the canister closure valve 25 is opened and the purge control valve 31 is closed when PT is returned to the atmospheric pressure at the end of the evaporated gas concentration reducing operation (between T2 and T3 in FIGS. 18A, 18B and 18C) in the second embodiment, both the canister closure valve 25 and the purge control valve 31 are opened when PT is returned to the atmospheric pressure at the end of the evaporated gas concentration reducing operation (between T2 and T3 in FIGS. 24A, 24B and 24C) in the third embodiment of the present invention. Other construction and processes are the same as the second embodiment.

According to the third embodiment of the present invention, the evaporated gas, which is adsorbed by the canister 23, is prevented from returning to the fuel tank 17 by opening the purge control valve 31 when the atmospheric pressure is introduced. Accordingly, the evaporated gas concentration in the fuel tank 17 is certainly reduced.

(Fourth embodiment)

Figures 25A, 25B, 25C:
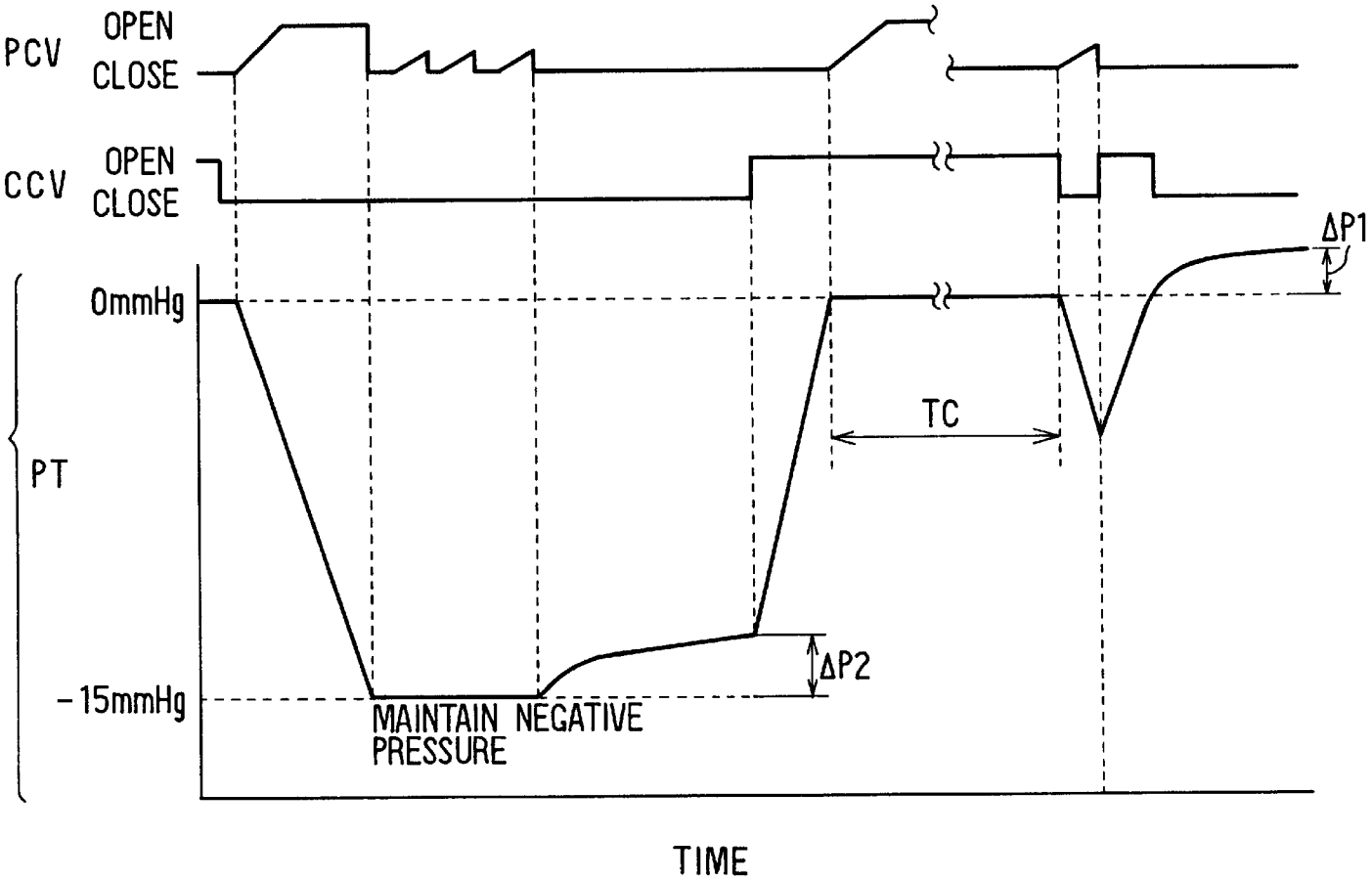
FIGS. 25A, 25B and 25C are time charts showing a relationship among operations of the purge control valve and the canister closure valve, and a fuel tank inner pressure PT according to the abnormality diagnosis routine in a fourth embodiment of the present invention.

Although the pressure change amount ΔP2 from the negative pressure is measured after the measurement of the pressure change amount ΔP1 from the atmospheric pressure in the second and the third embodiment of the present invention, ΔP1 is measured after the measurement of ΔP2 and the execution of the evaporated gas concentration reducing operation after elapsing a certain time period TC after PT returns to the atmospheric pressure as shown in FIGS. 25A, 25B and 25C according to the fourth embodiment of the present invention. Other construction and processes are the same as the second and third embodiments.

When PT is returned to the atmospheric pressure after the measurement of ΔP2, the evaporated gas component in the fuel tank 17 becomes saturated condition rapidly, and the inside of the fuel tank 17 is unstable for a while. According to the fourth embodiment of the present invention, the evaporated gas concentration reducing operation is performed after the time period TC has passed. Accordingly, the evaporated gas concentration in the fuel tank 17 is certainly reduced before measuring ΔP1.

(Fifth embodiment)

Figures 26A, 26B, 26C:
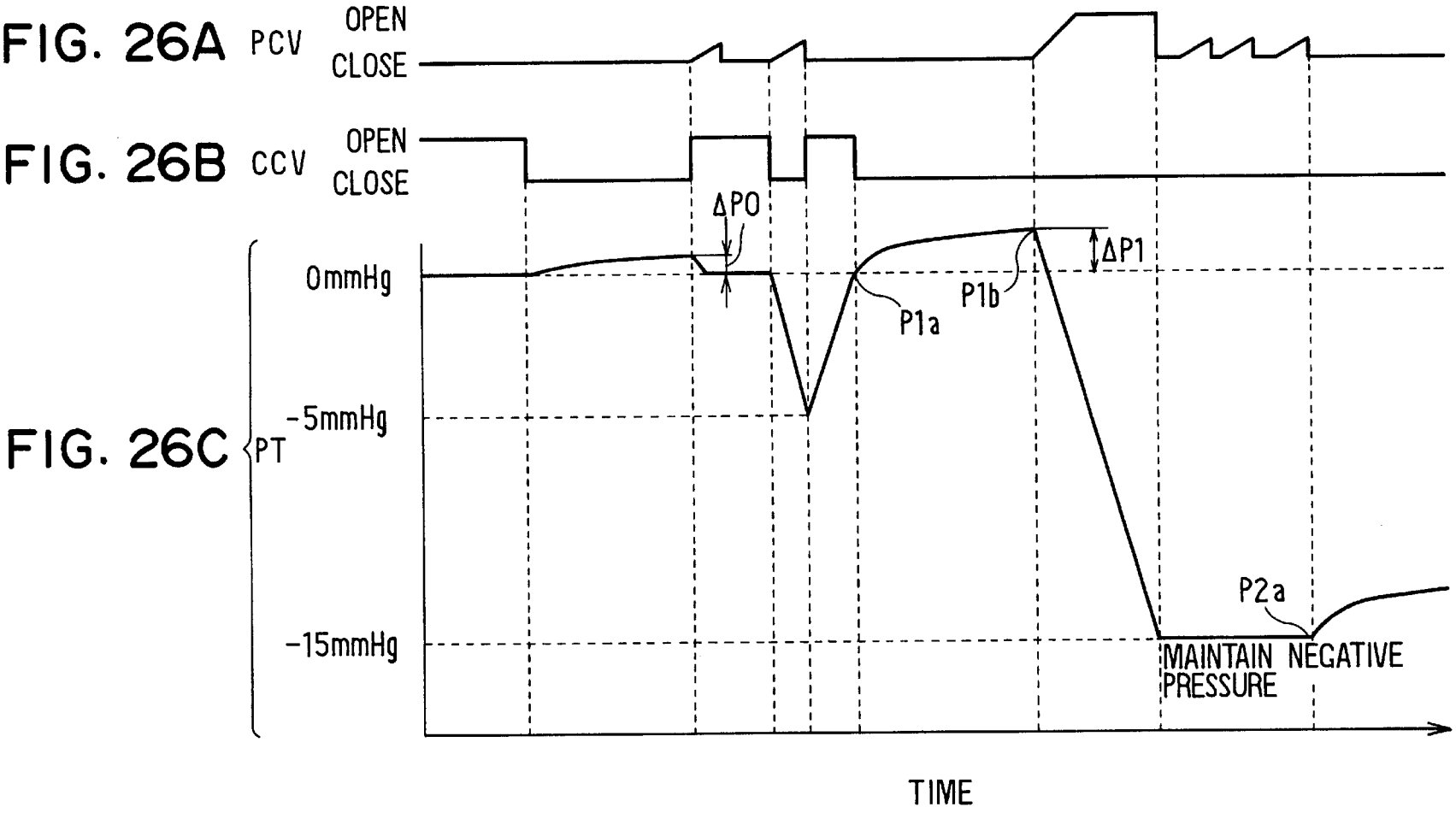
FIGS. 26A, 26B and 26C are time charts showing a relationship among operations of the purge control valve and the canister closure valve, and a fuel tank inner pressure PT according to the abnormality diagnosis routine in a fifth embodiment of the present invention.

It is determined based on the fuel temperature and the fuel temperature change amount whether the execution condition for the reducing operation of the evaporated gas concentration is satisfied, according to the second embodiment of the present invention. According to the fifth embodiment as shown in FIGS. 26A, 26B and 26C, however, a preliminary measurement for measuring a pressure change amount ΔP0 is performed by adjusting PT to the atmospheric pressure before executing the abnormality diagnosis of the evaporated gas purge system. Then, it is determined by comparing ΔP0 with a predetermined value whether the evaporated gas concentration reducing operation is to be executed.

Specifically, it is estimated that the partial pressure of the evaporated gas component in the fuel tank 17 is close to the saturated vapor pressure when ΔP0 is less than the predetermined value. In this case, it is necessary to reduce the evaporated gas concentration in the fuel tank 17. Thus, the evaporated gas concentration in the fuel tank 17 is reduced by emitting the evaporated gas in the fuel tank 17 in the same way described in the second embodiment.

It is estimated that the partial pressure of the evaporated gas component in the fuel tank 17 is quite lower than the saturated vapor pressure when ΔP0 is equal to or greater than the predetermined value. In this case, it is not necessary to reduce the evaporated gas concentration in the fuel tank 17. Therefore, ΔP1 is measured without executing the evaporated gas concentration reducing operation.

The number of the measurement of ΔP0 may be one or more.

(Sixth embodiment)

Figure 27:
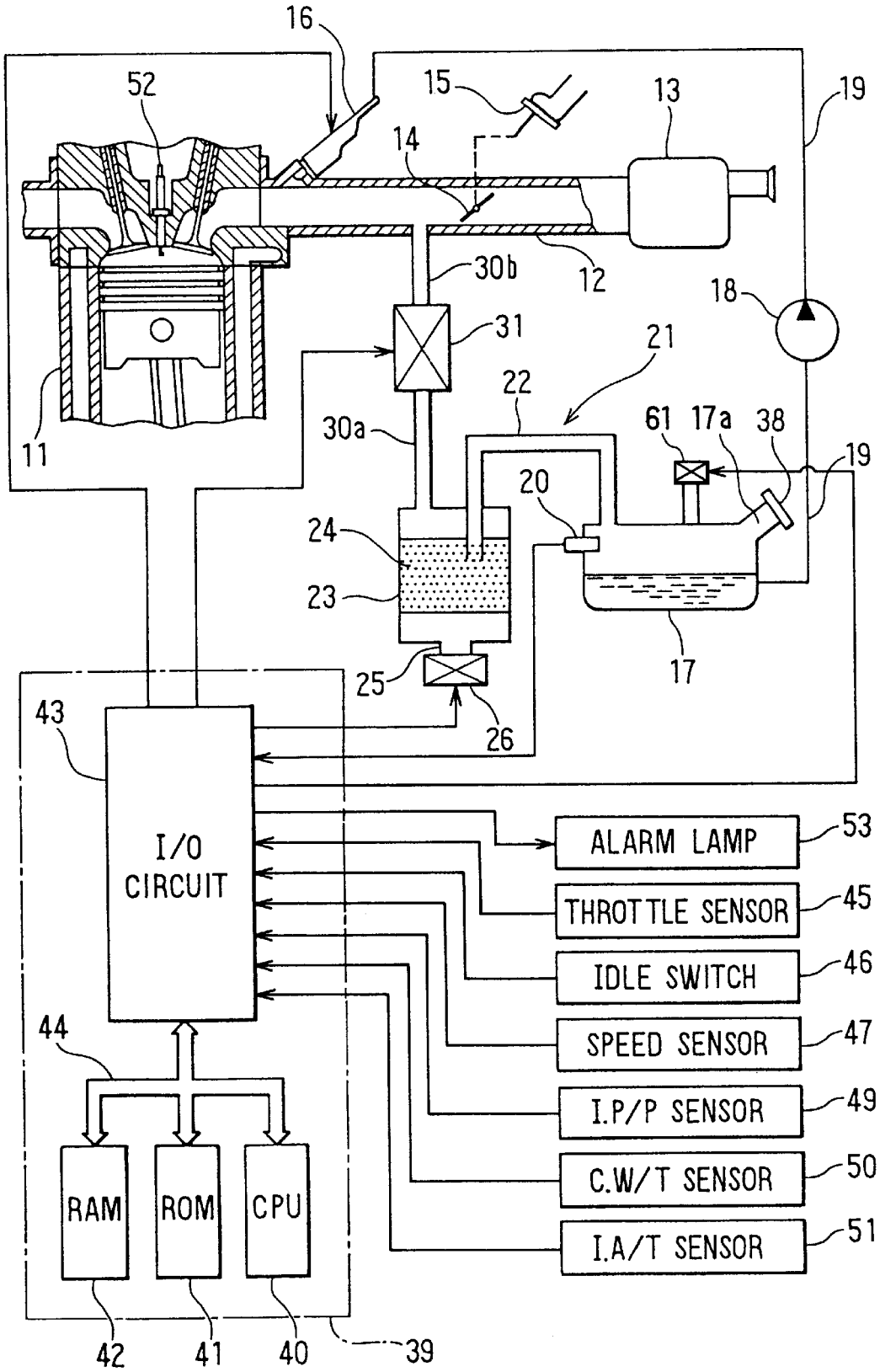
FIG. 27 is a schematic illustration showing a total gas purge system according to a sixth embodiment of the present invention.

According to the second through fifth embodiments of the present invention, the canister closure valve 25 is opened to introduce the atmospheric pressure into the gas purge system (the gas purge passage 21) when the fuel tank inner pressure PT is returned to the atmospheric pressure. According to the sixth embodiment as shown in FIG. 27, however, a relief valve 61 is installed in the purge passage between the fuel tank 17 and the canister 23 to introduce the atmospheric pressure into the gas purge system by opening the relief valve 61 when PT is returned to the atmospheric pressure.

Instead of detecting the inner pressure of the fuel tank 17, a pressure at any place in the gas purge passage 21, such as a pressure at the communication pipe 22, may be detected by the pressure sensor 20.

(Seventh embodiment)

A seventh embodiment of the present invention will be described with reference to FIGS. 28 through 41. In this seventh embodiment, explanations for routines of air fuel ratio feedback control, purge ratio control, purge ratio moderate control, evaporated gas concentration detection control, and purge control valve control are omitted because they are the same as those in the second embodiment.

Figure 28:
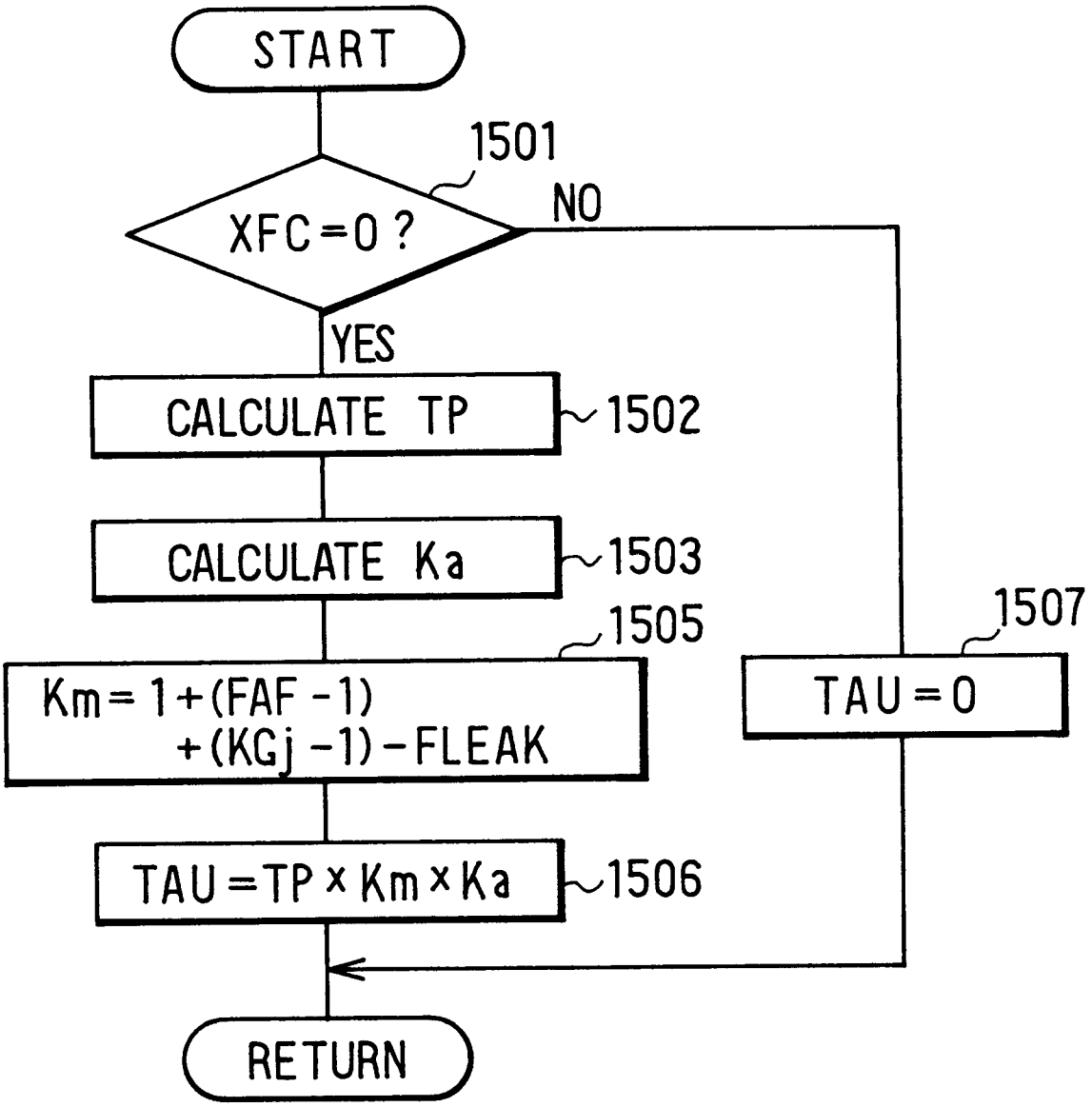
FIG. 28 is a flowchart showing a fuel injection amount control routine according to a seventh embodiment of the present invention.

A fuel injection amount control in the seventh embodiment is executed according to a flowchart shown in FIG. 28 as an interruption handling routine every 4 msec.

In step 1501, it is determined whether a fuel cut flag XFC is "0" which represents not to execute the fuel cut. When it is determined that XFC=1 (execution of the fuel cut), the fuel injection amount TAU is set to "0" instep 1507, and the fuel injection amount control routine ends. As a result, the fuel cut is performed.

On the other hand, when XFC=0 (non-execution of the fuel cut), a basic injection amount TP based on the engine speed NE and an engine load (for example, the intake pipe pressure PM) is calculated in step 1502 according to data held in the ROM 41 as a map. In step 1503, various compensation coefficients Ka regarding the driving conditions of the engine 11, such as a cooling water temperature compensation coefficient, a compensation coefficient after starting of the engine, an intake air temperature compensation coefficient and the like, are calculated.

In step 1505, an air fuel ratio compensation coefficient Km is calculated from the following equation according to FAF, an air fuel ratio learned value KGj, and an anticipated compensation coefficient FLEAK:

$$Km=1+(FAF-1)+(KGj-1)-FLEAK$$

In the above equation, KGj is a backup data to be stored in the RAM 42, and is a coefficient which is set for each engine driving region. The anticipated compensation coefficient FLEAK is a coefficient to compensate the anticipated deviation of the air fuel ratio caused by purging the evaporated gas from the gas purge passage 21 to the intake pipe 12 when the intake pipe negative pressure is introduced into the gas purge passage 21 at the abnormality diagnosis of the gas purge passage 21. Methods for calculating the anticipated compensation coefficient FLEAK will be described hereinafter.

In step 1506, the fuel injection amount TAU is calculated by multiplying Km and various compensation coefficients Ka by TP as follows:

$$TAU=TP\times Km\times Ka$$

CPU 40 performs the fuel injection with the fuel injection valve 16 based on TAU and a predetermined injection timing. Steps 1505 and 1506 correspond to anticipated compensation means in the present invention.

Figure 29:
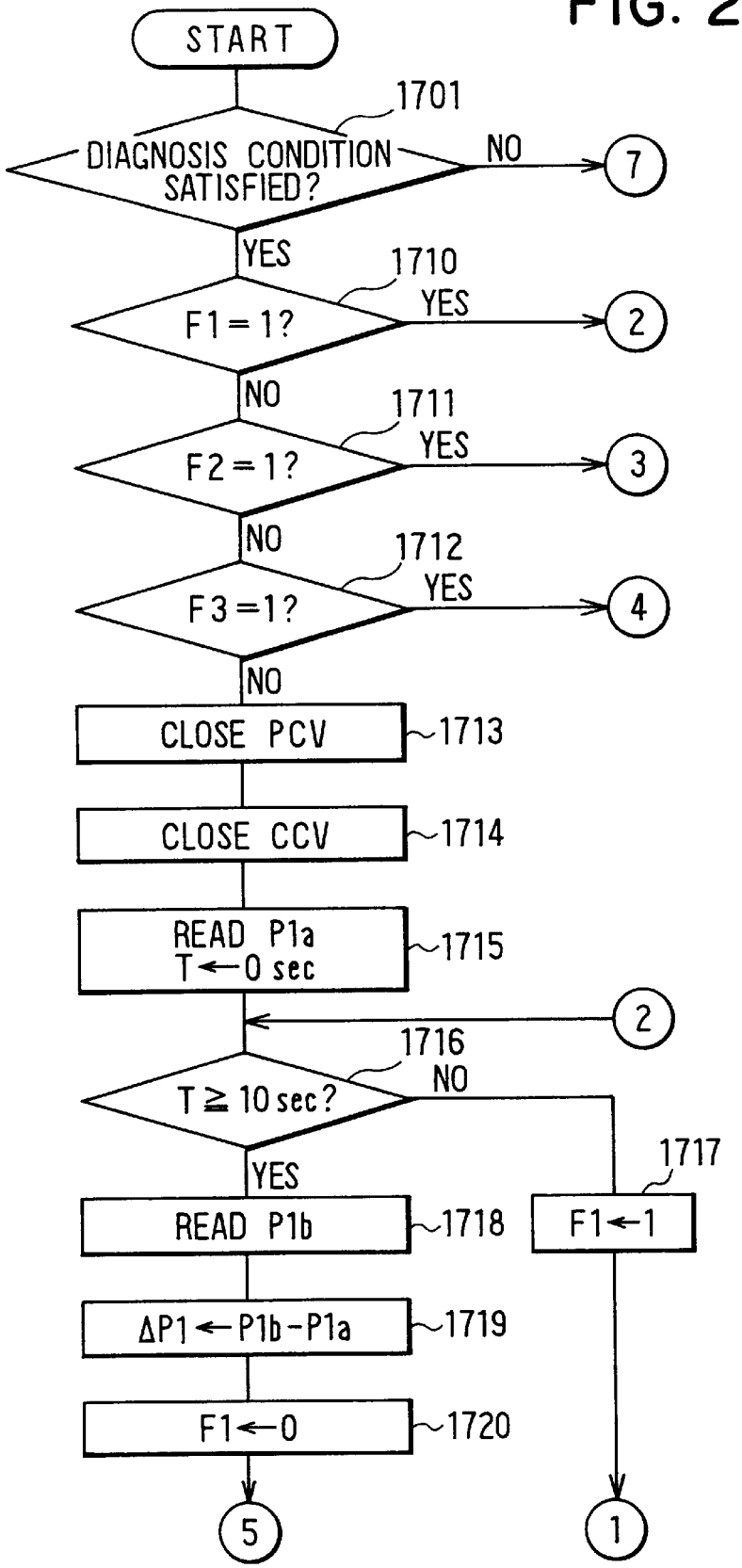
FIG. 29 is a part of a flowchart showing an abnormality diagnosis routine according to the seventh embodiment of the present invention.
Figure 30:
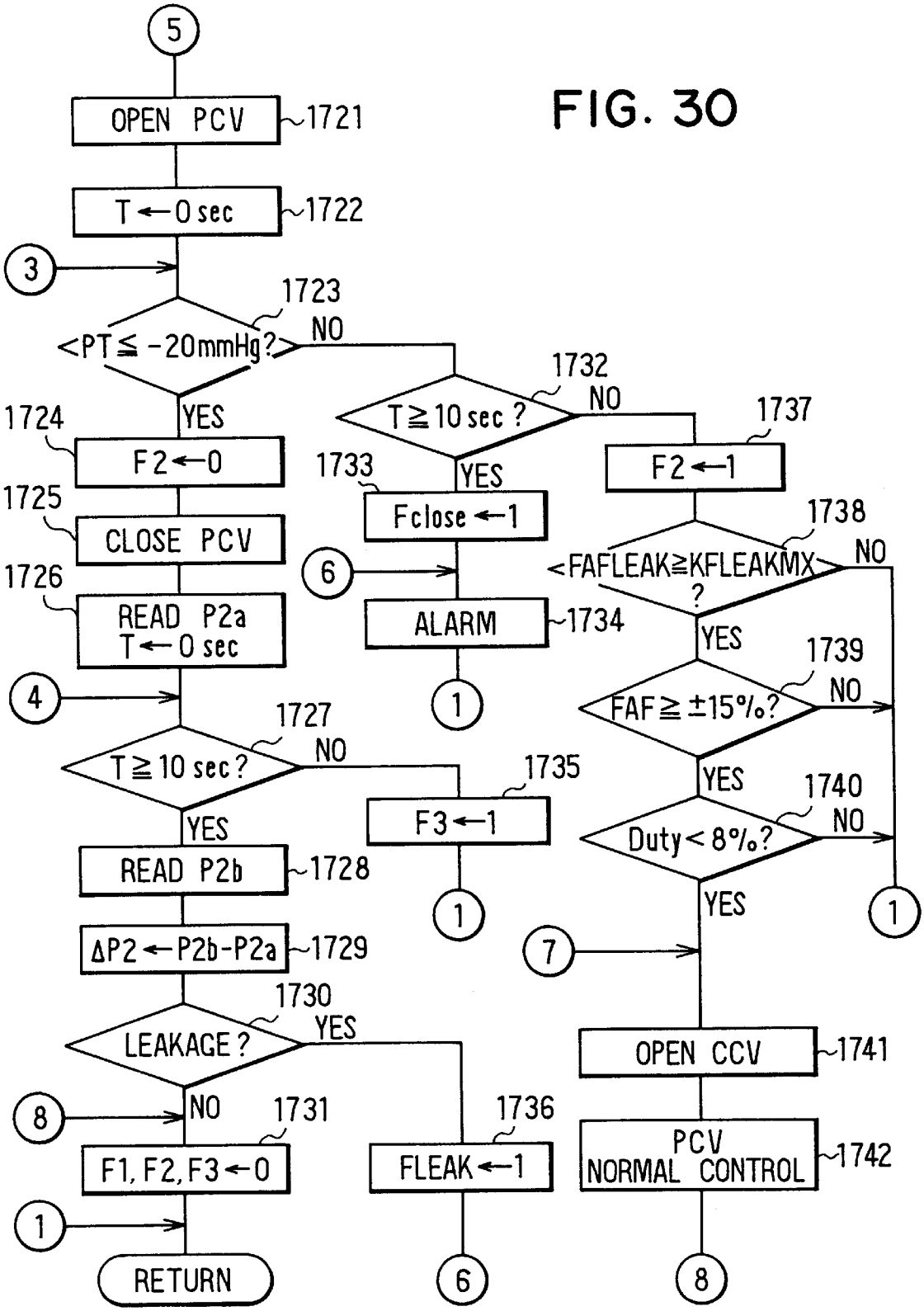
FIG. 30 is a part of the flowchart showing the abnormality diagnosis routine according to the seventh embodiment of the present invention.

An abnormality diagnosis for the gas purge passage 21 in the seventh embodiment is executed repeatedly every 256 msec according to flowcharts shown in FIGS. 29 and 30. This abnormality diagnosis routine functions as abnormality diagnosis means in the present invention.

In step 1701, it is determined whether a diagnosis execution condition is satisfied. When an engine driving condition is stable, the diagnosis execution condition is satisfied. The diagnosis execution condition is satisfied even during the idling of the engine if the engine driving condition is stable. When the diagnosis execution condition is not satisfied in step 1701, the program goes to step 1741 to prohibit the abnormality diagnosis and to fully open the canister closure valve 26, and the purge control valve 31 is brought under normal control condition in step 1742, and the program goes to step 1731 to reset the first through third flags F1, F2 and F3 to "0", and the routine ends.

When the diagnosis execution condition is satisfied in step 1701, the program goes to steps 1710 through 1712 to determine the location of the routine (to what extent the routine has finished) from the flags F1 through F3, and branches into various steps. When all flags F1 through F3 are set to "0" (when it is determined "No" in all steps 1710 through 1712), the program goes to step 1713 for a first stage.

Figures 31A, 31B, 31C:
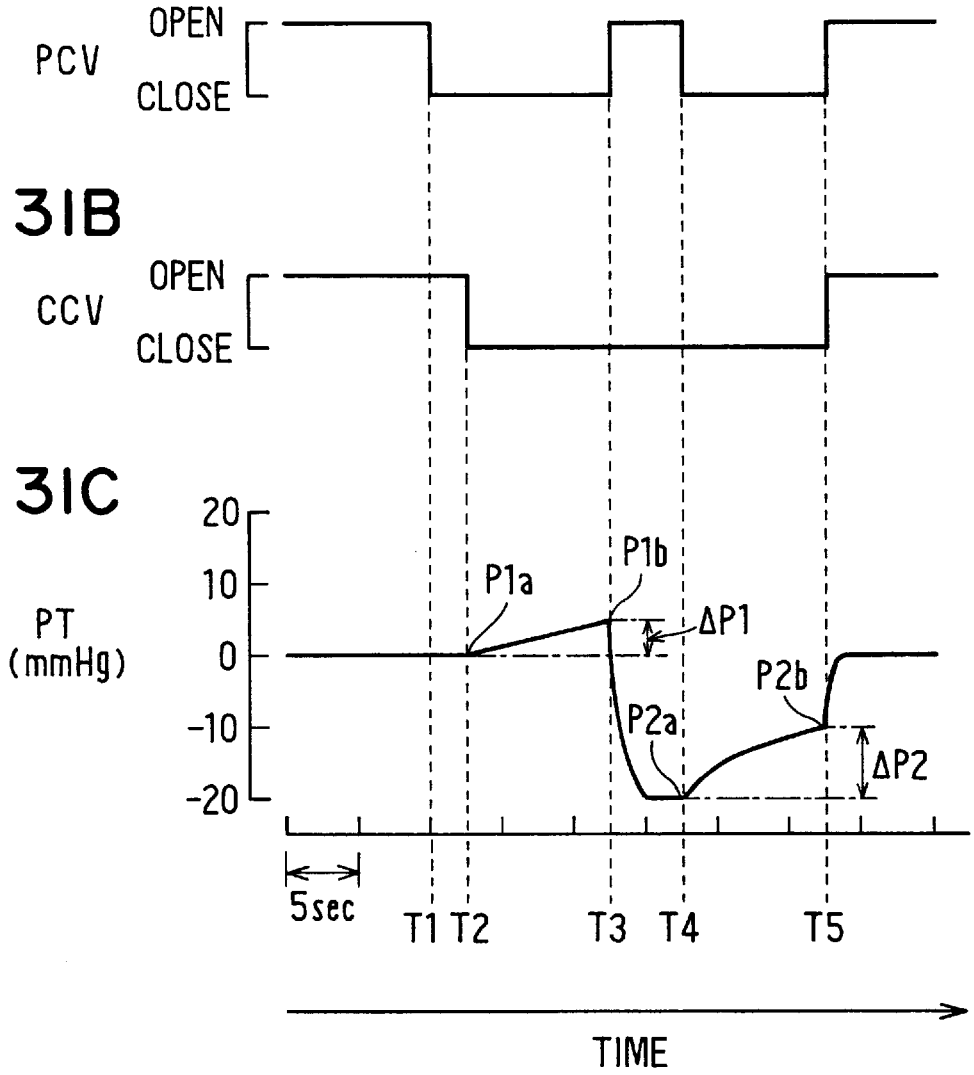
FIGS. 31A, 31B and 31C are time charts showing a relationship among operations of the purge control valve and the canister closure valve, and a fuel tank inner pressure PT according to the abnormality diagnosis routine in the seventh embodiment of the present invention.

At the first stage, the evaporated gas purge system (the evaporated gas purge passage 21) is hermetically sealed by closing the purge control valve 31 and the canister closure valve 26 in steps 1713 and 1714, respectively. Specifically, as shown in FIGS. 31A, 31B and 31C, the purge control valve 31 is fully closed at T1 while the canister closure valve 26 is opened. Accordingly, the gas purge passage 21 is held at the atmospheric pressure via the atmosphere communication pipe 25. Shortly after T1, the canister closure valve 26 is fully closed at T2 to form the hermetically sealed gas purge passage 21 held at the atmospheric pressure.

In step 1715, fuel tank inner pressure P1a at T2 in FIGS. 31A, 31B and 31C is read, and the timer T is reset and started. In step 1716, it is determined whether the counted value of the timer T is equal to or greater than 10 seconds. When T is less than 10 seconds, the first flag F1 is set to "1" in step 1717, and the program ends.

At the second stage, when this program is again executed thereafter, it is determined "Yes" in step 1710. Therefore, the processes of step 1701→step 1710→step 1716→ . . . are performed. During this period, the fuel tank inner pressure PT detected by the pressure sensor 20 increases from 0 mmHg between T2 and T3 in FIGS. 31A, 31B and 31C according to the generated amount of the evaporated gas in the fuel tank 17.

When 10 seconds have passed after T2 (when P1a is detected), P1b detected by the pressure sensor 20 is read in step 1718. In step 1719, the pressure change amount ΔP1 during the ten seconds (from T2 to T3) is calculated. In step 1720, the first flag F1 is reset to "0" to finish the second stage.

At the third stage, in step 1721, the purge control valve 31 is switched from fully closed state to fully opened state to start the control for the intake pipe negative pressure introduction, and the timer T is reset and started. The intake pipe negative pressure is introduced into the gas purge passage 21 having the atmospheric pressure by opening the purge control valve 31 (from T3 to T4 in FIGS. 31A, 31B and 31C). Accordingly, the fuel tank inner pressure PT detected by the pressure sensor 20 starts to decrease if there is no leakage in the gas purge passage 21.

In step 1723, it is determined whether PT is equal to or less than a predetermined negative pressure (for example, −20 mmHg). When PT is higher than −20 mmHg, it is determined in step 1732 whether 10 seconds have passed after the opening of the purge control valve 31. When it is before elapsing 10 seconds, the program goes to step 1737 to set the second flag F2 to "1".

It is determined in steps 1737 through 1740 whether the intake pipe negative pressure introduction to the gas purge passage 21 is being executed under stable condition. Specifically, it is determined in step 1738 whether a fuel injection amount compensation value FAFLEAK is equal to or greater than an upper limit value KFLEAKMX to know whether the introduction of the intake pipe negative pressure into the gas purge passage 21 is under stable condition. When FAFLEAK is equal to or greater than KFLEAKMX, the program goes to step 1739 to determine whether the air fuel ratio compensation coefficient FAF is not within a range between −15% and 15%. When FAF is not within a range between −15% and 15%, the program goes to step 1740 to determine whether the control value "Duty" for driving the purge control valve 31 is less than 8%.

When it is determined "Yes" in all steps 1738 through 1740, it is considered that the introduction of the intake pipe negative pressure is unstable. Therefore, the execution of the abnormality diagnosis is prohibited, and the program goes to step 1741 to open the canister closure valve 26, and the purge control valve 31 is brought under normal control condition in step 1742, and first through third flags F1, F2 and F3 are reset to "0" in step 1731, and the routine ends.

When it is determined "No" in one of steps 1738, 1739 and 1740, it is considered that the introduction of the intake pipe negative pressure is stable. Therefore, the routine ends.

If the introduction control of the intake pipe negative pressure is executed by the purge ratio PGR instead of using "Duty", step 1740 may be executed by determining whether PGR is less than 0.2%, and the abnormality diagnosis may be prohibited when PGR is less than 0.2%.

When this program is again executed thereafter, it is determined "No" in steps 1710, and is determined "Yes" in step 1711 because F2 is set to "1" in step 1737. Therefore, the processes of steps 1701 through 1711→step 1723→ . . . are repeatedly performed until step 1723 or step 1732 is determined "Yes".

When it is determined "Yes" in step 1732 before determining "Yes" in step 1723, it means that a choke may exist in the gas purge passage 21. In this case, the program goes to step 1733 to set a choke flag Fclose to "1", and it goes to step 1734 to turn on the alarm lamp 53.

When it is determined "Yes" in step 1723 before determining "Yes" in step 1732, the program goes to step 1724 to reset the second flag F2 to "0". In step 1725, the purge control valve 31 is fully closed.

In step 1726, the fuel tank inner pressure P2a, detected by the pressure sensor 20 at T4 which is immediately after sealing the gas purge passage 21 hermetically with the negative pressure, is read and memorized, and the timer T is reset and started. Accordingly, the program transfers from the third stage to the fourth stage.

According to the execution of the processes in steps 1724 through 1726, the gas purge passage 21 is hermetically sealed with negative pressure of −20 mmHg at T4 as shown in FIG. 31C.

In step 1727, it is determined whether 10 seconds have passed after reading P2a. When it is determined that T is less than 10 seconds, the program goes to step 1735 to set the third flag F3 to "1", and the routine ends. Accordingly, when this program is again executed thereafter, it is determined "No" in steps 1710 and 1711, and is determined "Yes" in step 1712, and the processes of steps 1701 through 1712→step 1727→ . . . are repeatedly performed.

When it is determined that T reaches 10 seconds in step 1727, the program goes to step 1728 to read P2b detected by the pressure sensor 20 at T6 in FIG. 31C. In step 1729, pressure change amount ΔP2 (=P2b−P2a) for the ten minute period after sealing the gas purge passage 21 is calculated.

In step 1730, it is determined based on the leakage determination condition shown in the following inequality whether the leakage exists:

$$\Delta P2>\gamma\cdot\Delta P1+\epsilon$$

In the above inequality, γ represents a compensation coefficient to compensate a difference of the fuel evaporation amount caused by the difference between the atmospheric pressure and the negative pressure. ϵ represents a compensation coefficient to compensate a detection accuracy of the pressure sensor 20, a pressure leakage at the canister closure valve 26, or the like.

When the above inequality is satisfied, it is determined in step 1730 that the leakage exists.

If there is a cause for the leakage in the hermetically sealed gas purge passage 21, a flowing out to the atmosphere from the gas purge passage 21 occurs under the positive pressure, and a flowing into the gas purge passage 21 from the atmosphere occurs under the negative pressure. Therefore, ΔP2 becomes greater than ΔP1 because (the pressure change amount under the atmospheric pressure ΔP1)=(generated amount of the evaporated gas in the fuel tank 17)−(an outflow to the atmosphere from the gas purge passage 21), and (the pressure change amount under the negative pressure ΔP2)=(generated amount of the evaporated gas in the fuel tank 17)+(an inflow to the gas purge passage 21 from the atmosphere). The above inequality is derived from such relationships.

When it is determined "Yes" ("the leakage exists in the gas purge passage 21") in step 1730, it means that there may be a cause of the leakage somewhere in the gas purge passage 21. Therefore, the program goes to step 1736 to set the leakage flag Fleak to "1", and the alarm lamp 53 is turned on in step 1734.

When it is determined "No" ("no leakage exists in the gas purge passage 21") in step 1730, the program goes to step 1731 to reset first through third flags F1 through F3 to "0", and the routine ends.

The anticipated compensation coefficient FLEAK used in step 1505 in FIG. 28 is calculated by one of the following methods:

(First exemplary method for FLEAK)

Figures 32, 33:
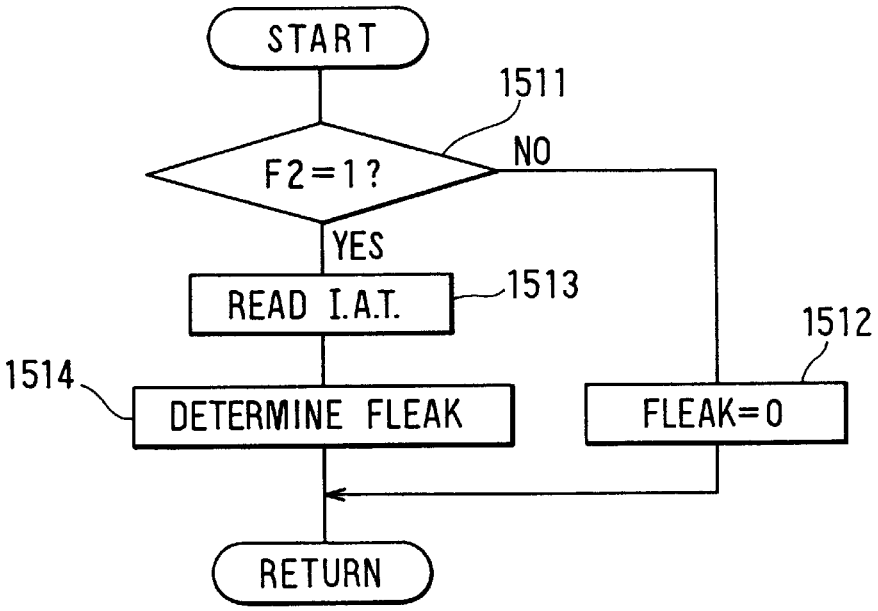
FIG. 32 is a flowchart showing an anticipated compensation coefficient (FLEAK) calculation routine according to a first exemplary method for determining FLEAK in the seventh embodiment of the present invention.
FIG. 33 is a table to determine FLEAK according to an intake air temperature in the first exemplary method for determining FLEAK in the seventh embodiment of the present invention.
Figures 34A, 34B, 34C, 34D, 34E:
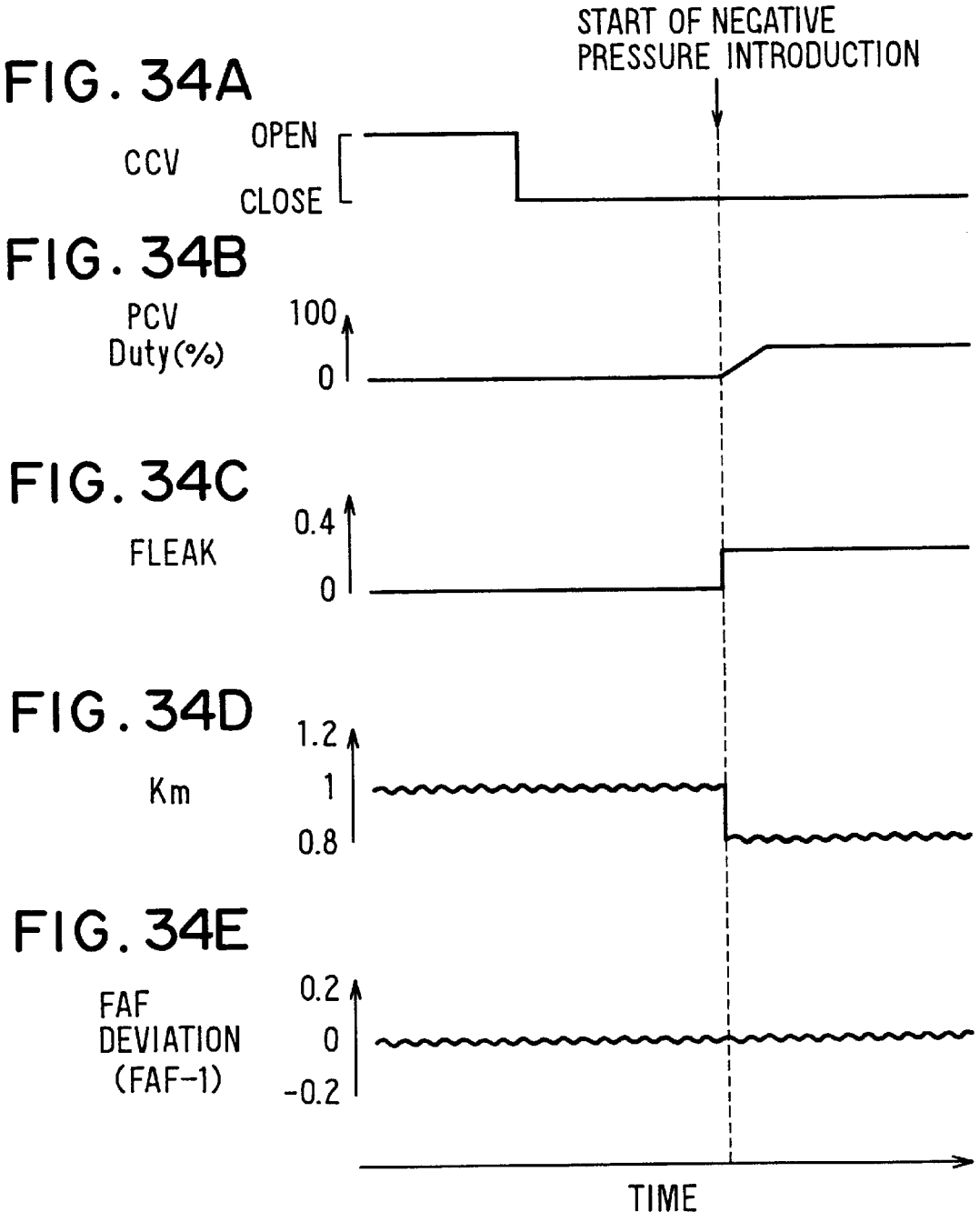
FIGS. 34A through 34E are time charts showing a relationship among an operation of the canister closure valve, Duty (%) of the purge control valve, FLEAK, Km and FAF deviation (FAF−1) according to the anticipated compensation using FLEAK determined by the first exemplary method for determining FLEAK in the seventh embodiment of the present invention.

According to a first example to obtain FLEAK in the seventh embodiment, the anticipated compensation coefficient FLEAK is calculated according to a flowchart shown in FIG. 32 as an interruption handling routine every 4 msec.

In step 1511, it is determined whether the second flag F2 is "1" which means that it is under the intake pipe negative pressure introduction. When F2 is equal to "0" (it is not under the intake pipe negative pressure introduction), the anticipated compensation is not necessary. Therefore, FLEAK is kept "0" in step 1512, and the FLEAK calculation routine ends.

When F2 is equal to "1" (it is under the intake pipe negative pressure introduction) in step 1511, an intake air temperature detected by the intake air temperature sensor 51 is read in step 1513. Instep 1514, FLEAK is determined from the map shown in FIG. 33 according to the intake air temperature.

FLEAK is determined according to the intake air temperature because an air fuel ratio deviation is caused, when the intake pipe negative pressure is introduced, by changes in the atmospheric temperature and the evaporated gas concentration in the fuel tank 17 caused by such intake air temperature change.

When the intake pipe negative pressure introduction is finished (when F2=0), FLEAK is set to "0" in step 1512, and the FLEAK calculation routine ends.

According to the air fuel ratio compensation utilizing FLEAK obtained by the above first exemplary method, as shown in FIGS. 34A through 34E, the canister closure valve 26 is fully closed, and the purge control valve 31 is opened, and the intake pipe negative pressure introduction into the gas purge passage 21 is started, and FLEAK is determined according to the intake air temperature, and the air fuel ratio compensation coefficient Km is offset by FLEAK to lean, when the abnormality diagnosis execution condition is satisfied. Accordingly, the fuel injection amount is compensated by FLEAK to lean when the intake pipe negative pressure is introduced, and an air fuel ratio deviation toward rich, caused by the evaporated gas purge from the fuel tank 17, is prevented. As a result, the air fuel deviation toward rich is reduced even when the abnormality diagnosis of the gas purge passage 21 is executed during the idling of the engine. Accordingly, the abnormality in the gas purge passage 21 is detected in an early stage without deteriorating the emission and the drivability.

As a parameter to determine FLEAK, an outside air temperature or a cooling water temperature may be used in lieu of the intake air temperature. Two or more of the intake air temperature, the outside air temperature, and the cooling water temperature may also be used in lieu of the intake air temperature.

FLEAK may be constant (for example, an average value) which does not change.

(Second exemplary method for FLEAK)

Figures 35, 36B:
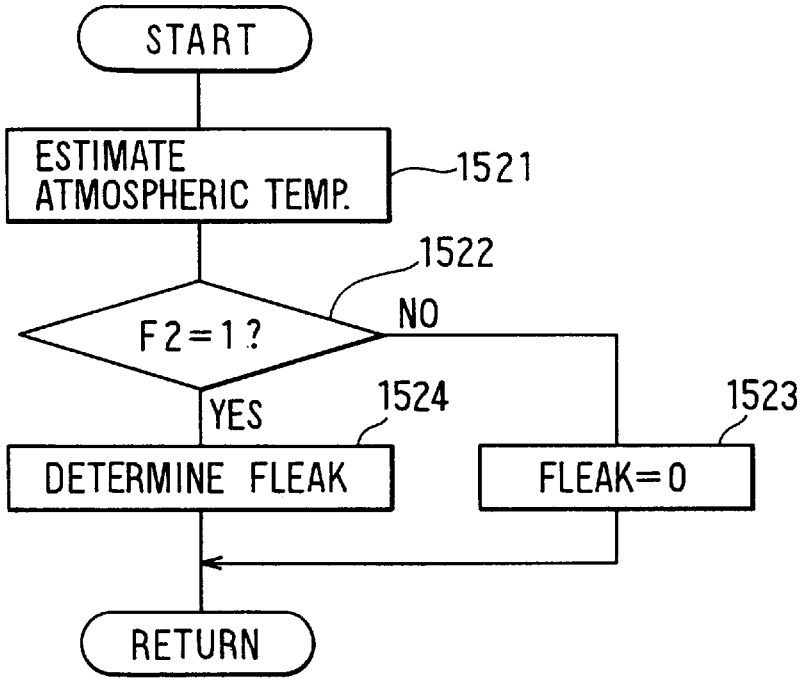
FIG. 35 is a flowchart showing an anticipated compensation coefficient (FLEAK) calculation routine according to a second exemplary method for determining FLEAK in the seventh embodiment of the present invention.
FIG. 36B is a table to determine a fuel temperature increase ΔT2 according to an average vehicle speed in the second exemplary method for determining FLEAK in the seventh embodiment of the present invention.

According to a second exemplary method to obtain FLEAK in the seventh embodiment, FLEAK is determined by an estimated atmospheric temperature in the fuel tank 17 according to a flowchart shown in FIG. 35 as an interruption handling routine every 4 msec.

In step 1521, the atmospheric temperature in the fuel tank 17 is estimated from the following equation:

$$\text{The atmospheric temperature}=To+\Delta T$$

In this equation, To represents an atmospheric temperature, which is estimated (presumed) from at least one of the intake air temperature, outside air temperature, cooling water temperature, and the lowest intake air temperature in the past at the start of the engine, in the fuel tank 17 at the start of the engine. The atmospheric temperature at the engine start To is calculated at the engine start, and is memorized in RAM 42. After memorizing To, such memorized To is used in this FLEAK calculation routine.

ΔT represents a temperature increase in the fuel tank 17 after the engine start. The increased temperature ΔT is calculated by one of the following methods ① and ②:

①: A fuel temperature increase ΔT1 is determined by a table shown in FIG. 36A according to an elapsed time after the engine start. A fuel temperature increase ΔT2 is determined by a table shown in FIG. 36B according to an average vehicle speed. Then, ΔT is calculated by adding ΔT2 to ΔT1 (ΔT=ΔT1+ΔT2). In FIG. 36B, the average vehicle speed may be replaced with an average engine speed, average load, or any other data represent the vehicle running conditions. The average vehicle speed may also be replaced with two or more of those parameters.

②: A fuel temperature increase ΔT3 is determined by a table shown in FIG. 37 according to a current vehicle speed and a continued time of such speed. Then, ΔT is calculated by summing ΔT3 (ΔT=ΣΔT3) after the engine start. In FIG. 37, the current vehicle speed may be replaced with the average engine speed, average load, or any other data represent the vehicle running conditions.

After the atmospheric temperature estimation in step 1521, it is determined whether F2 is equal to "1" in step 1522. When it is determined F2 is equal to 1 in step 1522, FLEAK is determined from a table shown in FIG. 38 according to the estimated atmospheric temperature in step 1524, and the anticipated compensation is executed with FLEAK. When the intake pipe negative pressure introduction is finished (when F2=0), FLEAK is set to "0" in step 1523 to terminate the anticipated compensation.

The process in step 1521 functions as atmospheric temperature estimation means in the present invention.

(Third exemplary method for FLEAK)

According to a third example to obtain FLEAK in the seventh embodiment, the anticipated compensation coefficient FLEAK is determined by a table shown in FIG. 39 according to an evaporated gas concentration learned value when the intake pipe negative pressure is introduced. The evaporated gas concentration learned value is obtained by learning the evaporated gas concentration obtained in the evaporated gas concentration detection routine shown in FIG. 10 in the second embodiment of the present invention.

(Fourth exemplary method for FLEAK)

According to a fourth example to obtain FLEAK in the seventh embodiment, the anticipated compensation coefficient FLEAK is determined by compensating FLEAK, obtained by one of the above first through third exemplary methods, by a deviation (FAF−1) of the air fuel ratio feedback compensation coefficient FAF during the intake pipe negative pressure introduction according to the following equation:

$$FLEAK=FLEAK-(FAF-1)$$

Figures 40A, 40B, 40C, 40D:
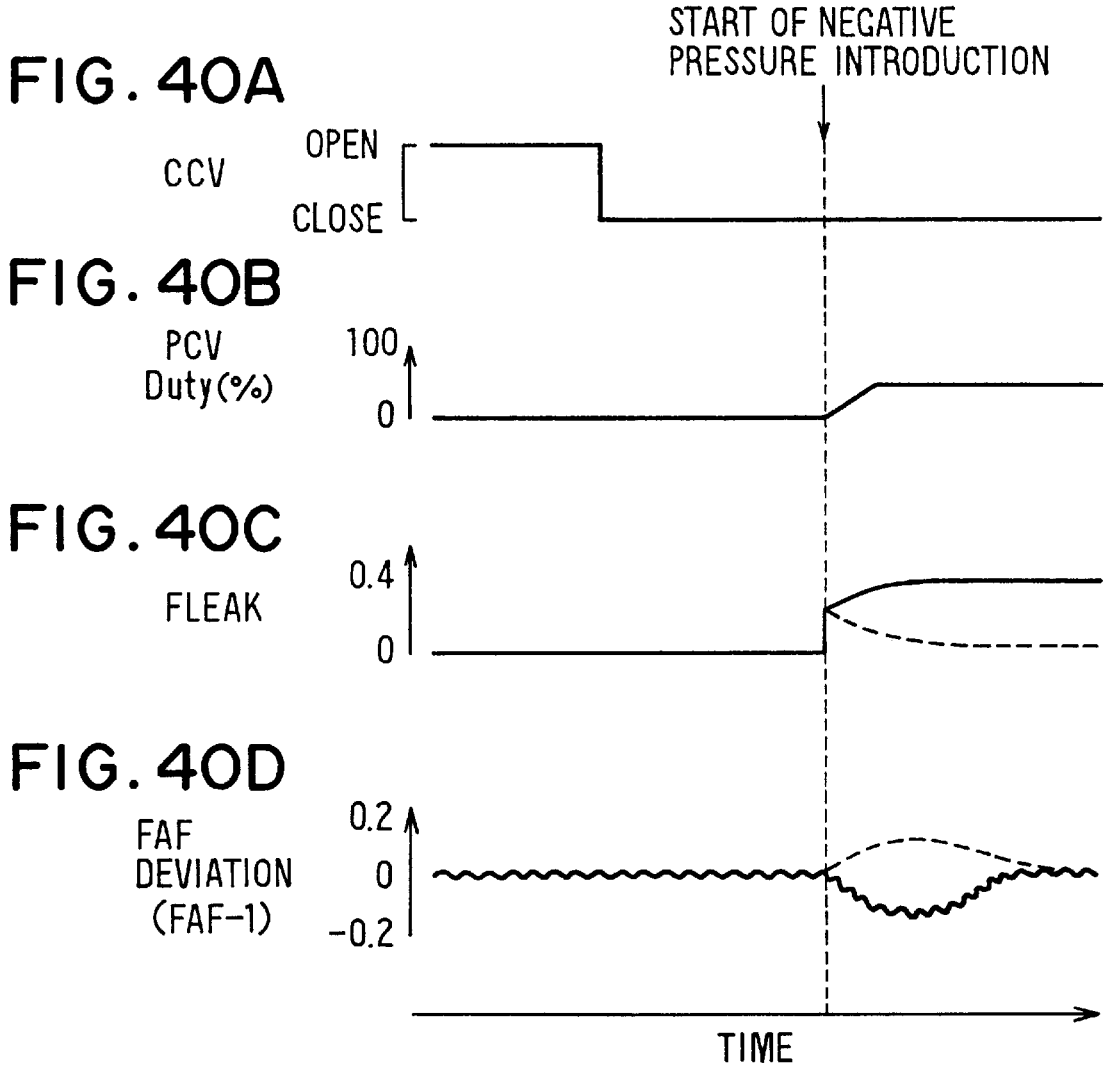
FIGS. 40A through 40D are time charts showing a relationship among an operation of the canister closure valve, Duty (%) of the purge control valve, FLEAK, and FAF deviation (FAF−1) according to the anticipated compensation using FLEAK determined by a fourth exemplary method for determining FLEAK in the seventh embodiment of the present invention.
Figures 41A, 41B, 41C, 41D:
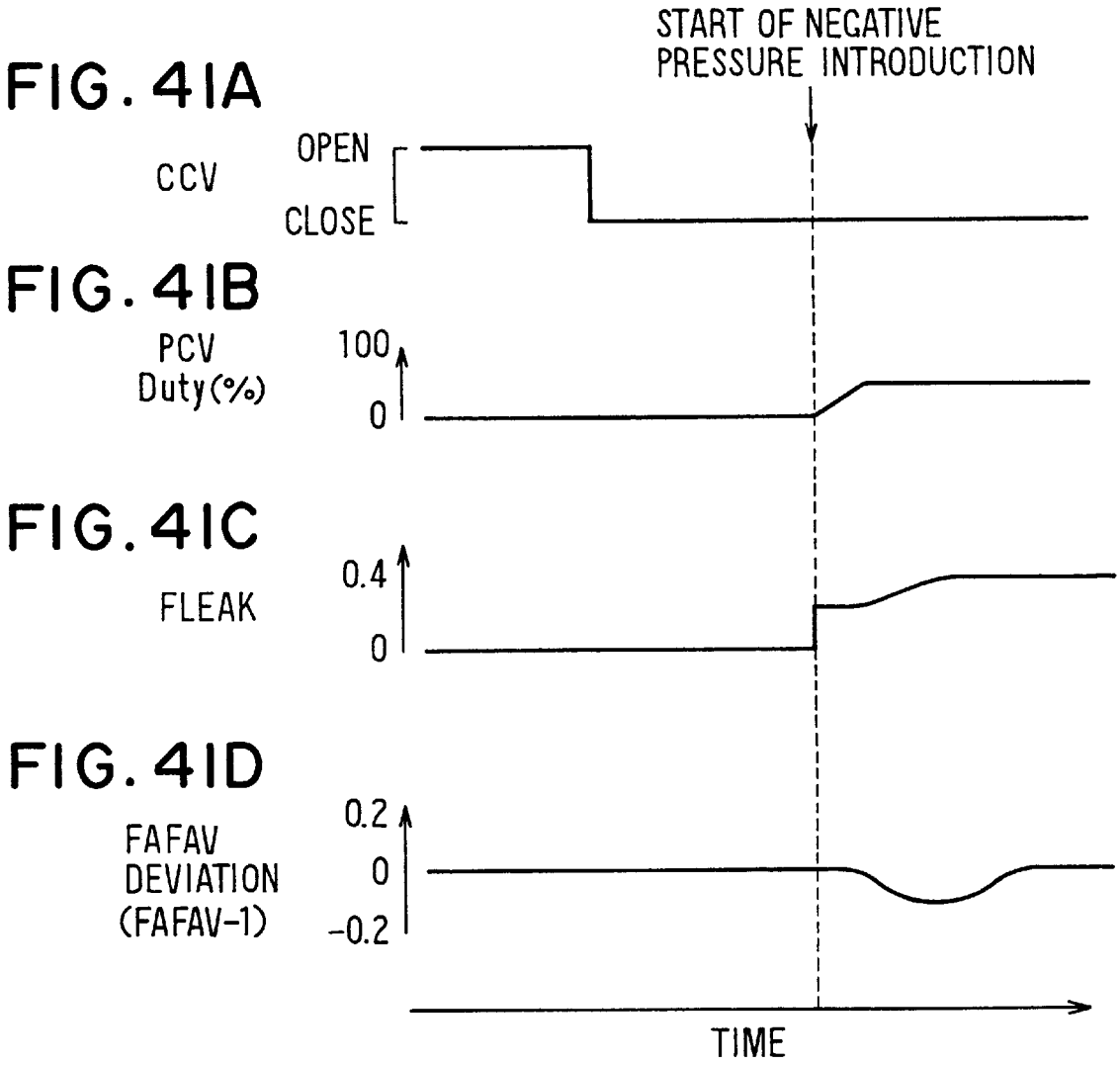
FIGS. 41A through 41D are time charts showing a relationship among an operation of the canister closure valve, Duty (%) of the purge control valve, FLEAK, and FAFAV deviation (FAFAV−1) according to the anticipated compensation using FLEAK determined by a fifth exemplary method for determining FLEAK in the seventh embodiment of the present invention.

An example of the fuel injection control using FLEAK obtained by the above equation will be explained based on FIGS. 40A through 40D. At the same time of the start of the intake pipe negative pressure introduction, FLEAK changes with a step as shown in FIG. 40C, and thereafter, FLEAK is compensated according to the FAF diviation (FAF−1). Accordingly, even if the air fuel ratio starts to be deviated during the intake pipe negative pressure introduction (during the execution of the anticipated compensation), FLEAK is compensated according to such air fuel ratio deviation, and the air fuel ratio deviation is compensated.

(Fifth exemplary method for FLEAK)

According to a fifth example to obtain FLEAK in the seventh embodiment, the anticipated compensation coefficient FLEAK is determined by compensating FLEAK by substituting the FAF deviation (FAF−1) in the fourth exemplary method with a FAFAV deviation (FAFAV−1) of the equalized (average) air fuel ratio compensation coefficient FAFAV calcurated in step 146 in the second embodiment, as follows:

$$FLEAK=FLEAK-(FAFAV-1)$$

According to the fifth exemplary method for FLEAK, even if the air fuel ratio starts to be deviated during the intake pipe negative pressure introduction, FLEAK is compensated in a similar way to the fourth exemplary method for FLEAK according to such air fuel ratio deviation as shown in FIGS. 41A through 41D, and the air fuel ratio deviation is compensated.

(Eighth embodiment)

Figure 42:
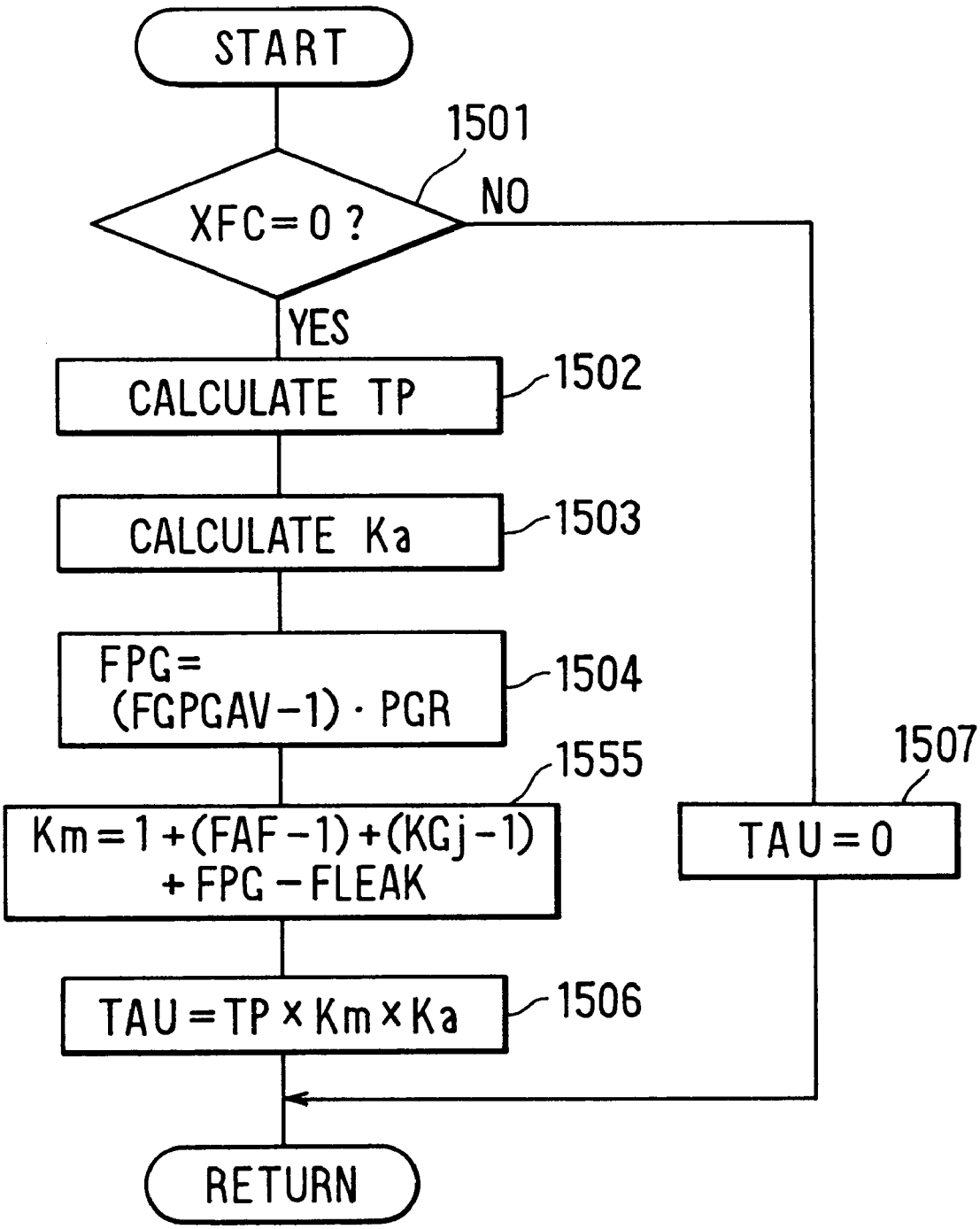
FIG. 42 is a flowchart showing a fuel injection amount control routine according to an eighth embodiment of the present invention.
Figures 43A, 43B, 43C, 43D:
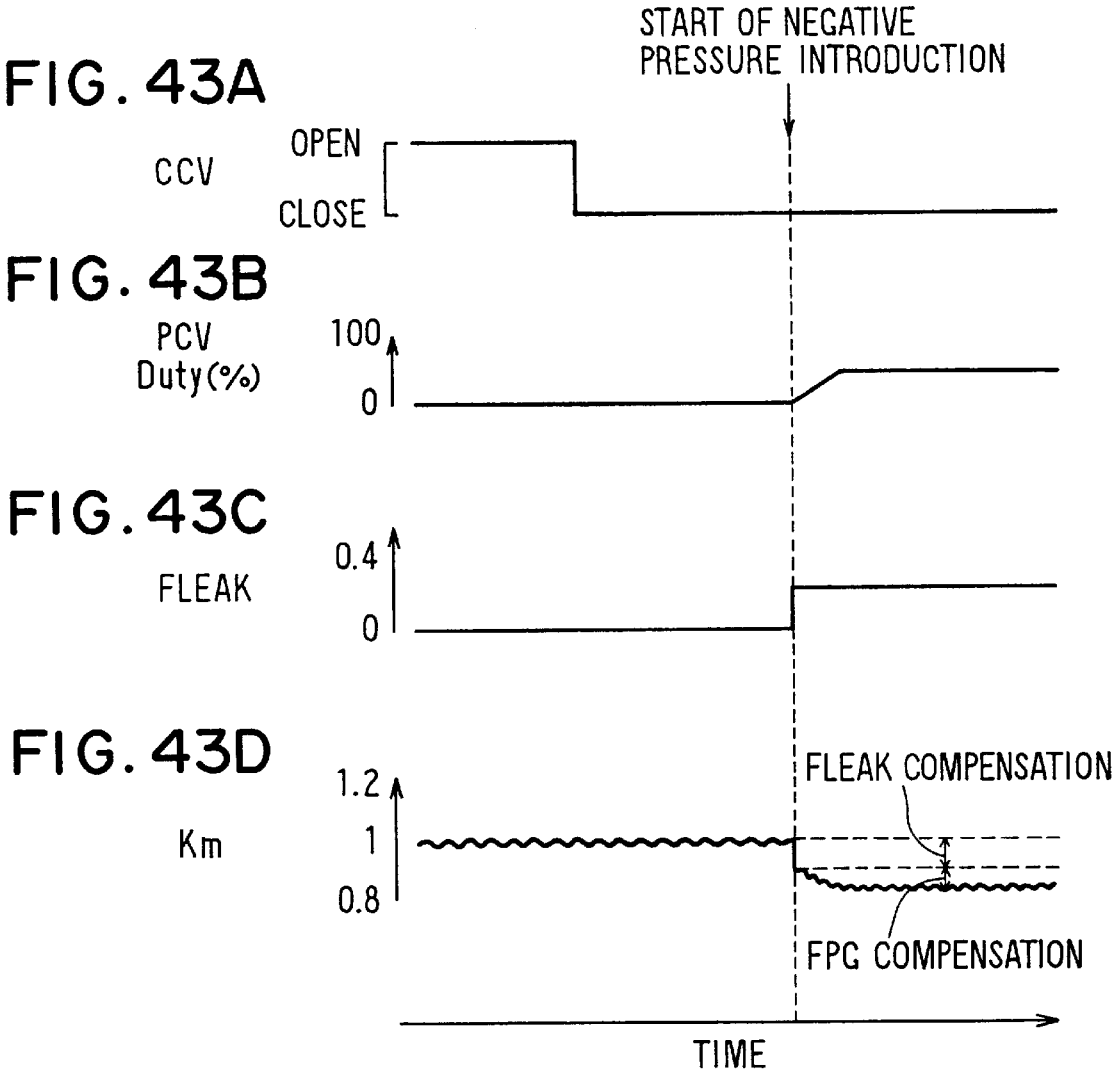
FIGS. 43A through 43D are time charts showing a relationship among an operation of the canister closure valve, Duty (%) of the purge control valve, FLEAK, and Km according to the eighth embodiment of the present invention.

An eighth embodiment of the present invention will be explained according to FIGS. 42 through 43D. The fuel injection amount TAU is calculated according to a fuel injection amount control routine shown in FIG. 42. Differences between the fuel injection amount control routine in the seventh embodiment (FIG. 28) and the fuel injection amount control routine in the eighth embodiment (FIG. 42) are steps 1504 and 1555 in FIGS. 42. Explanations in steps 1501, 1502 1503, 1506 and 1507 will be omitted in the eighth embodiment because those steps are the same as the ones in the seventh embodiment.

In step 1504, a purge compensation coefficient FPG is calculated from the evaporated gas concentration FGPGAV calculated in the evaporated gas concentration detection routine (FIG. 10) and the final purge ratio PGR calculated in the purge ratio control routine (FIG. 7) according to the following equation:

$$FPG=(FGPGAV-1)\cdot PGR$$

The purge compensation coefficient FPG means a fuel amount replenished from the canister 23 by executing the purge under the condition determined by the purge ratio control. A fuel amount corresponding to FPG is reduced (compensated) from the basic injection amount TP.

(FGPGAV−1) in the above equation corresponds to "a air fuel ratio feedback compensation amount deviation per 1% of the purge ratio" in the present invention. The purge compensation coefficient FPG corresponds to an evaporated gas concentration compensation amount in the present invention. Therefore, the process in step 1504 functions as evaporated gas concentration compensation amount calculating means in the present invention.

In step 1555, the air fuel ratio compensation coefficient Km is calculated from the following equation according to the air fuel ratio feedback compensation coefficient FAF, the purge compensation coefficient FPG, the air fuel ratio learned value KGj, and the anticipated compensation coefficient FLEAK:

$$Km=1+(FAF-1)+(KGj-1)+FPG-FLEAK$$

According to the eighth embodiment of the present invention, the compensation by FPG as well as the compensation by FLEAK is executed after the start of the intake pipe negative pressure introduction as shown in FIGS. 43A through 43D. Accordingly, the influence of the evaporated gas purge from the canister 23 after the start of the negative pressure introduction is taken into consideration. Therefore, the deviation of the air fuel ratio toward rich is effectively suppressed.

(Ninth embodiment)

Although the start of the anticipated compensation is synchronized with the start of the intake pipe negative pressure introduction according to the seventh and eighth embodiments, an anticipated compensation in a ninth embodiment of the present invention is started with a certain delay from the start of the intake pipe negative pressure introduction as shown in FIGS. 44 through 46C taking into consideration that there is a delay for the evaporated gas in the fuel tank 17 to reach the intake pipe 12 after the start of the intake pipe negative pressure introduction.

Figures 44, 45:
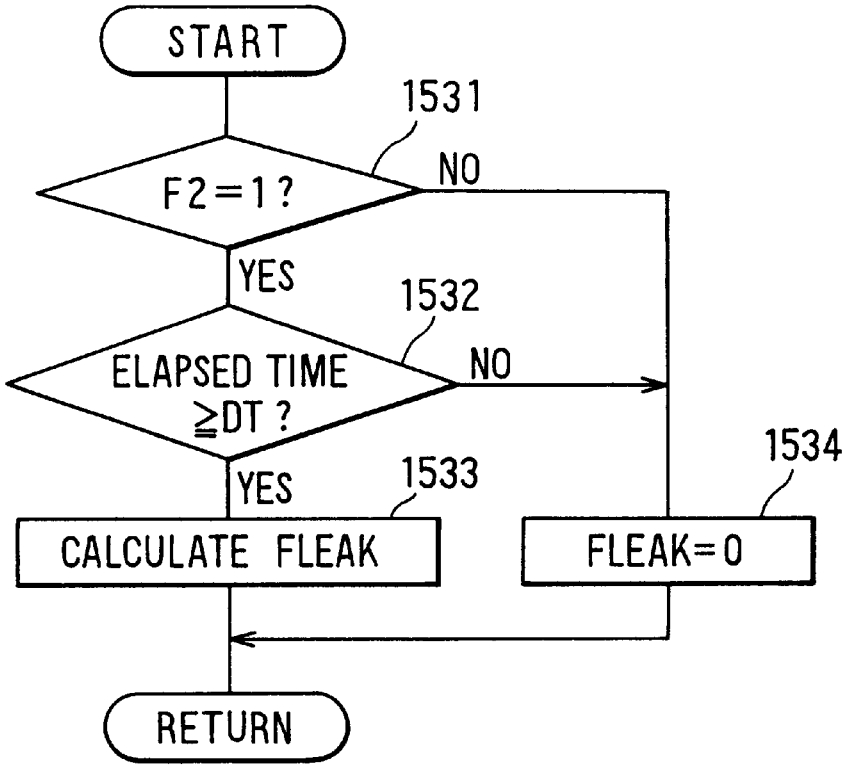
FIG. 44 is a flowchart showing an anticipated compensation coefficient (FLEAK) calculation routine according to a ninth embodiment of the present invention.
FIG. 45 is a table to determine a delayed time period, which is used in the FLEAK calculation routine in FIG. 44, based on the evaporated gas concentration learned value according to the ninth embodiment of the present invention.

The anticipated compensation coefficient FLEAK in the ninth embodiment is calculated according to a FLEAK calculation routine shown in FIG. 44.

When it is determined that the intake pipe negative pressure introduction is started (F2=1) in step 1531, it is determined whether a certain delayed time period DT has passed after the start of the intake pipe negative pressure introduction in step 1532. When it is determined that DT has not passed after the start of the intake pipe negative pressure introduction in step 1532, FLEAK is kept to "0" in step 1534, and the anticipated compensation is not started.

Although the delayed time period may be constant, it is determined from a table shown in FIG. 45 according to a current evaporated gas concentration learned value in the ninth embodiment. The evaporated gas concentration learned value in FIG. 45 may be replaced with one or more of the intake air temperature, the outside air temperature, the cooling water temperature, and the atmospheric temperature in the fuel tank 17.

When the delayed time period DT has passed after the start of the intake pipe negative pressure introduction, the program goes to step 1533 to calculate FLEAK according to one of the FLEAK calculation methods described in the seventh embodiment of the present invention to start the anticipated compensation.

When the intake pipe negative pressure introduction is terminated (F2=0), FLEAK is set to "0" in step 1534 to terminate the anticipated compensation.

According to the ninth embodiment of the present invention, the anticipated compensation is started at the same timing that the evaporated gas in the fuel tank 17 reaches the intake pipe 12 because the anticipated compensation is started with a certain delay (DT) from the start of the intake pipe negative pressure introduction as shown by the solid line in FIG. 46C. Therefore, the accuracy of the anticipated compensation is further improved.

Although the count of DT is started from the start of the intake pipe negative pressure introduction (when the purge control valve 31 is started to be opened) in the ninth embodiment, it may be started when the control value Duty of the purge control valve 31 exceeds a predetermined value (when an opening degree of the purge control valve 31 exceeds a predetermined opening degree).

Instead of delaying the anticipated compensation, an anticipated compensation with a moderate increase of FLEAK after the start of the intake pipe negative pressure introduction as shown by solid lines X and Y in FIG. 46C may by executed. In this case, the start of the moderate increase of FLEAK may be (1) at the same timing of the start of the intake pipe negative pressure introduction (when the purge control valve 31 starts to be opened), (2) when the control value Duty of the purge control valve 31 exceeds a predetermined value, or (3) after elapsing a predetermined delayed time period.

Although the moderate increase pattern (the increase rate of FLEAK) may be constant, it may be set according to one or more of the evaporated gas concentration learned value, the intake air temperature, the outside air temperature, the cooling water temperature, and the atmospheric temperature in the fuel tank 17.

(Tenth embodiment)

The anticipated compensations for the fuel injection amount during the intake pipe negative pressure introduction are performed in the seventh through ninth embodiments. According to a tenth embodiment, however, the influence of the evaporated gas purge from the fuel tank 17 is reduced by increasing the intake air amount with an increased engine speed NE prior to or at the intake pipe negative pressure introduction into the gas purge passage 21 at the time of the execution of the abnormality diagnosis.

An engine speed increase control in the abnormality diagnosis in the tenth embodiment is executed according to a flowchart shown in FIG. 47 as an interruption handling routine every 4 msec.

In step 1801, it is determined whether the abnormality diagnosis execution condition is satisfied. When the abnormality diagnosis execution condition is not satisfied in step 1801, the engine speed increase control routine ends.

Figures 48, 49A, 49B, 49C, 50:
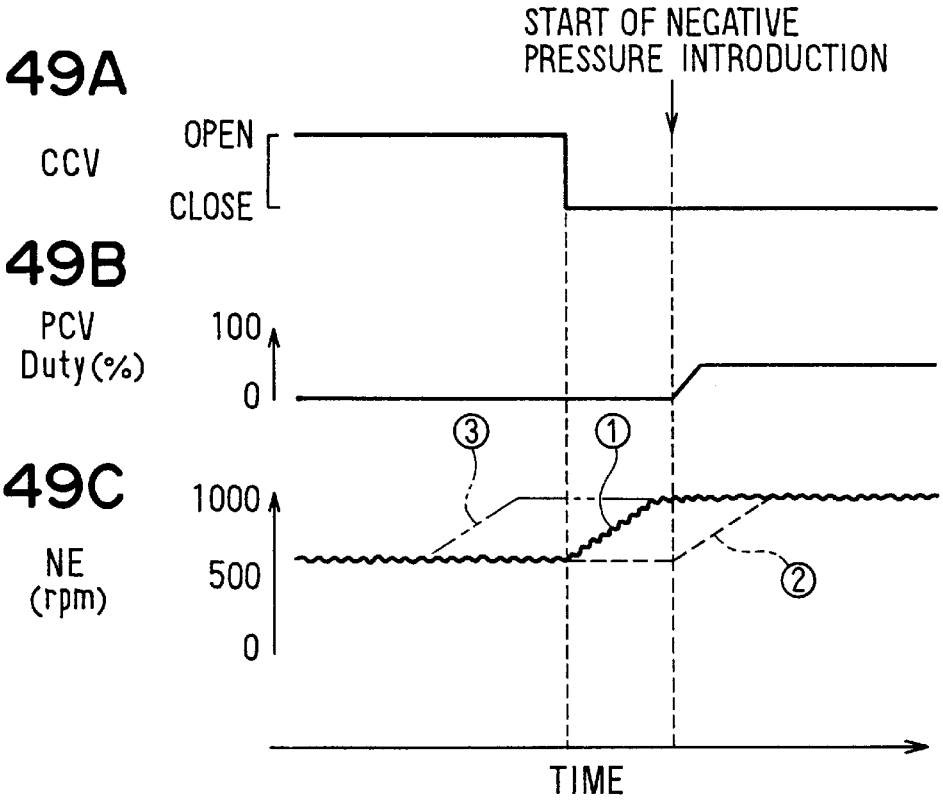
FIG. 48 is a table to determine the increased amount of NE based on the evaporated gas concentration learned value according to the tenth embodiment of the present invention.
FIGS. 49A through 49C are time charts showing a relationship among an operation of the canister closure valve, Duty (%) of the purge control valve, and the engine speed NE according to the tenth embodiment of the present invention.
FIG. 50 is a table to determine a compensation amount of an engine speed increased amount CANE according to a deviation (FAF−1) of an air fuel ratio feedback compensation coefficient FAF according to the tenth embodiment of the present invention.

When the abnormality diagnosis execution condition is satisfied in step 1801, it is determined whether it is timely to increase NE in step 1802. The timing of increasing NE may be one of ① when the canister closure valve 26 is closed, ② when the purge control valve 31 is opened, and ③ prior to closing the canister closure valve 26, as shown in FIGS. 49A through 49C. In case of the above ③, NE is increased after the abnormality diagnosis execution condition is satisfied, and the canister closure valve 26 is closed thereafter.

The engine speed increase control routine ends when it is determined that it is not timely to increase NE in step 1802. When it is determined that it is timely to increase NE in step 1802, NE is increased instep 1803. Although the increased amount of NE may be constant, it is determined from a table shown in FIG. 48 according to the evaporated gas concentration learned value in this tenth embodiment.

The the evaporated gas concentration learned value in FIG. 48 may be replaced with one or more of the intake air temperature, the outside air temperature, the cooling water temperature, and the atmospheric temperature in the fuel tank 17. The engine speed increase control routine shown in FIG. 47 functions as engine speed increase control means in the present invention.

According to the tenth embodiment, the influence of the evaporated gas purge from the fuel tank 17 is reduced, and the air fuel deviation toward rich is reduced even when the abnormality diagnosis of the gas purge passage 21 is executed during the idling of the engine. Accordingly, the abnormality in the gas purge passage 21 is detected in an early stage without deteriorating the emission and the drivability.

In the tenth embodiment, a compensation amount of an engine speed increased amount CANE may be used to compensate the engine speed increased amount. The compensation amount of an engine speed increased amount CANE may be determined from a table shown in FIG. 50 according to the FAF deviation (FAF−1) during the intake pipe negative pressure introduction. Accordingly, the air fuel ratio deviation during the intake pipe negative pressure introduction is compensated accurately. In FIG. 50, the FAF deviation (FAF−1) may be replaced with the FAFAV deviation (FAFAV−1).

(Eleventh embodiment)

An eleventh embodiment of the present invention performs a combination of the anticapated compensation described in the seventh through ninth embodiments and the tenth embodiment of the present invention to prevent from the air fuel ratio deviation during the intake pipe negative pressure introduction as follows.

FIRST COMBINATION EXAMPLE

In a first combination example of the eleventh embodiment, the engine speed NE is increased after the execution of the anticipated compensation. In this case, the increased amount of NE may be determined by the same method described in the tenth embodiment. Alternatively, it may be determined according to the FAF deviation (FAF−1) or the FAFAV deviation (FAFAV−1).

SECOND COMBINATION EXAMPLE

Figures 51A, 51B, 51C, 51D, 51E:
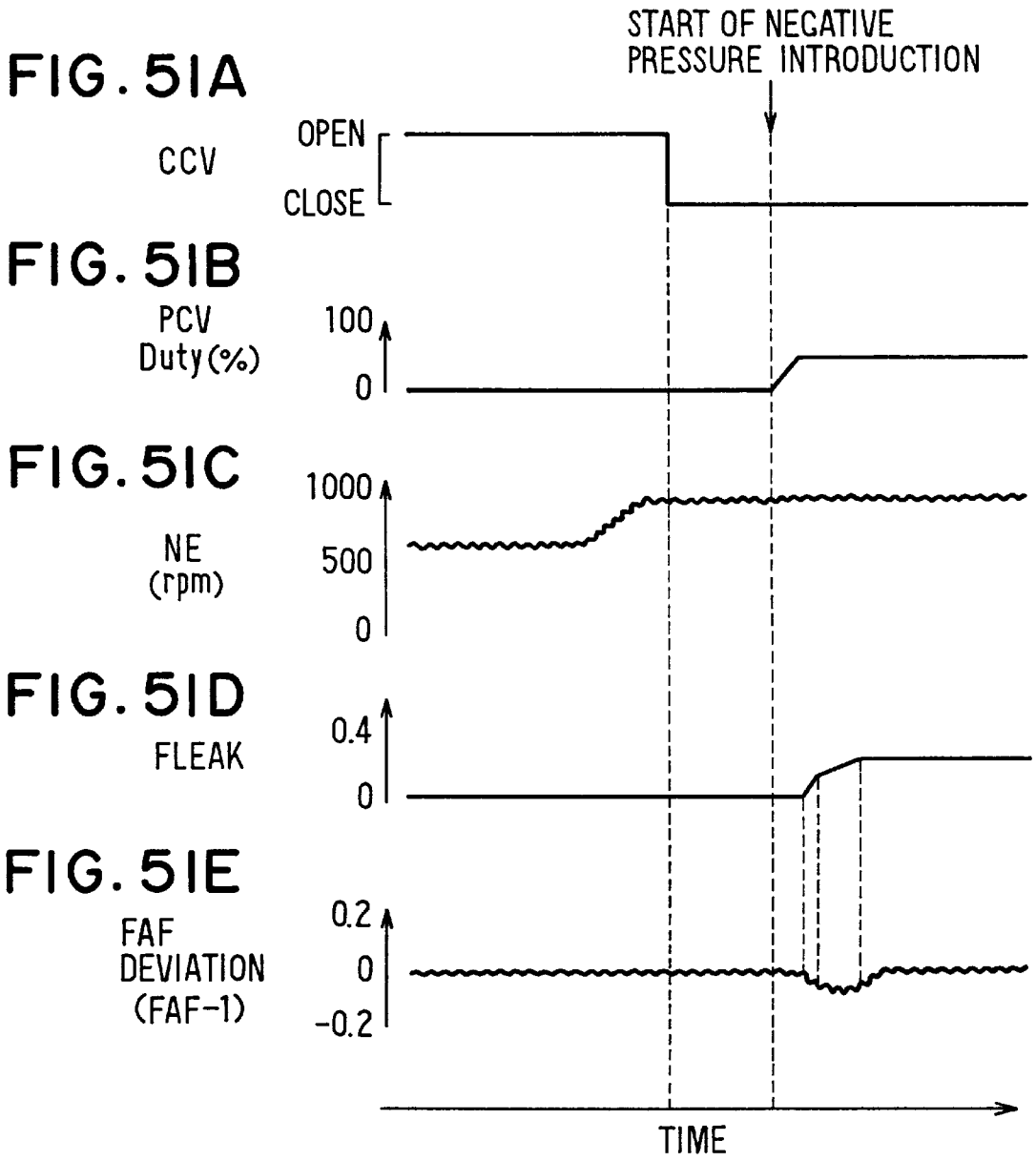
FIGS. 51A through 51E are time charts showing a relationship among an operation of the canister closure valve, Duty (%) of the purge control valve, the engine speed NE, the anticipated compensation coefficient FLEAK, and the FAF deviation (FAF−1) according to a second combination example of an eleventh embodiment of the present invention.

In a second combination example of the eleventh embodiment, the engine speed NE is increased prior to the execution of the anticipated compensation. The second combination example of the eleventh embodiment is shown in FIGS. 51A through 51E. As shown in FIGS. 51A through 51E, the engine speed NE is increased before closing of the canister closure valve 26 (FIG. 51C), and the anticipated compensation is executed according to the deviation (FAF−1) of the air fuel ratio feedback compensation coefficient FAF after starting the intake pipe negative pressure introduction (FIGS. 51D and 51E).

In this case, the anticipated compensation coefficient FLEAK may be determined by the same method described in one of the seventh through ninth embodiments. Alternatively, it may be determined according to the FAF deviation (FAF−1) or the FAFAV deviation (FAFAV−1).

THIRD COMBINATION EXAMPLE

In a third combination example of the eleventh embodiment, the engine speed NE is increased prior to the execution of the anticipated compensation, and the increased amount of NE is determined according to the FAF deviation (FAF−1) or the FAFAV deviation (FAFAV−1).

FOURTH COMBINATION EXAMPLE

In a fourth combination example of the eleventh embodiment, the increase of the engine speed NE and the anticipated compensation are executed at the start of the intake pipe negative pressure introduction simultaneously. In this case, the increased amount of NE and the anticipated compensation coefficient FLEAK may be compensated during the intake pipe negative pressure introduction according to the FAF deviation (FAF−1) or the FAFAV deviation (FAFAV−1).

According to seventh through eleventh embodiments of the present invention, the abnormality diagnosis, the anticipated compensation, and the engine speed increasing are executed when the abnormality diagnosis execution condition is satisfied (when the engine condition is stable) regardless of whether it is running or idling. However, the intake air amount is large and the influence of the evaporated gas purge is small while the vehicle is running. Therefore, the anticipated compensation and the engine speed increase may be executed only at the abnormality diagnosis during the idling of the engine, and only the normal purge compensation may be executed at the abnormality diagnosis while the vehicle is running without executing the anticipated compensation or the engine speed increase.

It is also possible to apply the seventh through eleventh embodiments to the first through sixth embodiments. In those cases, the deviation of the air fuel ratio is reduced at the leakage diagnosis during the idling of the engine. The leakage diagnosis applicable to the seventh through eleventh embodiments may not only the one which is disclosed in the seventh through eleventh embodiments, but also other leakage diagnosis methods.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure chance amount and an introduced pressure which is introduced into a part of the purge system including at least the fuel tank and the canister, said detected pressure change amount being obtained by detecting pressure in said part of the purge system after said part of the purge system is hermetically sealed, wherein said leakage diagnosing means further includes:

compensation means for compensating said detected pressure change amount based on said introduced pressure; and comparison means for comparing said detected pressure change amount with a determination value.

2. A leakage diagnosing apparatus for an evaporated gas purge system according to claim 1, wherein;

said compensation means compensates said detected pressure change amount such that said detected pressure change amount is reduced as said introduced pressure decreases.

3. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing puree system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein said leakage diagnosing means further includes:

comparison means for comparing said detected pressure change amount with a determination value; and compensation means for compensating said determination value based on said introduced pressure.

4. A leakage diagnosing apparatus for an evaporated gas purge system according to claim 3, wherein;

said compensation means compensates said determination value such that said determination value is increased as said introduced pressure decreases.

5. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein said leakage diagnosing means starts said detected pressure after reaching a minimum pressure in said part of the purge system.

6. A leakage diagnosing apparatus for an evaporated gas purge system having a fuel tank, an intake pipe for an engine, a passage which connects the fuel tank to the intake pipe, a canister installed in the passage for adsorbed evaporated gas from, a purge control valve installed in the passage for controlling a purge of said adsorbed evaporated gas the canister to the intake pipe, comprising;

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said leakage diagnosing means executes an evaporated gas concentration reducing operation to emit evaporated gas from the fuel tank before said pressure detection.

7. A leakage diagnosing apparatus for an evaporated gas purge system according to claim 6, wherein;

said evaporated gas concentration reducing operation includes to return a pressure in said part of the purge system to an approximately atmospheric pressure after emitting the evaporated gas from the fuel tank by changing said pressure in said part of the purge system.

8. A leakage diagnosing apparatus for an evaporated gas purge system according to claim 7, wherein;

said leakage diagnosing means detects a first pressure change amount in said part of the purge system after introducing a negative pressure into said part of the purge system;

said leakage diagnosing means executes said evaporated gas concentration reducing operation after elapsing a predetermined time period from an end of said detection of said first pressure change amount;

said leakage diagnosing means detects a second pressure change amount in said part of the purge system after an execution end of said evaporated gas concentration reducing operation; and said leakage diagnosing means determines said purge system leakage by comparing said first pressure change amount and said second pressure change amount.

9. A leakage diagnosing apparatus for an evaporated gas purge system according to claim 7, wherein;

said canister includes a canister closure valve for selectively communicating said canister with the atmosphere; and said canister closure valve opens and said purge control valve closes when said pressure in said part of the purge system returns to said approximately atmospheric pressure at an execution end of said evaporated gas concentration reducing operation.

10. A leakage diagnosing apparatus for an evaporated gas purge system according to claim 7, wherein;

said canister includes a canister closure valve for selectively communicating said canister with the atmosphere; and said canister closure valve and said purge control valve open when said pressure in said part of the purge system returns to said approximately atmospheric pressure at an execution end of said evaporated gas concentration reducing operation.

11. A leakage diagnosing apparatus for an evaporated gas purge system according to claim 6, wherein;

said apparatus includes fuel temperature determining means for determining a fuel temperature in the fuel tank; and said leakage diagnosis means determines one of an execution and a non-execution of said evaporated gas concentration reducing operation based on at least one of said determined fuel temperature and a change amount of said determined fuel temperature.

12. A leakage diagnosing apparatus for an evaporated gas purge system according to claim 6, wherein;

said leakage diagnosis means executes at least one preliminary measurement for measuring a pressure change at an approximately atmospheric pressure before diagnosing purge system leakage; and said leakage diagnosis means determines one of an execution and a non-execution of said evaporated gas concentration reducing operation based on said preliminary measurement.

13. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said leakage diagnosing means includes evaporated gas concentration determination means for determining an evaporated gas concentration from a ratio of an air fuel ratio feedback compensation amount deviation to a purge ratio during a purge execution; and said leakage diagnosing means further includes execution condition determining means for determining one of an execution and a non-execution of said purge system leakage diagnosis by comparing a change amount of said evaporated gas concentration with a comparison value.

14. A leakage diagnosing apparatus for an evaporated gas purge system according to claim 13, wherein;

said leakage diagnosing means includes comparison value determination means for determining said comparison value based on at least one of an engine cooling water, elapsed time after an engine start, and accumulated time of an execution of the purge.

15. A leakage diagnosing apparatus for an evaporated gas purge system according to claim 13, wherein;

said leakage diagnosing means includes compensation means for compensating said detected pressure change amount based on at least one of said evaporated gas concentration and said change amount of said evaporated gas concentration.

16. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing puree system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said leakage diagnosing means includes evaporated gas concentration determination means for determining an evaporated gas concentration from a ratio of an air fuel ratio feedback compensation amount deviation to a purge ratio during a purge execution; and said leakage diagnosing means further includes execution condition determining means for determining one of an execution and a non-execution of said purge system leakage diagnosis by comparing both a change amount of said evaporated gas concentration and said evaporated gas concentration with a comparison value.

17. A leakage diagnosing apparatus for an evaporated gas purge system according to claim 16, wherein;

said leakage diagnosing means includes comparison value determination means for determining said comparison value based on at least one of an engine cooling water, elapsed time after an engine start, and accumulated time of said purge execution.

18. A leakage diagnosing apparatus for an evaporated gas purge system according to claim 17, wherein;

said leakage diagnosing means includes compensation means for compensating said detected pressure change amount based on at least one of said evaporated gas concentration and said change amount of said evaporated gas concentration.

19. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said leakage diagnosing means includes evaporated gas concentration determination means for determining an evaporated gas concentration from a ratio of a purge ratio to an air fuel ratio feedback compensation amount deviation during a purge execution;

said leakage diagnosing means further includes execution condition determining means for determining one of an execution and a non-execution of said purge system leakage diagnosis by comparing said evaporated gas concentration with a comparison value; and said leakage diagnosing means further includes comparison value determination means for determining said comparison value based on at least one of an engine cooling water, elapsed time after an engine start, and accumulated time of said purge execution.

20. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said apparatus includes anticipated compensation means for compensating a fuel injection amount such that an anticipated deviation of an air fuel ratio, caused by introducing a negative pressure of the intake pipe into said part of the purge system under said purge system leakage diagnosis during an idling of the engine, is reduced.

21. A leakage diagnosing apparatus for an evaporated gas purge system according to claim 20, wherein;

said anticipated compensation means determines an anticipated compensation amount at said negative pressure introduction based on an atmospheric temperature in the fuel tank.

22. A leakage diagnosing apparatus for an evaporated gas purge system according to claim 21, wherein;

said apparatus includes temperature detecting means for detecting at least one of an intake air temperature, an outside air temperature, and an engine cooling water temperature;

said apparatus further includes atmospheric temperature estimation means for estimating said atmospheric temperature in the fuel tank at a start of the engine based on a detected temperature detected by said temperature detecting means at said start of the engine; and said atmospheric temperature estimation means further determines current atmospheric temperature in the fuel tank by compensating said estimated atmospheric temperature based on at least one of a vehicle running condition after said start of the engine and elapsed time after said start of the engine.

23. A leakage diagnosing apparatus for an evaporated gas purge system according to claim 20, wherein;

said anticipated compensation means compensates an anticipated compensation amount at said negative pressure introduction based on one of a deviation of an air fuel ratio feedback compensation amount and a deviation of an average value of said air fuel ratio feedback compensation amount.

24. A leakage diagnosing apparatus for an evaporated gas purge system according to claim 20, wherein;

said apparatus includes evaporated gas concentration compensation amount calculating means for calculating an evaporated gas concentration compensation amount by multiplying a purge ratio by an air fuel ratio feedback compensation amount deviation per 1% of said purge ratio; and said anticipated compensation means compensates said fuel injection amount at said negative pressure introduction based on an amount of said anticipated compensation and said evaporated gas concentration compensation amount.

25. A leakage diagnosing apparatus for an evaporated gas purge system according to claim 20, wherein;

said apparatus includes evaporated gas concentration compensation amount calculating means for calculating an evaporated gas concentration compensation amount by multiplying a purge ratio by an air fuel ratio feedback compensation amount deviation per 1% of said purge ratio; and said anticipated compensation means determines an amount of said anticipated compensation based on said evaporated gas concentration compensation amount.

26. A leakage diagnosing apparatus for an evaporated gas purge system according to claim 20, wherein;

said anticipated compensation means starts to compensate said fuel injection amount with a delayed period after a start of said negative pressure introduction.

27. A leakage diagnosing apparatus for an evaporated gas purge system according to claim 20, wherein;

said anticipated compensation means gradually increases an amount of said anticipated compensation after a start of said negative pressure introduction.

28. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure change amount and an introduced pressure which is introduced into a part of the purge system including at least the fuel tank and the canister, said detected pressure change amount being obtained by detecting pressure in said part of the purge system after said part of the purge system is hermetically sealed, wherein;

said apparatus includes engine speed increase control means for increasing an intake air amount by increasing an engine speed of the engine until an end of a negative pressure introduction from the intake pipe into said part of the purge system at the latest, while diagnosing said purge system leakage during an idling of the engine.

29. A leakage diagnosing apparatus for an evaporated gas purge system according to claim 28, wherein;

said engine speed increase control means determines an increased amount of said engine speed based on at least one of an intake air temperature, an outside air temperature, a cooling water temperature, an evaporated gas concentration learned value, a deviation of an air fuel ratio feedback compensation amount, and an average value deviation of said air fuel ratio feedback compensation amount.

30. A leakage diagnosing apparatus for an evaporated gas purge system according to claim 28, wherein;

said apparatus includes anticipated compensation means for compensating a fuel injection amount until an end of a negative pressure introduction from the intake pipe into said part of the purge system at the latest such that an anticipated deviation of an air fuel ratio is reduced.

31. A leakage diagnosing apparatus for an evaporated gas purge system having a fuel tank, an intake pipe for an engine, a passage which connects the fuel tank to the intake pipe, a canister installed in the passage for adsorbed evaporated gas, a purge control valve installed in the passage for controlling a purge of said adsorbed evaporated gas from the canister to the intake pipe, comprising:

leakage diagnosing means for diagnosing purge system leakage based on a detected pressure chance amount and an introduced pressure which is introduced into a part of the purge system including at least the fuel tank and the canister, said detected pressure change amount being obtained by detecting pressure in said part of the purge system after said part of the purge system is hermetically sealed, wherein;

said apparatus includes fuel consumption determining means for determining a fuel amount consumed by the engine, and remaining fuel determining means for determining one of a remaining fuel amount and an air amount in said fuel tank; and said leakage diagnosis means compensates one of said detected pressure and said detected pressure change amount based on both the consumed fuel amount determined by said fuel consumption determining means and said one of a remaining fuel amount and an air amount in said fuel tank determined by said remaining fuel determining means.

32. A leakage diagnosing apparatus for an evaporated gas purge system according to claim 31, wherein;

said leakage diagnosis means compensates one of said detected pressure and said detected pressure change amount based on a ratio of said consumed fuel amount to an air volume in the fuel tank.

33. A leakage diagnosing apparatus for an evaporated gas purge system according to claim 31, wherein;

said fuel consumption determining means determines said consumed fuel amount based on at least one of a fuel injection amount, a vehicle speed, an engine speed, an intake air volume, an intake pipe pressure.

34. An abnormality diagnosing apparatus for an evaporated gas purge system having a fuel tank, an intake pipe for an engine, a passage which connects the fuel tank to the intake pipe, a canister installed in the passage for adsorbing evaporated gas, a purge control valve installed in the passage for controlling a purge of said adsorbed evaporated gas from the canister to the intake pipe, comprising;

abnormality diagnosing means for diagnosing purge system abnormality based on a detected pressure change amount in a part of the purge system including at least the fuel tank and the canister, said detected pressure change amount being obtained by detecting pressure in said part of the purge system after sealing said part of the purge system hermetically, and wherein;

said abnormality diagnosing means executes an evaporated gas concentration reducing operation to emit evaporated gas from the fuel tank before said pressure detection.

35. An abnormality diagnosing apparatus for an evaporated gas purge system according to claim 34, wherein;

said evaporated gas concentration reducing operation includes to return a pressure in said part of the purge system to an approximately atmospheric pressure after emitting the evaporated gas from the fuel tank by changing said pressure in said part of the purge system.

36. An abnormality diagnosing apparatus for an evaporated gas purge system according to claim 35, wherein;

said abnormality diagnosing means detects a first pressure change amount in said part of the purge system after introducing a negative pressure into said part of the purge system;

said abnormality diagnosing means executes said evaporated gas concentration reducing operation after elapsing a predetermined time period from an end of said detection of said first pressure change amount;

said abnormality diagnosing means detects a second pressure change amount in said part of the purge system after an execution end of said evaporated gas concentration reducing operation; and said abnormality diagnosing means determines said purge system leakage by comparing said first pressure change amount and said second pressure change amount.

37. An abnormality diagnosing apparatus for an evaporated gas purge system according to claim 35, wherein;

said canister includes a canister closure valve for selectively communicating said canister with the atmosphere; and said canister closure valve opens and said purge control valve closes when said pressure in said part of the purge system returns to said approximately atmospheric pressure at an execution end of said evaporated gas concentration reducing operation.

38. An abnormality diagnosing apparatus for an evaporated gas purge system according to claim 35, wherein;

said canister includes a canister closure valve for selectively communicating said canister with the atmosphere; and said canister closure valve and said purge control valve open when said pressure in said part of the purge system returns to said approximately atmospheric pressure at an execution end of said evaporated gas concentration reducing operation.

39. An abnormality diagnosing apparatus for an evaporated gas purge system according to claim 34, wherein;

said apparatus includes fuel temperature determining means for determining a fuel temperature in the fuel tank; and said abnormality diagnosis means determines one of an execution and a non-execution of said evaporated gas concentration reducing operation based on at least one of said determined fuel temperature and a change amount of said determined fuel temperature.

40. An abnormality diagnosing apparatus for an evaporated gas purge system according to claim 34, wherein;

said abnormality diagnosis means executes at least one preliminary measurement for measuring a pressure change at an approximately atmospheric pressure before diagnosing purge system abnormality; and said abnormality diagnosis means determines one of an execution and a non-execution of said evaporated gas concentration reducing operation based on said preliminary measurement.

41. An abnormality diagnosing apparatus for an evaporated gas purge system having a fuel tank, an intake pipe for an engine, a passage which connects the fuel tank to the intake pipe, a canister installed in the passage for adsorbing evaporated gas, a purge control valve installed in the passage for controlling a purge of said adsorbed evaporated gas from the canister to the intake pipe, comprising;

abnormality diagnosing means for diagnosing purge system abnormality based on one of a detected pressure and a detected pressure change amount in a part of the purge system including at least the fuel tank and the canister, said one of said detected pressure and said detected pressure change amount being obtained by detecting pressure in said part of the purge system after sealing said part of the purge system hermetically, and wherein;

said abnormality diagnosing means includes evaporated gas concentration determination means for determining an evaporated gas concentration from a ratio of an air fuel ratio feedback compensation amount deviation to a purge ratio during a purge execution; and said abnormality diagnosing means further includes execution condition determining means for determining one of an execution and a non-execution of said purge system abnormality diagnosis by comparing at least one of said determined evaporated gas concentration and a change amount of said evaporated gas concentration with a comparison value.

42. An abnormality diagnosing apparatus for an evaporated gas purge system according to claim 41, wherein;

said abnormality diagnosing means includes comparison value determination means for determining said comparison value based on at least one of an engine cooling water, elapsed time after an engine start, and accumulated time of an execution of the purge.

43. An abnormality diagnosing apparatus for an evaporated gas purge system according to claim 41, wherein;

said abnormality diagnosing means includes compensation means for compensating said detected pressure change amount based on at least one of said evaporated gas concentration and said change amount of said evaporated gas concentration.

44. An abnormality diagnosing apparatus for an evaporated gas purge system having a fuel tank, an intake pipe for an engine, a passage which connects the fuel tank to the intake pipe, a canister installed in the passage for adsorbing evaporated gas, a purge control valve installed in the passage for controlling a purge of said adsorbed evaporated gas from the canister to the intake pipe, comprising;

abnormality diagnosing means for diagnosing purge system abnormality based on one of a detected pressure and a detected pressure change amount in a part of the purge system including at least the fuel tank and the canister, said one of said detected pressure and said detected pressure change amount being obtained by detecting pressure in said part of the purge system after sealing said part of the purge system hermetically; and anticipated compensation means for compensating a fuel injection amount such that an anticipated deviation of an air fuel ratio, caused by introducing a negative pressure of the intake pipe into said part of the purge system under said purge system abnormality diagnosis during an idling of the engine, is reduced.

45. An abnormality diagnosing apparatus for an evaporated gas purge system according to claim 44, wherein;

said anticipated compensation means determines an anticipated compensation amount at said negative pressure introduction based on an atmospheric temperature in the fuel tank.

46. An abnormality diagnosing apparatus for an evaporated gas purge system according to claim 45, wherein;

said apparatus includes temperature detecting means for detecting at least one of an intake air temperature, an outside air temperature, and an engine cooling water temperature;

said apparatus further includes atmospheric temperature estimation means for estimating said atmospheric temperature in the fuel tank at a start of the engine based on a detected temperature detected by said temperature detecting means at said start of the engine; and said atmospheric temperature estimation means further determines current atmospheric temperature in the fuel tank by compensating said estimated atmospheric temperature based on at least one of a vehicle running condition after said start of the engine and elapsed time after said start of the engine.

47. A leakage diagnosing apparatus for an evaporated gas purge system according to claim 44, wherein;

said anticipated compensation means compensates an anticipated compensation amount at said negative pressure introduction based on one of a deviation of an air fuel ratio feedback compensation amount and a deviation of an average value of said air fuel ratio feedback compensation amount.

48. An abnormality diagnosing apparatus for an evaporated gas purge system according to claim 44, wherein;

said apparatus includes evaporated gas concentration compensation amount calculating means for calculating an evaporated gas concentration compensation amount by multiplying a purge ratio by an air fuel ratio feedback compensation amount deviation per 1% of said purge ratio; and said anticipated compensation means compensates said fuel injection amount at said negative pressure introduction based on an amount of said anticipated compensation and said evaporated gas concentration compensation amount.

49. An abnormality diagnosing apparatus for an evaporated gas purge system according to claim 44, wherein;

said apparatus includes evaporated gas concentration compensation amount calculating means for calculating an evaporated gas concentration compensation amount by multiplying a purge ratio by an air fuel ratio feedback compensation amount deviation per 1% of said purge ratio; and said anticipated compensation means determines an amount of said anticipated compensation based on said evaporated gas concentration compensation amount.

50. An abnormality diagnosing apparatus for an evaporated gas purge system according to claim 44, wherein;

said anticipated compensation means starts to compensate said fuel injection amount with a delayed period after a start of said negative pressure introduction.

51. An abnormality diagnosing apparatus for an evaporated gas purge system according to claim 44, wherein;

said anticipated compensation means gradually increases an amount of said anticipated compensation after a start of said negative pressure introduction.

52. An abnormality diagnosing apparatus for an evaporated gas purge system having a fuel tank, an intake pipe for an engine, a passage which connects the fuel tank to the intake pipe, a canister installed in the passage for adsorbing evaporated gas, a purge control valve installed in the passage for controlling a purge of said adsorbed evaporated gas from the canister to the intake pipe, comprising;

abnormality diagnosing mean s for diagnosing purge system abnormality based on one of a detected pressure and a detected pressure change amount in a part of the purge system including at least the fuel tank and the canister, said one of said detected pressure and said detected pressure change amount being obtained by detecting pressure in said part of the purge system after sealing said part of the purge system hermetically; and engine speed increase control means for increasing an intake air amount by increasing an engine speed of the engine until an end of a negative pressure introduction from the intake pipe into said part of the purge system at the latest, while diagnosing said purge system abnormality during an idling of the engine.

53. An abnormality diagnosing apparatus for an evaporated gas purge system according to claim 52, wherein;

said engine speed increase control means determines an increased amount of said engine speed based on at least one of an intake air temperature, an outside air temperature, a cooling water temperature, an evaporated gas concentration learned value, a deviation of an air fuel ratio feedback compensation amount, and an average value deviation of said air fuel ratio feedback compensation amount.

54. An abnormality diagnosing apparatus for an evaporated gas purge system according to claim 52, wherein;

said apparatus includes anticipated compensation means for compensating a fuel injection amount until an end of a negative pressure introduction from the intake pipe into said part of the purge system at the latest such that an anticipated deviation of an air fuel ratio is reduced.

55. A leakage diagnosing apparatus for an evaporated gas purge system having a fuel tank, an intake pipe for an engine, a passage which connects the fuel tank to the intake pipe, a canister installed in the passage for adsorbing evaporated gas, a purge control valve installed in the passage for controlling a purge of said adsorbed evaporated gas from the canister to the intake pipe, comprising;

leakage diagnosing means for diagnosing purge system leakage based on one of a detected pressure and a detected pressure change amount in a part of the purge system including at least the fuel tank and the canister, said one of said detected pressure and said detected pressure change amount being obtained by detecting pressure in said part of the purge system after sealing said part of the purge system hermetically; and fuel consumption determining means for determining a fuel amount consumed by the engine; wherein said leakage diagnosis means compensates one of said detected pressure and said detected pressure change amount based on said consumed fuel amount determined by said fuel consumption determining means.

56. A leakage diagnosing apparatus for an evaporated gas purge system according to claim 55, wherein;

said leakage diagnosis means compensates one of said detected pressure and said detected pressure change amount based on a ratio of said consumed fuel amount to an air volume in the fuel tank.

57. A leakage diagnosing apparatus for an evaporated gas purge system according to claim 56, wherein;

said fuel consumption determining means determines said consumed fuel amount based on at least one of a fuel injection amount, a vehicle speed, an engine speed, an intake air volume, an intake pipe pressure.

58. A leakage diagnosing apparatus for an evaporated gas purge system according to claim 31, wherein said introduced pressure is a negative pressure.

59. A leakage diagnosing apparatus for an evaporated gas purge system according to claim 31, wherein an amount that said one of said detected pressure change amount and said detected pressure is compensated increases as said remaining fuel amount increases.

* * * * *